United States Patent [19]

Hosoi et al.

[11] Patent Number: 5,064,181

[45] Date of Patent: Nov. 12, 1991

[54] PAPER HANDLING APPARATUS

[75] Inventors: Masatoshi Hosoi; Tsutomu Ichinose; Masashi Shimada, all of Nagoya; Shin Umeda; Hirobumi Yoshino, both of Tokyo, all of Japan

[73] Assignee: Ricoh Company, Ltd., Tokyo, Japan

[21] Appl. No.: 464,193

[22] Filed: Jan. 12, 1990

[30] Foreign Application Priority Data

| | | | |
|---|---|---|---|
| Jan. 19, 1989 | [JP] | Japan | 1-8452 |
| Jan. 19, 1989 | [JP] | Japan | 1-8460 |
| Dec. 5, 1989 | [JP] | Japan | 1-314219 |

[51] Int. Cl.[5] ..... B42B 1/02

[52] U.S. Cl. ..... 270/53; 270/58

[58] Field of Search ..... 270/37, 53, 58

[56] References Cited

U.S. PATENT DOCUMENTS

| | | | |
|---|---|---|---|
| 4,901,994 | 2/1990 | Ishiguro | 270/53 |
| 4,930,761 | 6/1990 | Naito | 270/53 |
| 4,971,302 | 11/1990 | Morii | 270/53 |

FOREIGN PATENT DOCUMENTS

| | | | |
|---|---|---|---|
| 236165 | 9/1989 | Japan | 270/53 |
| 281258 | 11/1989 | Japan | 270/53 |

*Primary Examiner*—Edward K. Look
*Assistant Examiner*—Therese M. Newholm
*Attorney, Agent, or Firm*—Oblon, Spivak, McClelland, Maier & Neustadt

[57] ABSTRACT

A paper handling apparatus having a plurality of bins, a paper positioning device for positioning paper sheets which are sequentially distributed to the bins, and a stapler for stapling the paper sheets stacked on the bins. A controller causes the paper positioning device to position the paper sheets even after the latter has been stapled by the stapler.

9 Claims, 73 Drawing Sheets

| Fig.53A | Fig.53B |
|---|---|

| Fig.65A |
|---|
| Fig.65B |

| Fig.69A |
| --- |
| Fig.69B |

PIVOT ERROR DETECTION
PIVOT MOTOR ON ?
(71-1)
YES
NO
PIVOT ERROR TIMER OPERATING?
(71-2)
YES
NO
START PIVOT ERROR TIMER
(71-3)
CHANGE OF PIVOT HOME SENSOR FROM OFF TO ON ?
(71-4)
YES
NO
PIVOT ERROR TIMER OVER ?
(71-5)
YES
NO

| Fig.72A |
| --- |
| Fig.72B |

| Fig.73A |
| --- |
| Fig.73B |

| Fig.74A |
| --- |
| Fig.74B |

PAPER HANDLING APPARATUS

BACKGROUND OF THE INVENTION

The present invention relates to a paper handling apparatus for use with a copier, printer or similar equipment.

Paper sheets driven out of a copier or a printer, for example, have customarily been stacked on individual bins of a sorter or stacker. The stacks of paper sheets are removed from the bins one by one and then bound together by a stapler, punched and then fastened, or bound together by paste. However, picking up the paper stacks one by one out of the bins for binding or otherwise treating them is troublesome and not efficient. A recent achievement in the realm of equipment of the kind described is a paper handling apparatus capable of stapling or otherwise handling paper stacks within bins thereof and, in this sense, sometimes referred to as a sorter and stapler. Typical of this type of paper handling apparatuses is an apparatus which distributes a predetermined number of paper sheets to each of all of the bins and then staple the paper sheets bin by bin, as disclosed in Japanese Patent Laid-Open Publication (Kokai) Nos. 62-290655, 63-60871, and 63-116168. A copier with such a sorter and stapler is generally provided with a function of positioning the paper sheets distributed to the bins. Should the paper sheets be not positioned or neatly arranged on the individual bins, the stapler would fail to bind them neatly. To promote efficient stapling, an arrangement may be made such that as soon as a paper sheet associated with the last document enters the first bin, a stapling operation begins at the first bin without awaiting the delivery of a predetermined number of paper sheets to all of the bins.

Also known in the art is a paper handling apparatus with a so-called dual sort type sorter which has first and second sorter means for distributing paper sheets driven out of equipment body to a plurality of bins. This kind of apparatus is capable of sorting paper sheets of different sizes. A problem with such an apparatus is that providing dual paper positioning means in association with the dual sorter means results in a complicated construction and an increase in cost. It has been customary, therefore, to position paper sheets on all of the bins at a time. This, however, prevents paper sheets of different sizes to be positioned at the same time. Of course, stapling a stack of paper sheets which are not neatly arranged does not make any sense.

A dual sort and staple mode is available with the above-stated prior art apparatus. In such a mode, a plurality of bins are divided into two blocks, and paper sheets distributed to the individual blocks are sorted and stapled endlessly. A problem particular to this mode is that paper stacks on the bins belonging to the first block are dislocated by the operation of stapling means and in turn prevent paper stacks distributed to the second block from being accurately positioned.

With the prior art stated above, efficient manipulations are not achievable because paper sheets of different sizes cannot be sorted in the dual mode.

Further, assume that the copier has run out of paper sheets before the delivery of copies of the last document to all of the predetermined bins. Then, the prior art apparatus staples paper stacks up to the bin to which a copy of the last document was delivered last and, after the supply of paper sheets to the copier, resumes the stapling operation. Since paper sheets are necessarily positioned before stapling, the paper sheets having been stapled before the supply of paper sheets are also positioned. This brings about a problem that since the stapled paper stacks are dislocated on the individual bins, an increase in the number of bins directly translates into an increase in the load acting on a motor which drives the paper positioning device, resulting in the need for a motor having a great torque. Such a motor is not only expensive but also bulky and is, therefore, disadvantageous from the space factor standpoint.

SUMMARY OF THE INVENTION

It is therefore an object of the present invention to provide a paper handling apparatus capable of stapling paper stacks after surely positioning them.

It is another object of the present invention to provide a paper handling apparatus capable of sorting paper sheets of different sizes also.

It is another object of the present invention to provide a paper handling apparatus which sufficiently positions paper sheets by using a low-torque, inexpensive and miniature motor.

In accordance with the present invention, a paper handling apparatus comprises a plurality of bins, a paper positioning unit for positioning paper sheets distributed to the plurality of bins, a stapling unit for stapling the paper sheets loaded on the plurality of bins, and a control for causing the positioning unit to act on the paper sheets even after the paper sheets have been bound by the stapling unit.

Also, in accordance with the present invention, a paper handling apparatus comprises first sorter means and second sorter means for distributing paper sheets driven out equipment body to a plurality of bins, a positioning unit for positioning the paper sheets loaded on the plurality of bins, a stapling unit for binding the paper sheets loaded on the plurality of bins, a size information sensor for sensing size information associated with the paper sheets reached the first sorter means and the second sorter means, a size information signal detector for receiving from the equipment body a size information signal which is representative of a size of paper sheets driven out of the equipment body, and a control for inhibiting the stapling unit from operating when the size information associated with the paper sheets reached the first sorter means and the second sorter means are different from each other as determined on the basis of either one of the size information sensor and the size information signal detector.

Further, in accordance with the present invention, a paper handling apparatus comprises first sorter means and second sorter means for distributing paper sheets driven out of equipment body to a plurality of bins, a positioning unit for positioning the paper sheets loaded on the plurality of bins, a stapling unit for stapling the paper sheets loaded on the plurality of bins, a size information sensor for sensing size information associated with the paper sheets reached the first sorter means and the second sorter means, a size information signal detector for receiving from the equipment body a size information signal representative of a size of paper sheets driven out of the equipment body, and a control for inhibiting the positioning unit from operating when the size information associated with the first sorter means and the second sorter means are different from each other as determined on the basis of either one of the size information sensor and the size information signal detector.

BRIEF DESCRIPTION OF THE DRAWINGS

The above and other objects, features and advantages of the present invention will become more apparent from the following detailed description taken with the accompanying drawings in which:

FIGS. 54A, 54B-1, and 54B-2 are flowcharts indicating a general procedure executed by the control system;

FIGS. 55A-1, 55A-2, 55B-1, 55B-2, and 55C are flowcharts showing a sequence of steps for stapling;

FIGS. 56A, 56B-1, and 56B-2 are flowcharts showing a procedure for operating the pivoting unit;

DESCRIPTION OF THE PREFERRED EMBODIMENT

Figure 1:
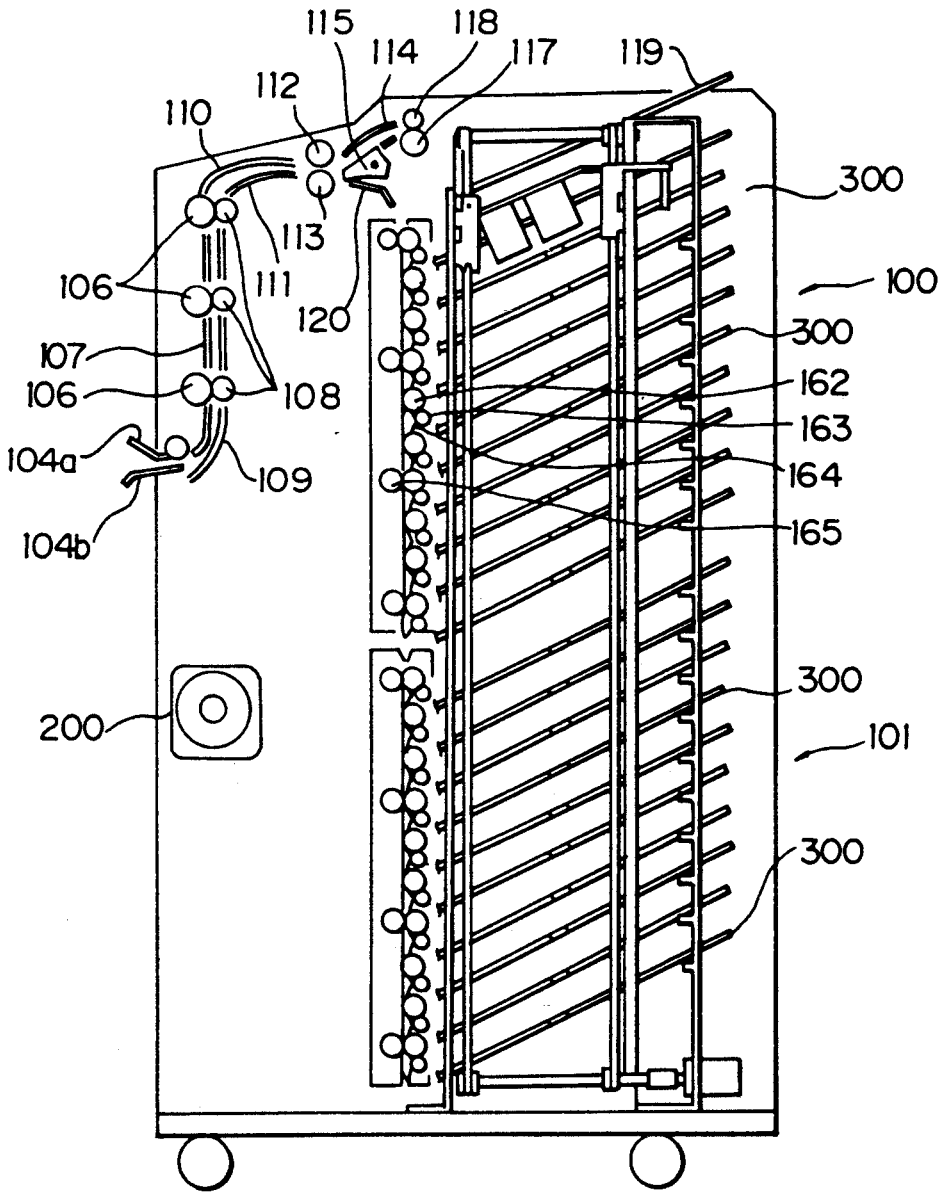
FIG. 1 is a front view of a paper handling apparatus embodying the present invention.

Referring to FIG. 1 of the drawings, a paper handling apparatus embodying the present invention is shown. As shown, the apparatus has inlet guides 104*a* and 104*b* located at an inlet for receiving copy sheets which are sequentially driven out of a copier or similar equipment. Guides 107, 109, 110 and 111, transport rollers 106, 108, 112 and 113, and a selector in the form of a pawl 115 are arranged downstream of the inlet guides 104*a* and 104*b* for transporting the incoming copy sheets upward. The selector 115 is movable to select either one of two independent paths, i.e., an upper path extending from a guide 114 to a discharge tray 119 via a discharge roller pair 117 and 118 and a lower path extending from a guide 120 to merge into a vertical transport path. The vertical transport path extends along the inlet ends of a plurality of, twenty in the illustrative embodiment, bins 300. The bins 300 are arranged one above another and in parallel to each other, and they are individually inclined obliquely upward, as illustrated. On the vertical transport path, a deflector in the form of a pawl 164, a transport roller 162 and a discharge roller 163 are provided and associated with each of the bins 300. The transport roller 162 and discharge roller 163 are provided in a pair. Driven rollers 165 are pressed against some of the transport rollers 162 which are spaced apart from each other by a suitable distance. The transport rollers 106, 108, 112 and 113, discharge rollers 117 and 118, transport rollers 162, and discharge rollers 163 are driven by a drive motor 200.

Figure 2:
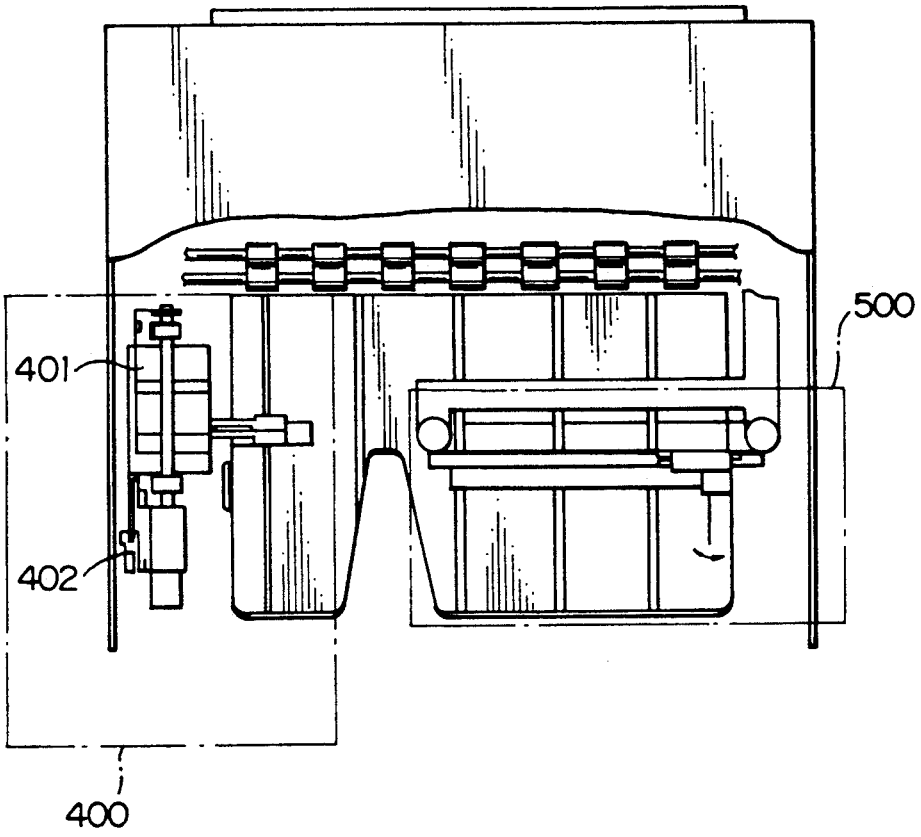
FIG. 2 is a plan view of the apparatus shown in FIG. 1.

As shown in FIG. 2, a stapling or binding device 400 is located at one side of the group of bins 300. The stapling device 400 is made up of stapler 401 serving as stapling means which will be described, a device 402 for pulling a stack of paper sheets toward the stapler 401 (hereinafter referred to as a chuck), and a mechanism for moving the stapler 401 and chuck section 402 up and down to any one of the bins 300. Located at the other side of the group of bins 300 is a pivoting device 500 which has pushing members playing the roll of regulating means for positioning or neatly arranging paper sheets before the latter is stapled, and a device for shifting each pushing member to a position which matches a paper size.

Figure 3:
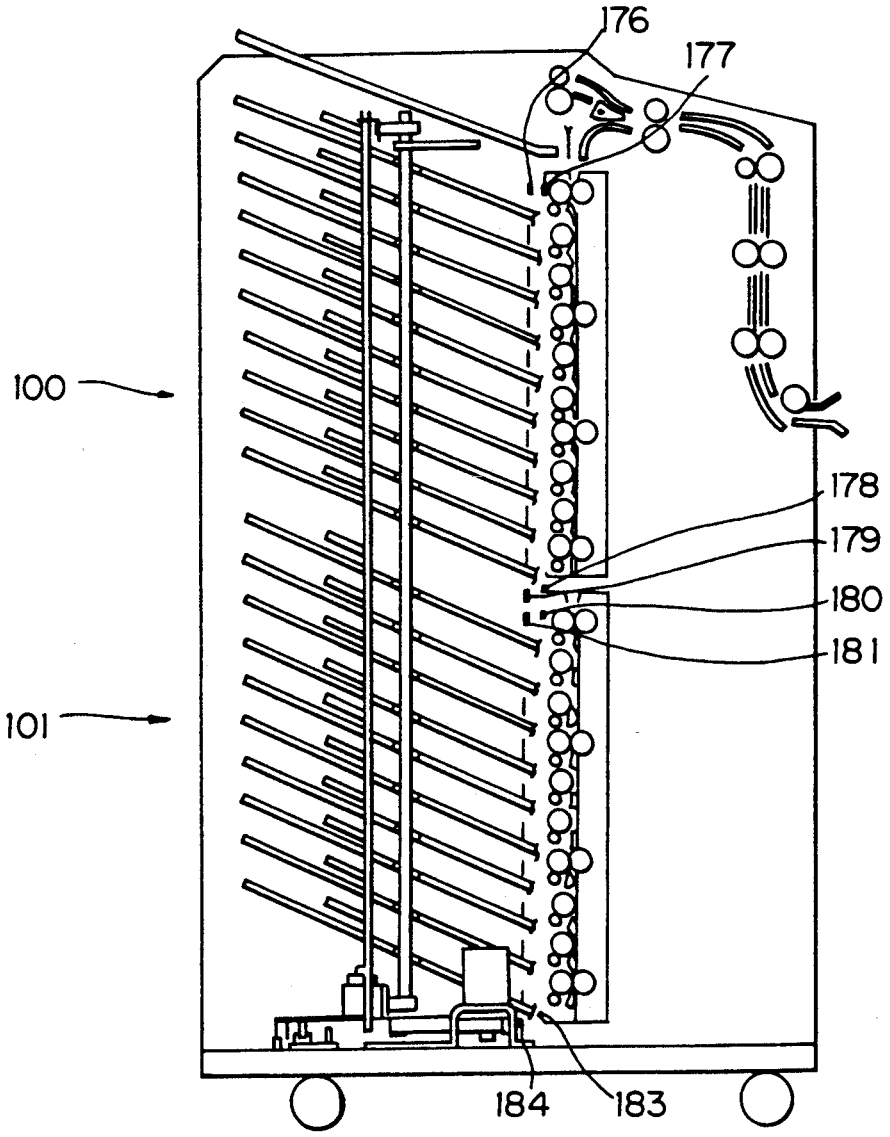
FIG. 3 is a rear view of the apparatus shown in FIG. 1.

FIG. 3 is a rear view of the apparatus shown in FIG. 1. The twenty bins 300 are divided into a first block or first sorter means 100 and a second block or second sorter means 101 each having ten bins. Bin sensors 176 and 179 and discharge sensors 177 and 178 are associated with the upper block (first sorter means) 100, while bin sensors 181 and 184 and discharge sensors 180 and 183 are associated with the lower block (second sorter means) 101. The sensors 176 to 184 are each implemented as a transmission type photosensor which is composed of a light emitting diode and a phototransistor. The discharge sensors 177, 178, 180 and 183 are each responsive to the discharge of a paper sheet or copy, while the bin sensors 176, 179, 181 and 184 are each responsive to a copy in the associated bins 300. With the bin sensors 176, 179, 181 and 184, it is possible to use the lower block 101 if the upper block 100 is loaded with copies.

In operation, a copy driven out of a copier enters the paper handling apparatus via the inlet guides 104*a* and 104*b* and is transported upward by the guides 107, 109, 110 and 111 and transport rollers 106, 108, 112 and 113. In an ordinary discharge mode, the selector 115 is lowered to steer the copy toward the discharge tray 119 via the guide 114 and discharge roller pair 117 and 118. In a sort mode (sorting copies in order of page) or a stack mode (sorting copies page by page), the selector 115 is raised to steer the copy upward along the guide 120. The copy driven by the transport rollers 162 and driven rollers 165 is distributed to a particular bin 300 where the associated deflector 164 is held in an operative position. The deflectors 164 are moved in matching relation to the mode (sort mode or stack mode).

In the sort mode, the deflector 164 associated with the first bin is actuated to discharge the copy to the first bin 300. The second copy of the first page is discharged to the second bin 300 by the deflector 164 associated with the second bin 300. The first copy of the second page is distributed to the first bin 300, and the second copy of the second page is distributed to the second bin 300. In this manner, in the sort mode, the first page and successive pages are sequentially distributed to each bin 300. In the stack mode, all the copies of the first page are discharged to the first bin, while all the copies of the second page are discharged to the second bin.

Hereinafter will be described mechanisms necessary for the copies sorted in either one of the above-stated modes to be stapled. To staple a plurality of stacks of copies, they have to be neatly arranged. To meet this requirement, the illustrative embodiment includes the pivoting device 500 which will be described with reference to FIGS. 4 to 8.

Figure 4:
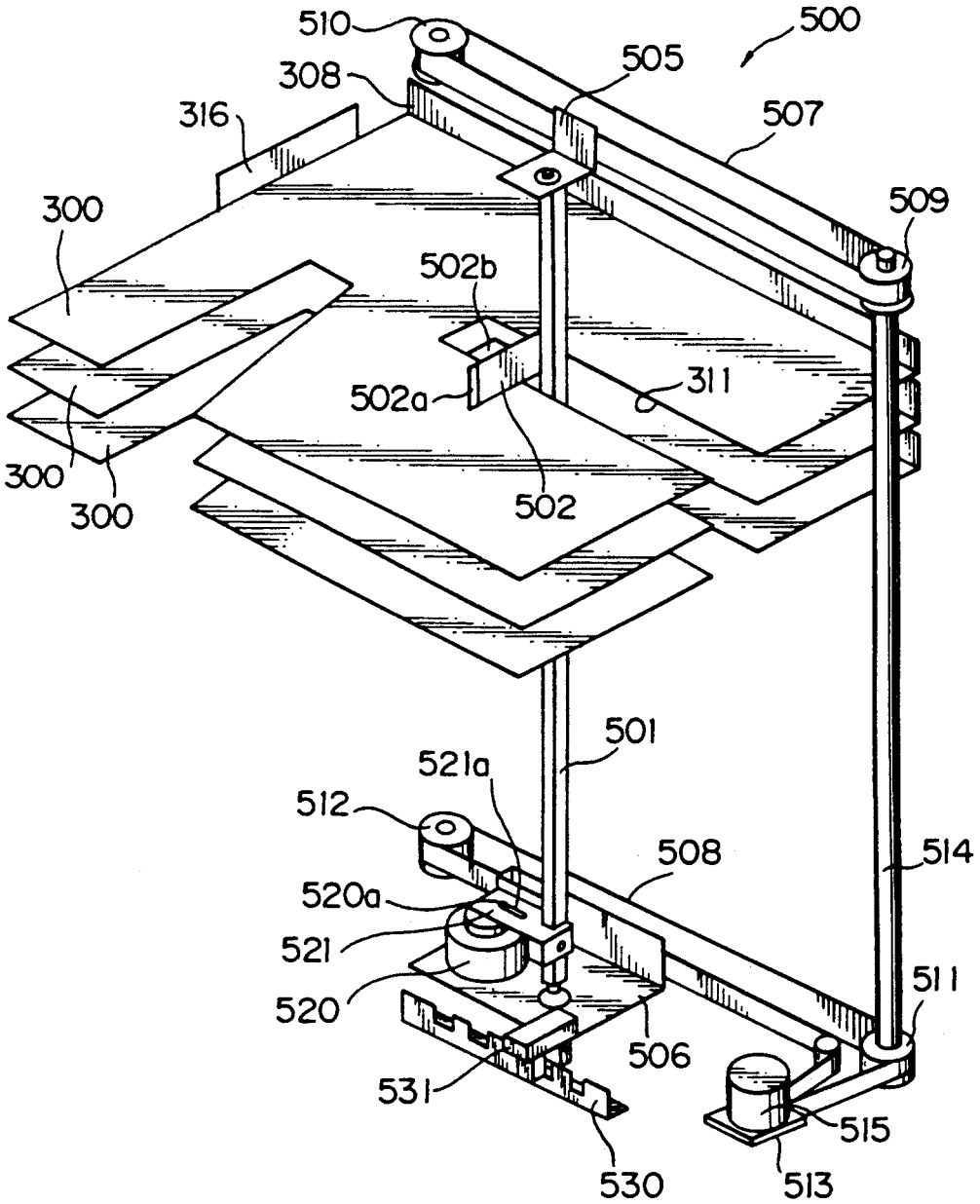
FIG. 4 is a perspective view showing a pivoting device included in the apparatus of FIG. 1.
Figure 5:
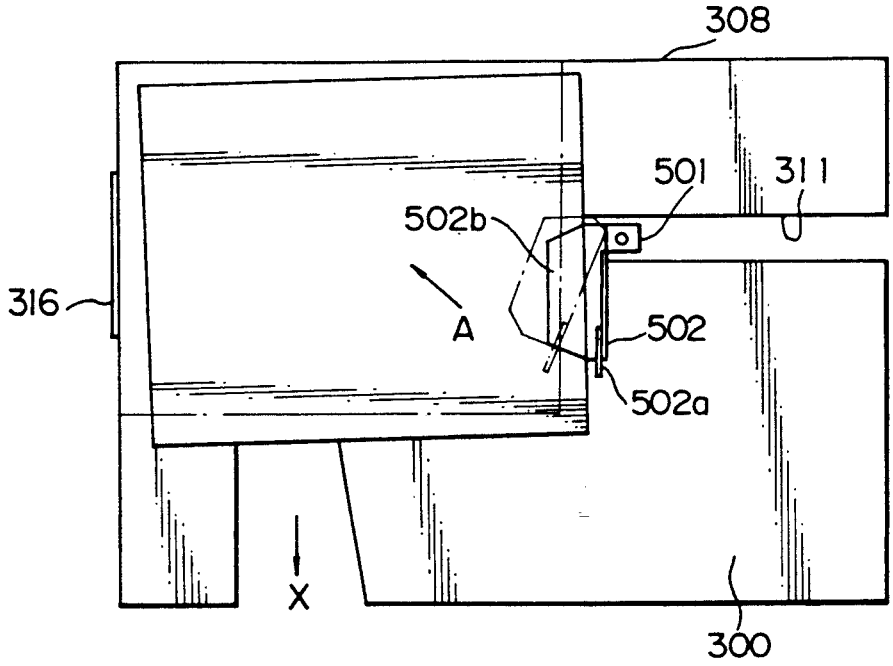
FIG. 5 is a plan view showing a relationship between the pivoting device and bins.
Figure 6:
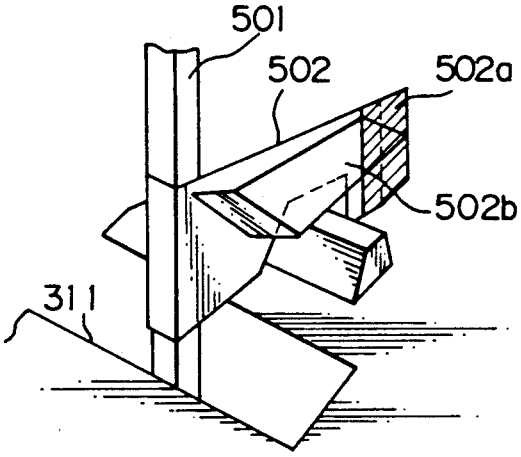
FIG. 6 is a perspective view of a pushing member included in the pivoting device.
Figure 7:
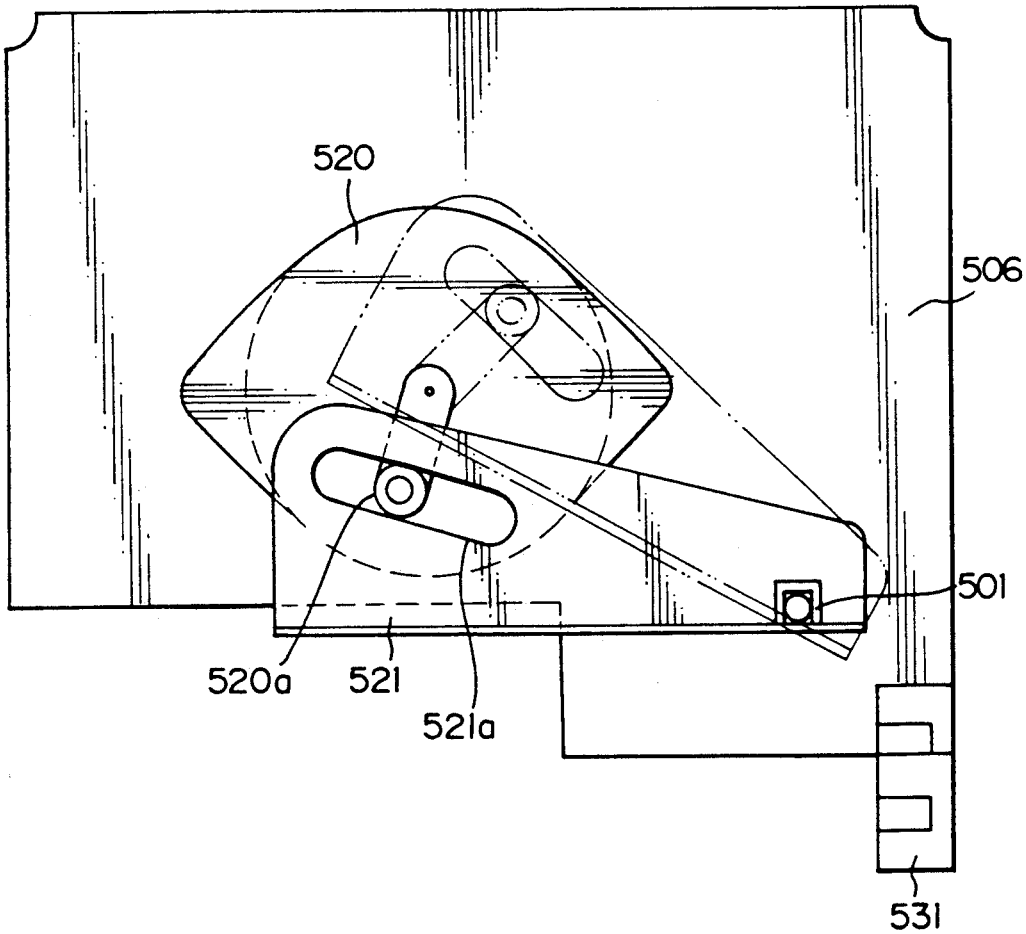
FIG. 7 is a plan view of a pivot motor and its associated elements forming part of the pivoting device.

Referring to FIGS. 4 and 5, each bin 300 has an upright bin fence 316 at one edge thereof. A rear end upright portion extends upward from another edge of the bin 300 which is perpendicular to the edge where the bin fence 316 is located. A notched portion 311 extends from the edge of the bin 300 which is parallel to the edge where the bin fence 316 is located. The notched portion 311 extends over a predetermined length toward the bin fence 316. A main shaft 501 has a rectangular cross-section and extends upright throughout the notched portions 311 of the bins 300. A plurality of pushing members or pushers 502 are mounted on the shaft 501 at spaced locations each corresponding to respective one of the bins 300. Each pusher 502 abuts against the end of a stack of paper sheets for positioning purpose, as will be described. As shown in FIG. 6, the pusher 502 is made up of elastic pushing pieces 502*a* and 502*b* which face the bin fence 316 and serve to absorb scattering in position particular to the pusher 502 and bin 300. When the paper sheet is curled upward, the elastic member 502*b* presses it so that the pusher 502 surely abuts against the end of a paper stack.

Generally L-shaped brackets 505 and 506 are respectively mounted on the upper end and the lower end of the main shaft 501. Timing belts 507 and 508 are respectively disposed in an upper region and a lower region of the bins 300, and each extends substantially in the same direction as the notched portions 311. The brackets 505 and 506 are anchored to the timing belts 507 and 508, respectively. The timing belt 507 is passed over pulleys 509 and 510, while the timing belt 508 is passed over pulleys 511, 512 and 513. The pulleys 509 and 511 which are drive pulleys are respectively mounted on the upper end and the lower end of an upright drive shaft 514. The pulley 513 is mounted on the output shaft of a size shift motor 515.

Figure 8:
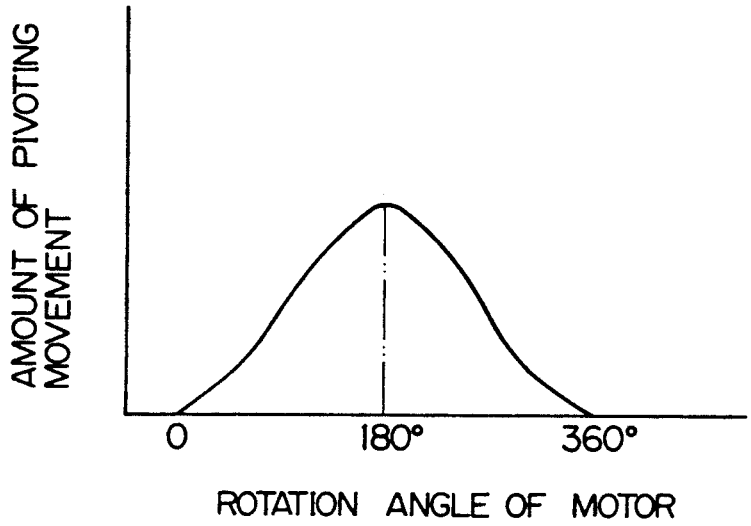
FIGS. 8 and 9 are graphs each showing a relationship between the rotation angle of the pivot motor and the displacement.

As shown in FIG. 4, a size sensing plate 530 is rigidly mounted on the sorter. A size sensor 531 is mounted on the lower bracket 506 to serve as size information sensing means. The size sensing plate 530 and size sensor 531 cooperate to sense a position of the pusher 502. A pivot motor 520 is mounted on the lower bracket 520. An eccentric shaft 520 extends upward from the output portion of the pivot motor 520. A pivot arm 521 extends out from the lower end of the main shaft 501 toward the motor 520. The eccentric shaft 520*a* is loosely fitted in an elongate slot 521*a* which is formed through the pivot arm 521. When the motor 520 is rotated, the arm 521 is rotated to in turn rotate the main shaft 501. The main shaft 501, therefore, rotates the elastic pushing members 502*a* of the individual pushers 502 between two different positions which are indicated by a solid line and a phantom line, respectively, in FIG. 5. This rotation is sinusoidal, as shown in FIG. 8. Hence, the rotation is slowed down at the top dead center. The phantom line position of the elastic member 502*a* is selected such that the member 502*a* bites into the end of a paper stack by a predetermined amount in order to surely urge the paper stack against the bin fence 316.

Figure 9:
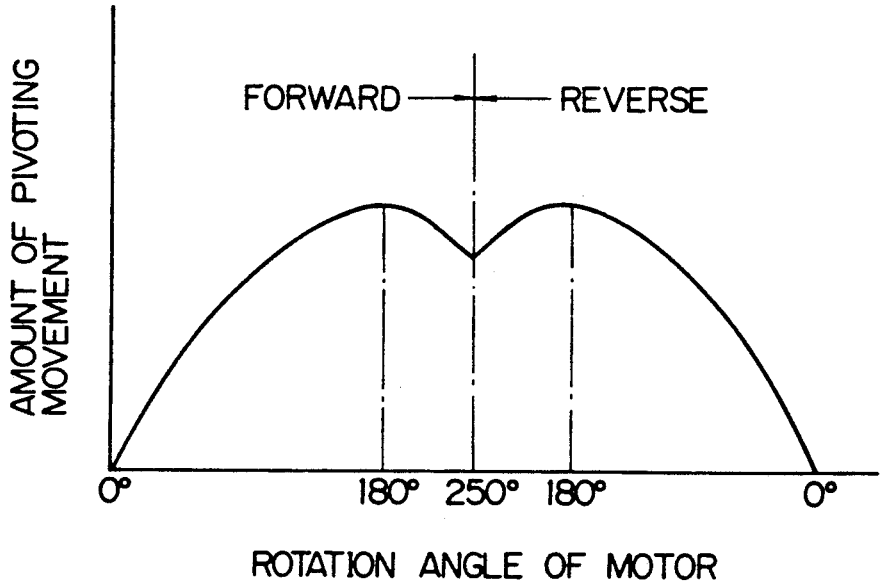

As stated above, the pivoting device 500 is constructed into a unit and is bodily moved by the size shift motor 515. When a size signal is fed from the image forming apparatus to the paper handling device, the rotating device causes the size shift motor 515 to rotate the upper and lower timing belts 507 and 508. As a result, the pushers 502 mounted on the main shaft 501 are moved forward toward one end of paper stacks loaded on the individual bins 300. The pivoting device or unit 500 is stopped at a predetermined position as sensed by the size sensing plate 530 and size sensor 531. Subsequently, the pivot motor 520 performs a half rotation (180 degrees) forward and then backward to its home position. This causes the arm 521 to pivot once and imparts its angular movement to the individual pushers 502*a* via the main shaft 501. Hence, each pusher 502*a* is moved from the solid line position shown in FIG. 5 to the phantom line position. If desired, as shown in FIG. 9, the motor 520 may be rotated forward by more than 180 degrees and then reversed to the home position so as to cause the pivoting motion of each pusher 502*a* twice by one step.

As the elastic member 502*a* of each pusher 502 abuts against one end of a paper stack loaded on the associated bin 300, the opposite end of the paper stack is urged against the bin fence 316 and thereby positioned. At the same time, the pusher 502 in rotation pushes the paper stack such that the end of the paper stack which is perpendicular to the above-mentioned end is urged against the upright portion 308 of the bin 300, as indicated by an arrow A in FIG. 5. As a result, the paper stack is accurately positioned on the bin in two perpendicular directions. Since the pivotal movement is implemented by the forward and backward rotations of the motor 520, the return to the home position is easy even when the pusher 502 has failed to fully push the paper stack during the forward pivotal movement.

The paper stack positioned on the bin 300 as described above is subjected to a stapling operation or similar operation and then pulled out in a direction indicated by an arrow X in FIG. 5. Since no obstructions exist in the direction X, the paper stack can be drawn out with ease.

Figure 10:
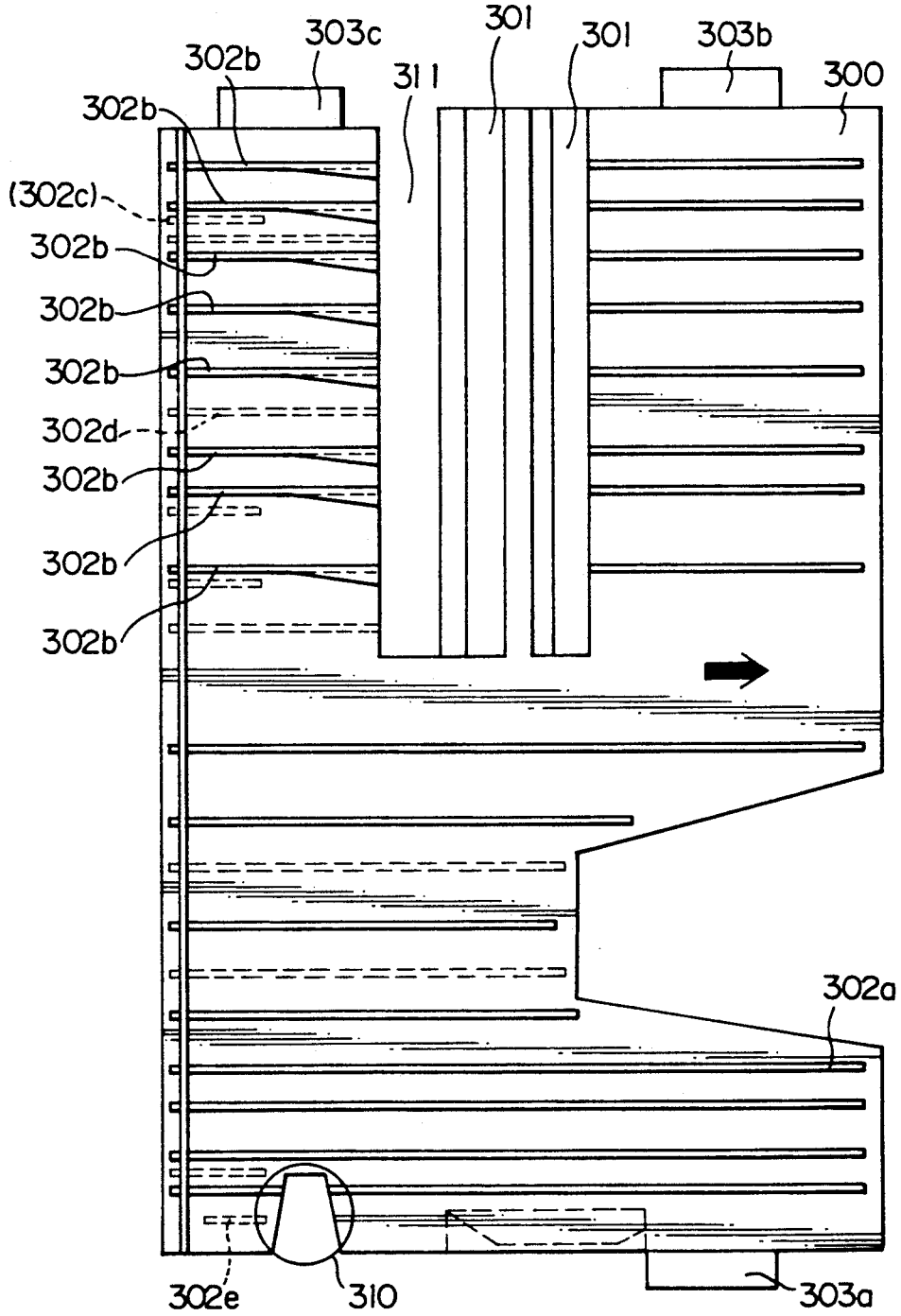
FIG. 10 is a plan view of the bin.
Figure 11:
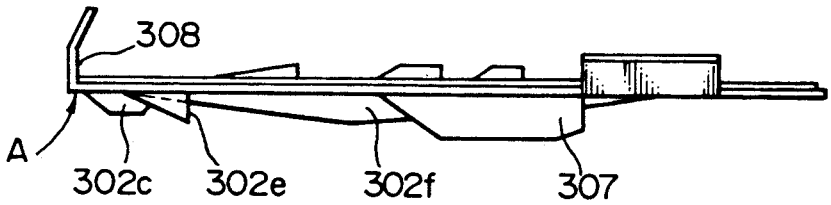
FIG. 11 is a side elevation of the bin.
Figure 15:
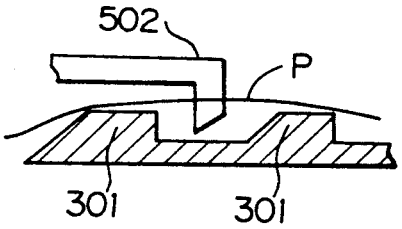

Referring to FIGS. 10 to 28, the structure of the bin 30 contemplated to promote accurate positioned of a paper stack and accurate stapling will be described. FIGS. 10 and 11 are respectively a plan view and a side elevation of the bin 30. As shown in FIG. 10, the notched portion 311 is positioned substantially at the intermediate of the bin 300 for allowing the main shaft 501 to move in matching relation to the paper size. Two ridges 301 are located beside the notched portion 311 and defines a channel for receiving the pusher 502 (FIG. 15) therebetween. As shown in FIG. 15, the ridges 301 serve to raise a paper sheet P and thereby allow it to be surely positioned.

Figure 17:
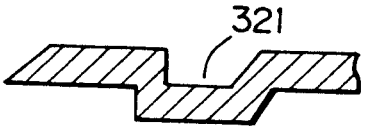
FIG. 17 is a section showing another specific configuration of the bin.
Figure 18:
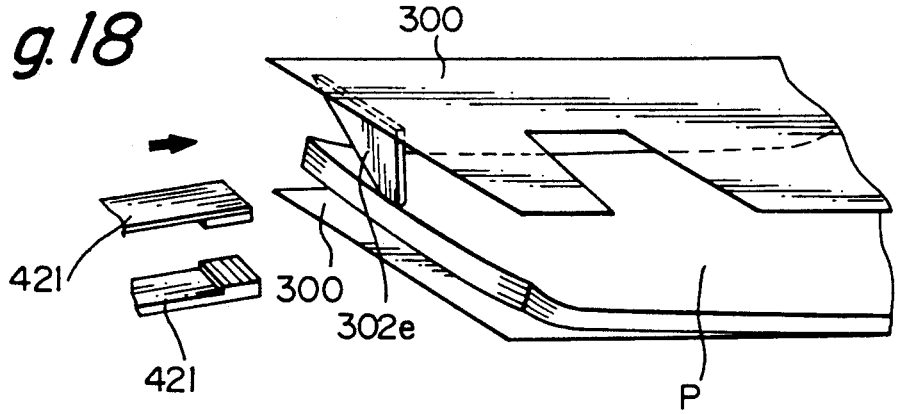
FIG. 18 is a view illustrating the function of a rib.

As shown in FIG. 17, the channel defined by two ridges 301 may be replaced with a simple recess.

Another advantage achievable with the ridges 301 is that the paper sheet P is provided with elasticity and, therefore, positioned with greater accuracy.

Figure 13:
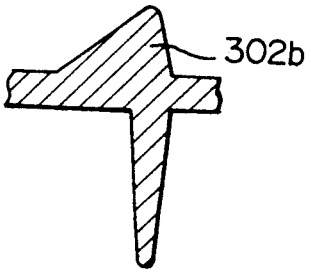
FIGS. 13, 14 and 15 are sections of various potions of the bin.
Figure 14:
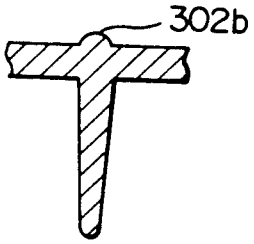

Ribs 302*b* provided on the bin 300 prevent a paper sheet from slipping into the notched portion 311. Specifically, as shown in FIG. 13, each rib 302*b* located in the vicinity of the notched portion 311 extends out upward and downward from the bin 300 so as to prevent a paper sheet P from getting under the bin 300 and, at the same time, to prevent it from slipping into the notched portion of the overlying bin. Regarding the position of the ribs 302*b*, it is substantially 10 millimeters inwardly of the end of the paper size to guide, especially the end of a paper sheet which is apt to enter the notched portion 311.

As shown in FIG. 13, the rib portion protruding upward from the bin 300 has a generally triangular gently-sloping cross-section. Such a configuration is successful in guiding a paper stack stapled and discharged such that it is not caught by the ribs such as the ribs 302. Each rib 302*b* has a height which sequentially rises toward the notched portion 311, as will be understood from FIG. 14. This is to accommodate a greater number of paper sheets on the bin 300.

Figure 16:
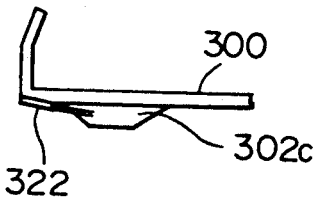
FIG. 16 is a side elevation showing a portion of the bin where a discharging brush is provided.

As shown in FIG. 16, in the illustrative embodiment, a discharging brush 322 is mounted on the bin 300 for increasing the number of copies which can be loaded on the bin 300. It is likely, however, that the brush 322 catches the discharged paper sheet P due to a curl of the latter or similar cause, effecting the stacking and positioning accuracy. Ribs 302*c* also provided on the bin 300 guide such a paper sheet P to surely prevent it from being caught by the brush 322. These ribs 302*c* are also positioned in such a manner as to press opposite ends of various sizes of paper sheets P.

As shown in FIG. 11, a rib 302*e* extends downward from the bin 300. As FIG. 18 indicates, the rib 302*e* serves to press the end paper sheets P so that chuck levers 421 of the chuck section 402 may surely chuck the paper sheets P without abutting against the end of the latter.

Figure 19:
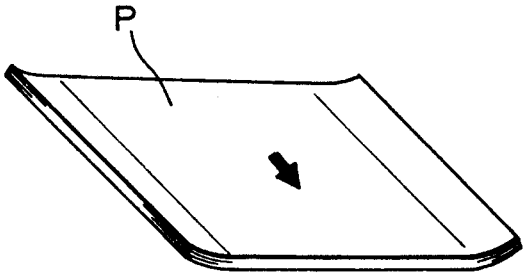
FIG. 19 is a perspective view showing one state of paper sheets.
Figure 20:
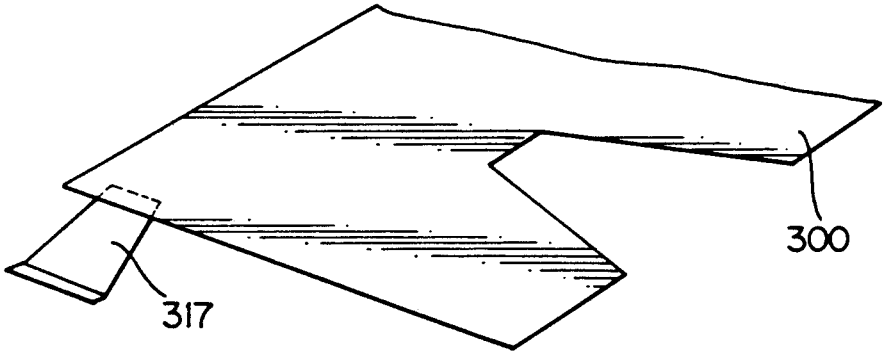
FIG. 20 is a perspective view of a guide.
Figure 21:
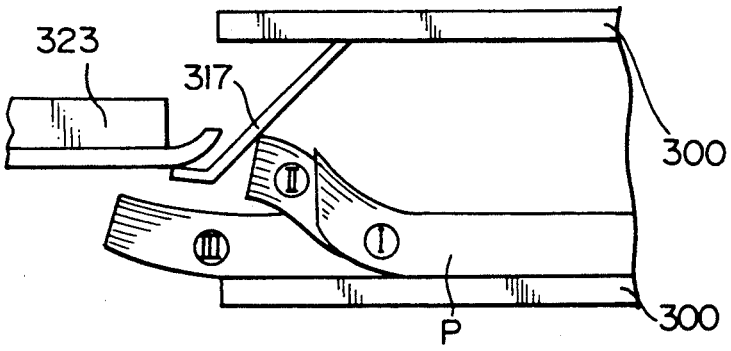
FIGS. 21 to 28 are views each showing a different state of paper sheets on the bin.
Figure 22:
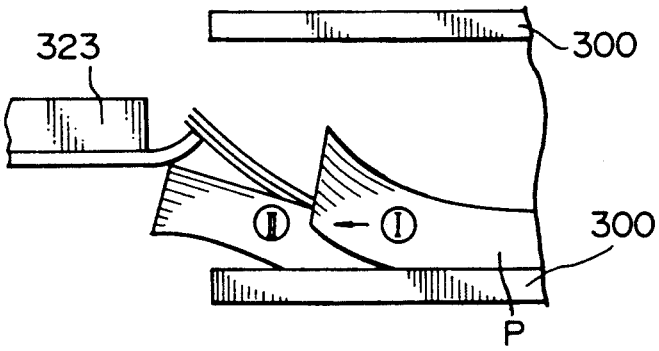

As shown in FIG. 20, a guide member 317 is affixed to the bin 300 for guiding the paper sheets P in the chuck section 402. Specifically, when the paper sheets P are moved toward the stapler section, the guide member 317 causes them to surely enter a frontage 323 of the stapler. As FIG. 22 indicates, if the guide member 317 is absent, there is a fear that the paper sheets P are caught by the frontage portion 323 when moved from a position I to a position II. This is especially true when the paper sheets are noticeably curled, as shown in FIG. 19, or when a great number of paper sheets are loaded on the bin 300. As shown in FIG. 21, the guide member 317 surely guides the paper sheets P into the frontage 323 of the stapler as represented positions I, II and III.

Figure 23:
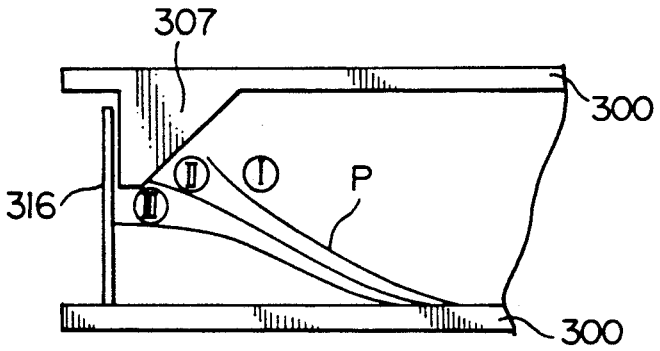
Figure 24:
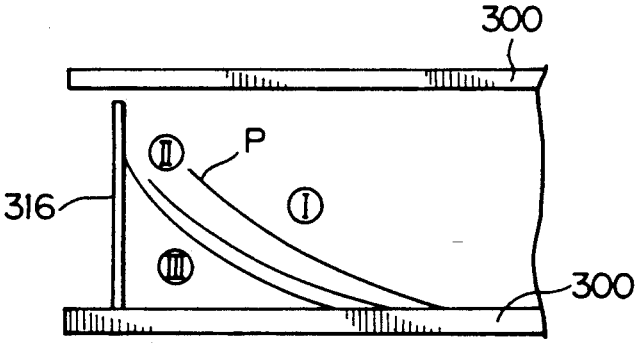

In FIG. 11, a projection 307 extends downward from the bin 300. While the paper sheet P distributed to the bin 300 is positioned in one direction, it is apt to get over the bin fence 316 (FIG. 12) if it has a substantial curl. The projection 307 promotes accurate positioning of such a paper sheet P by pressing the curl. FIGS. 23 and 24 show respectively a case wherein the projection 307 is present and a case wherein it is absent in order to illustrate the effect of the projection 307. In FIGS. 23 and 24, the position of the paper sheet P sequentially varies as indicated by I, II and III.

In FIG. 10, the bin 300 is formed with a notch 310 for allowing the chuck section 402 to chuck paper sheets P stacked on the bin 300.

The bins 300 are mounted on the sorter in a certain angular position, e.g., at an angle of 25 degrees to the horizontal. In this configuration, paper sheets are positioned in the intended direction of discharge not only by the rotation of the pusher 502 but also by gravity.

Figure 25:
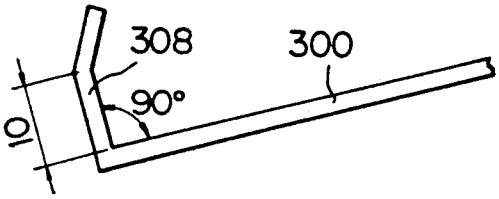
Figure 26:
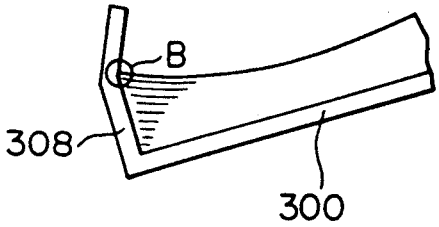
Figure 27:
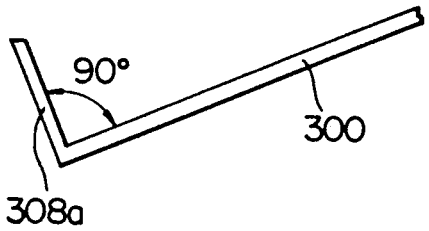
Figure 28:
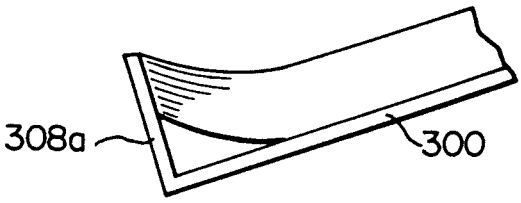

As shown in FIG. 25, the innermost or lowermost portion 308 of the bin 300 is provided with a unique configuration in order to enchance accurate positioned in the intended direction of discharge and to promote nest stacking. Specifically, a wall extends from the lowermost portion 308 perpendicularly to the latter and has an end portion which is bent by an acute angle smaller than 90 degrees relative to the bottom of the bin 300. When paper sheets P are sequentially stacked on the bin 300, a bend B of the above-mentioned wall 308 allows them to be accurately positioned and stacked by pressing curls, as shown in FIG. 26. FIG. 27 shows a bin 300 the upright wall of which is not provided with the bend B. Thee configuration shown in FIG. 27 fails to press curls of paper sheets P and causes them to get over the wall, as shown in FIG. 28.

Figure 12:
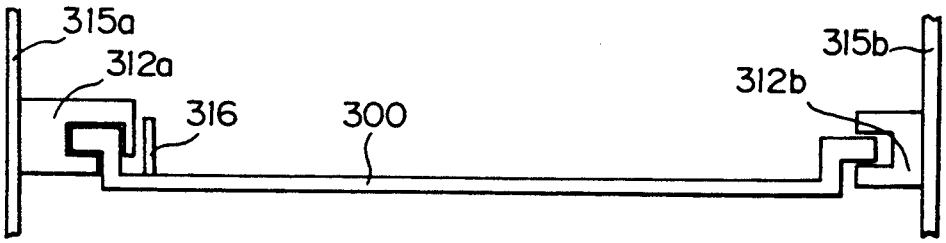
FIG. 12 is a side elevation of the bin as viewed from the right.

FIG. 12 is a side elevation of the bin 300 as seen from the right and shows how it is mounted. There are shown in the figure side walls 315*a* and 315*b* and bin supports 312*a* and 312*b*. The bin 300 is rigidly connected to the bin support 312*a* located near the bin fence 316 and is simply held by the other bin support 312*b* with a small clearance being defined between the bin 300 and the support 312*b*. The clearance between the bin 300 and the bin support 312*b* absorbs thermal expansion of the bin 300.

Figure 29:
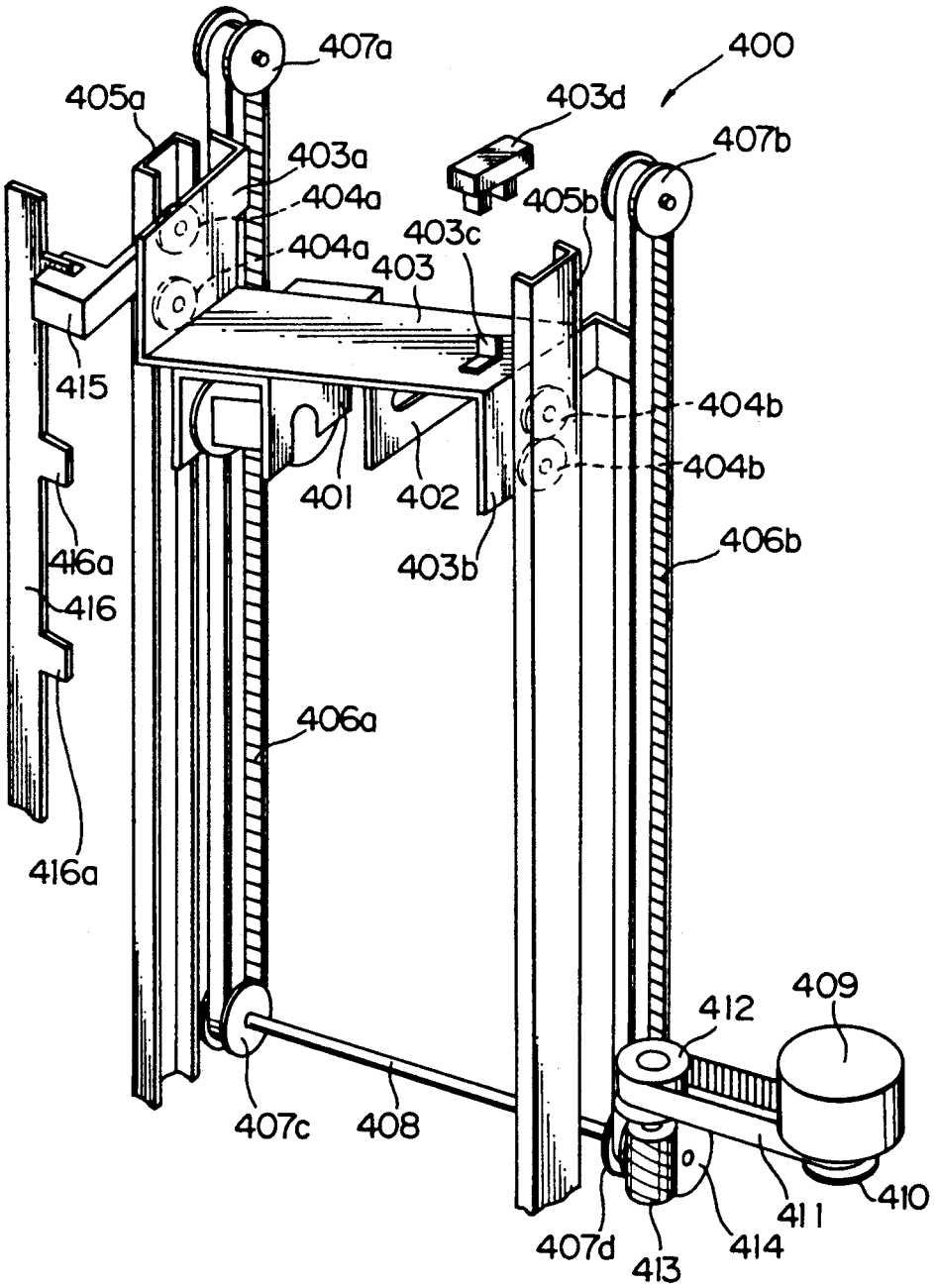
FIG. 29 is a perspective view showing the overall construction of a stapling device of the illustrative embodiment.
Figure 30:
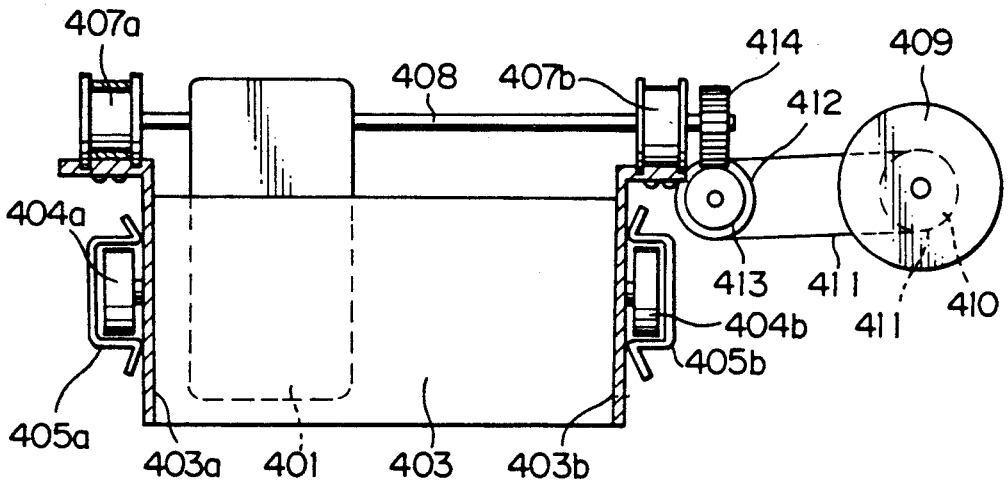
FIG. 30 is a plan view of a bracket.

The stapling device 400 is constructed and operated as follows. As shown in FIGS. 29 and 30, the stapling device 400 is located at one side of the multiple bins 300. The stapling device 400 has the stapler 401 and the paper moving device 402 which are mounted on the underside of the bracket 403. The stapler 401 drives a staple into a paper stack which is loaded on any one of the bins 300. The paper moving device 402 grips the paper stack on the bin 300 and transports it substantially in the horizontal direction. Opposite ends 403*a* and 403*b* of the bracket 403 are bent upward and downward, respectively. Rollers 404*a* and rollers 404*b* are rotatably mounted on the bent ends 403*a* and 403*b*, respectively. Two parallel guide rails 405*a* and 405*b* extend vertically along the ends of the bins 300. The rollers 404*a* and 404*b* are respectively received in the guide rails 405*a* and 405*b* so that the stapler 401 and paper moving device 402 are movable up and down integrally along the ends of the bins 300. A belt 406*a* is passed over pulleys 407*a* and 407*c* which are spaced apart from each other by a predetermined distance in the vertical direction. Likewise, a belt 406*b* is passed over pullys 407*b* and 407*d* which are located in the same manner as the pulleys 407*a* and 407*c*. The belts 406*a* and 406*b* extend substantially parallel to each other along the bins 300. The bent ends 403*a* and 403*b* of the bracket 403 are respectively fastened to the belts 406*a* and 406*b* by screws. The lower pulleys 407*c* and 407*d* are mounted on a single shaft 408 to be rotatable integrally with each other. A pulley 401 is mounted on the output shaft of a motor 409. A belt 411 is passed over the pulley 401 and a pulley 412. A drive gear 413 is mounted on the same shaft as the pulley 412 and held in mesh with a gear 414. The rotation of the motor 409 is transmitted to the pulley 407*d* via such a gearing. In this configuration, the belts 406 and 406 are movable to transport the stapler 401 and paper moving device 402 up and down. A position sensor 415 is mounted on the bent end 403*a* of the bracket 403, while an upright sensing plate 416 is associated with the position sensor 415, as illustrated. The sense plate 416 has lugs 416*a* which are located at predetermined intervals in association with the bins 300. Such a position sensing mechanism allows the stapler 401 and paper moving device 402 to be brought to and stopped at any one of the bins 300. A lug 403*c* is provided on the bracket 403 and defines the upper limit position of the bracket 403 in cooperation with a sensor 403*d*. Specifically, when the lug 403*c* enters the sensor 403*d*, the motor 409 deenergized to inhibit any further upward movement of the bracket 403.

Figure 31:
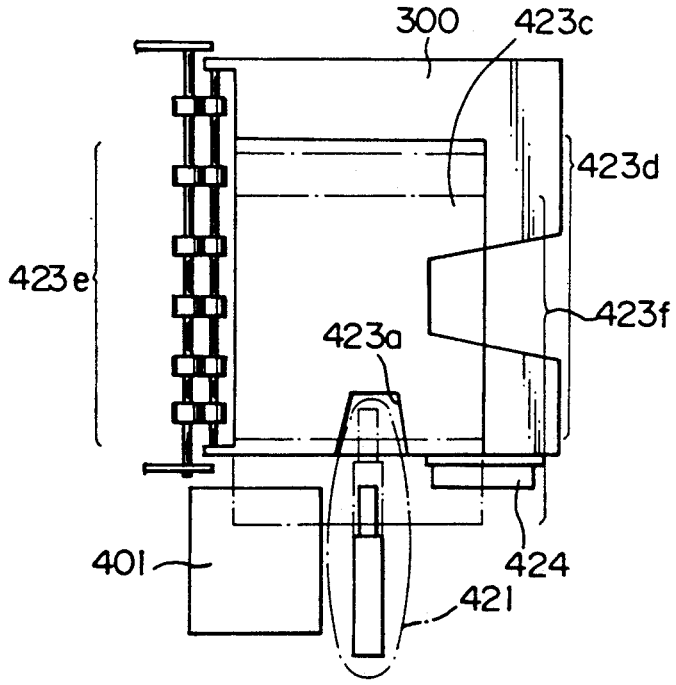
FIG. 31 is a plan view of a stapler.
Figure 32:
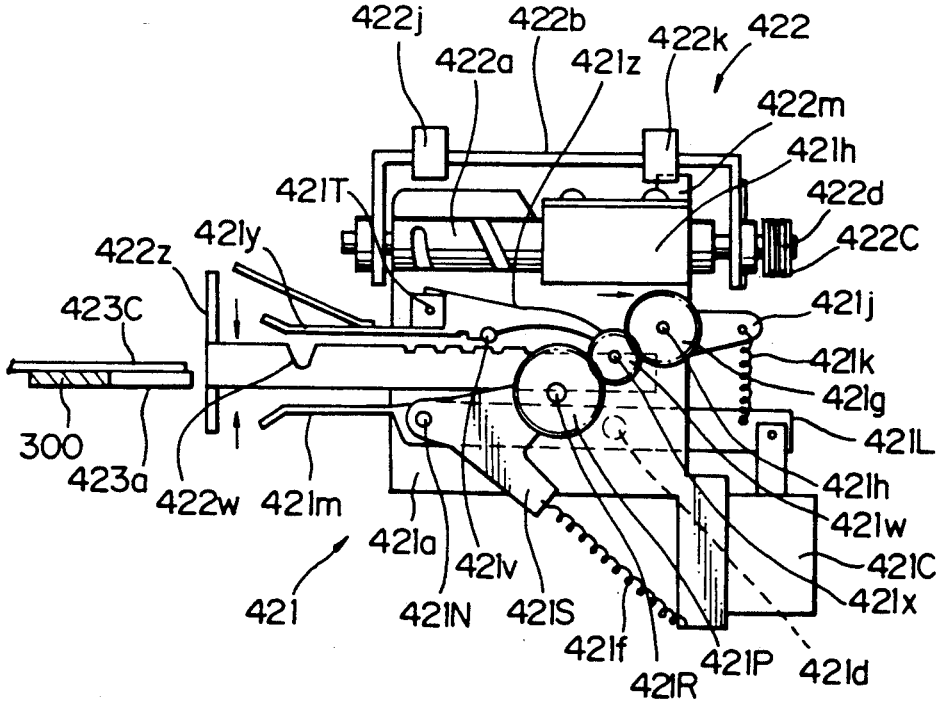
FIG. 32 is a front view of the stapler.

FIG. 31 is a view useful for understanding the movement of the stapling device 400. As shown, a paper sheet 423*c* distributed to the bin 300 is discharged in a position indicated by 423*d* and then urged by the pivoting device 500 against the bin fence 316. On the start of a stapling operation, the chuck section 421 is moved from a solid line position to a phantom line position. At the phantom line position, the chuck section 421 is closed to grip paper sheets 423*c*. Then, the chuck section 421 is returned to the solid line position, whereby the paper sheets 423*c* are moved to a position 423*f*. In this condition, the stapler 401 is driven to stapler the paper sheets 423*c*. Subsequently, the chuck section 421 is opened to release the stapled paper sheets 423*c*, and a push bar which will be described pushes the paper sheets 423*c* to return them to a position lying in the range of 423*e* to 423*d*. Such a sequence of steps is repeated with the other bins, as will be described in detail later. As shown in FIG. 32, the paper moving device 42 has the chuck section 421 for gripping a paper stack and a reciprocating mechanism 422 for moving the chuck section 421 horizontally in a reciprocating motion. The chuck section 421 has a base 412*a* on which a pair of arms 421*z* and 421*s* are rotatably mounted. Actuated by a solenoid 421*c*, the arms 421*z* and 421*s* cause their associated chucks 421*y* and 421*m* to grip a paper stack.

Figure 33:
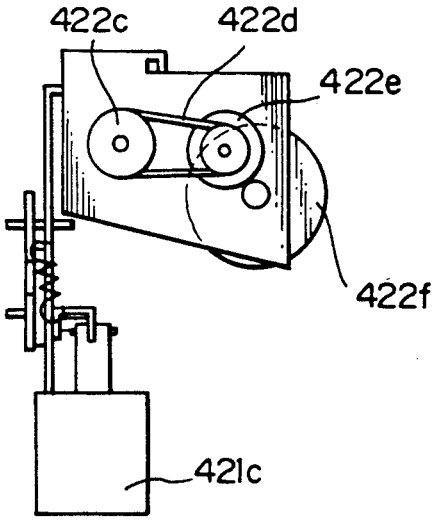
FIG. 33 is a side elevation of the stapler.

The reciprocating mechanism 422 has a feed shaft 422*a* for moving the chuck section 421 toward and away from the bin 300. Stubs extending out from opposite ends of the feed shaft 422*a* are rotatably supported by a generally U-shaped fram 422*b*. One of the stubs extends throughout the frame 422 to protrude to the outside by a predetermined amount. As shown in FIG. 33, a pulley 422*c* is mounted on the protruding end of the above-mentioned stub. A belt 422*d* having a circular cross-section is passed over the pulley 422*c* and an intermediate pulley. A motor 422*f* drives the pulley 422*c* via a gear 422*e*, intermediate pulley, and belt 422*d*. The feed shaft 422*a* has a groove on the periphery thereof which constitutes a ball screw. The base 421*a* has a boss 421*h* which is in threaded engagement with the feed shaft 422*a* Specifically, the motor 422*f* drives the feed shaft 422*a* in a rotary motion and thereby drives the base 421*a* in a reciprocating motion. Position sensors 422*j* 422*k* are mounted on the frame 422*b* and spaced apart from each other by a predetermined distance. A sense piece 422*m* is provided on the boss 421*h* in such a manner as to be sensed by the position sensors 422*j* and 422*k*. The chuck section 421 is movable back and forth between the position sensors 422*j* and 422*k*.

On the start of a staple mode operation, the stapler 401 and paper moving device 402 are moved integrally upward or downward by the belts 406*a* and 406*b* (FIG. 29). The stapler 401 and paper moving device 402 are brought to any one of the bins 300 which is loaded with a paper stack to be bound. In response to an output of the position sensor 415, the stapler 401 and paper moving device 402 are stopped in a position adjacent to the particular bin 300. In this instance, the solenoid 421*c* is not energized so that the arms 421*z* and 421*s* and, therefore, the chucks 421*y* and 421*m* are held in their open position. Subsequently, the motor 422*f* rotates the feed shaft 422*a* to move the chuck section 421 forward toward the paper stack on the bin 300.

Figure 45:
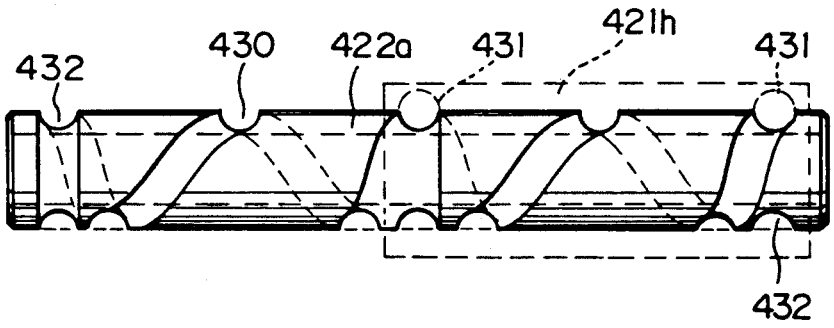
FIG. 45 is a front view of a feed screw.

FIG. 45 shows a specific configuration of a groove 430 provided on the periphery of the feed shaft 422*a*, as mentioned earlier. As the feed shaft rotates, balls 431 mated with the groove 430 are moved in a reciprocating motion by being guided by the groove 430. The feed shaft 422*a* has at opposite ends thereof an idle poriton 432 which extends over an angular distance of 180 degress or more. The ends of such idle portions 432 serve as stops for preventing the stop position from being changed by inertia. When the balls 431 abut against the associated ends of the groove 430, the resulting impact is absorbed by the circular belt 422*d* due to slippage. This is also true when the circular belt 422*d* is replaced with a flat belt or similar means for friction type transmission.

Figure 51:
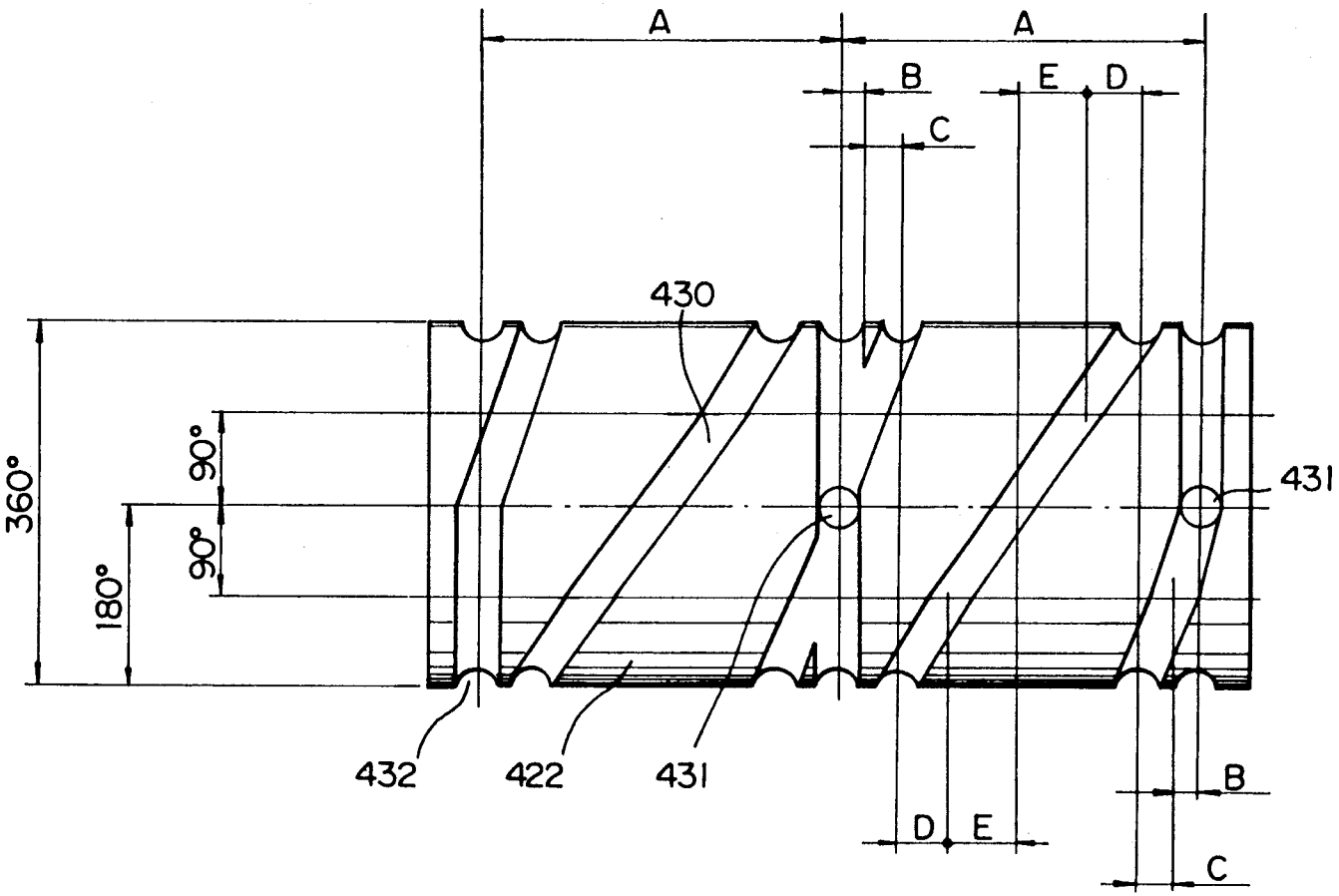
FIG. 51 is a front view showing another specific configuration of the feed shaft.
Figure 52:
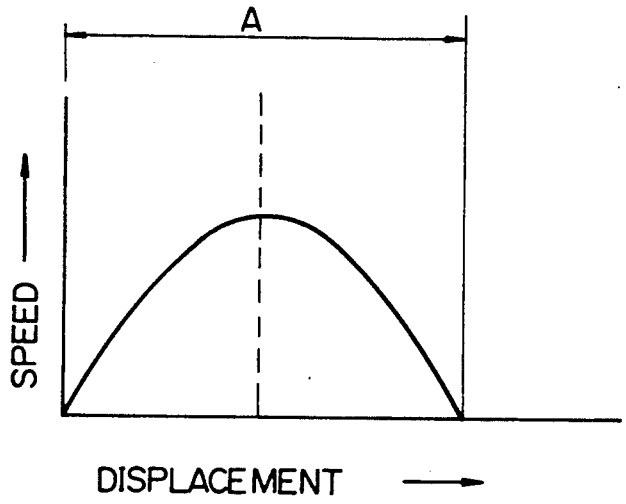
FIG. 52 is a graph showing a relationship between the speed and the displacement attainable with the feed screw shaft in FIG. 51.

FIG. 51 shows another specific configuration of the groove 430 in a developed view. The groove 430 of FIG. 51 is so configured as to control the moving speed by changing the displacement relative to the rotation angle. In this example, the feed shaft 422*a* is assumed to provide the entire displacement by two rotations thereof (720 degrees). The movement is accelerated little by little by the first rotation of the feed shaft 422*a* and then decelerated by the next rotation. For example, assuming that the displacement A is 42 millimeters, the groove 430 may be configured such that the first 90 degrees of rotation provides a displacement B of 3 millimeters, another 90 degrees of rotation provides a displacement C of 4 millimeters, another 90 degrees of rotation provides a displacement D of 6 millimeters, and another 90 degrees of rotation provides a displacement E of 7 millimeters. FIG. 52 is a graph representative of such speed control. It will be seen that this kind of speed control frees the paper stack 423*c* from disturbance to positioning ascribable to inertia which occurs when the chucks 421*y* and 421*m* having gripped the paper stack 423*c* begin moving toward the stapling position and stop there.

Figure 34:
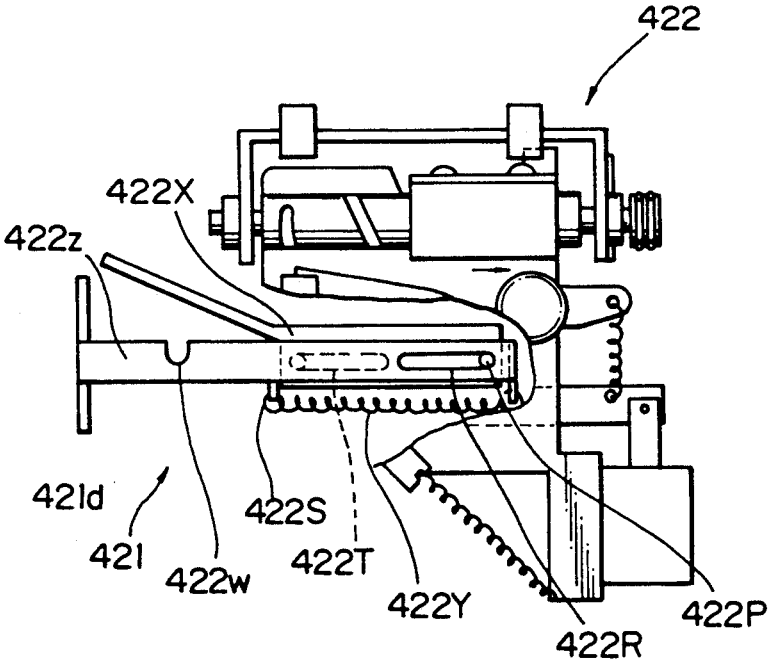
FIGS. 34 to 44 are front views demonstrating the movements of various components of the stapler.
Figure 35:
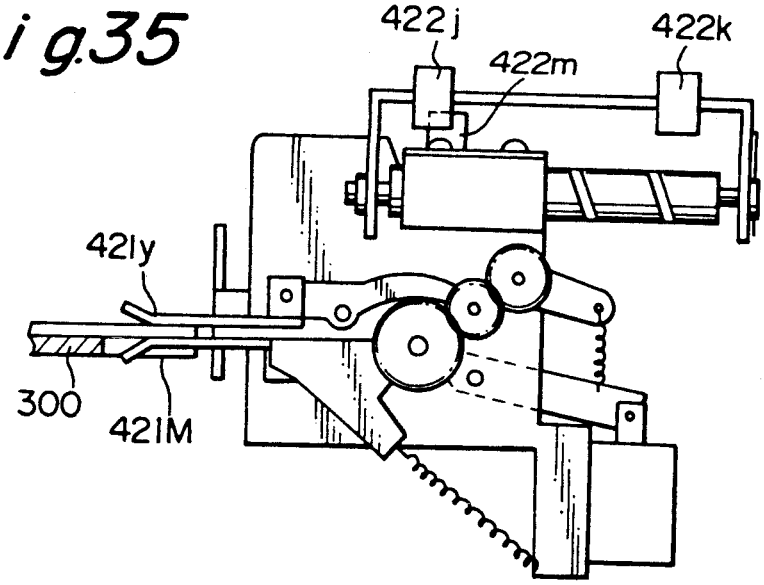

As soon as the chucks 421*y* and 421*m* reach a position where they can grip the paper stack, they are stopped there and, at the same time, the solenoid 421*c* is energized. Then, as shown in FIG. 35, the chucks 421*y* and 421*m* are closed to grip the end portion of the paper stack. Such a procedure will be described in detail with reference to FIGS. 32 to 38 hereinafter.

Figure 36:
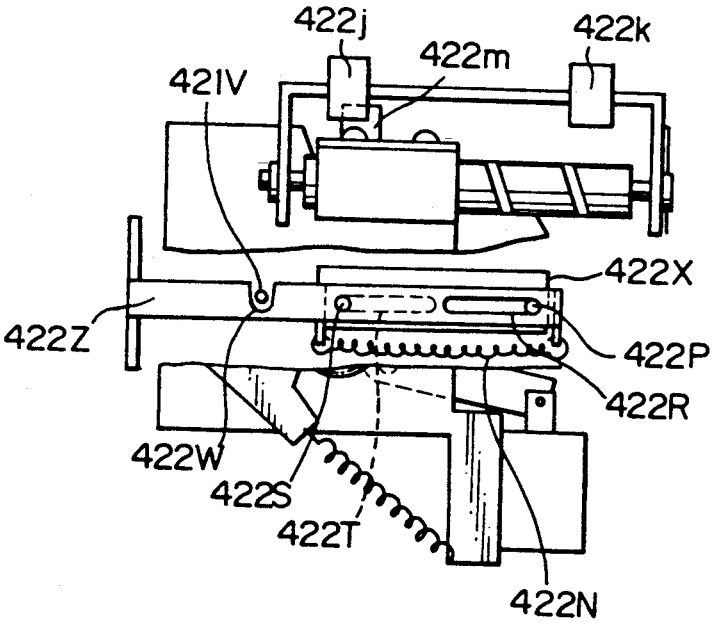

When the solenoid 421*c* is energized, a lever 421*l* is rotated about a fulcrum 421*d*. Then, a lever 421*j* is rotated about a fulcrum 421*h* by a spring 421*k* which is anchored to the lever 421*l*. The rotation of the lever 421*j* is transmitted to a B gear 421*w* via an A gear 421*g* which is rigidly mounted on the lever 421*j*. The gear B 421*w* is rigidly mounted on an upper arm 421*z* so that the upper arm 421*z* is rotated counterclockwise about a fulcrum 421*x*, i.e., downward as viewed at a point 421*t*, whereby the upper chuck 421*y* is lowered. Since the chuck section is protruded forward, as shown in FIG. 36, a pin 421*y* drops into a notch 422*w* which is formed in a push bar 422*z*. The gear B421*w* is held in mesh with a gear 421*p*. Hence, the gear 421*p* is also rotated clockwise to in turn rotate a lower lever 421*s* rigid on the gear 421*p* about a fulcrum 421*r*. The lower chuck 421*m* is, therefore, moved upward about a fulcrum 421*n*, as shown in FIG. 35. Although a spring 421*f* constantly biases the lower arm 421*s* counterclockwise, its preload is small enough to allow the lower chuck 421*m* to move as mentioned above. The displacements of the chucks 421*y* and 421*m* from their predetermined positions are dependent on the number of teeth of the gears 421*g*, 421*w* and 421*p* and the distances between the fulcrums and the acting points. In the illustrative embodiment, the A gear 421*g*, B gear 421*w* and C gear 421*p* have forty gears, thirty-two gears, and fifty-six gears, respectively. Therefore, the displacements of the gears may be expressed in ratio as A:B:C=1.25:0.7. Further, the distance between the fulcrum 421*x* of the upper arm 421*z* and the acting point 421*t* is 52 millimeters, and the distance between the fulcrum 421*r* of the lower arm 421*s* and the acting point 421*n* is 37 millimeters. Hence, the displacement ratio is $1.25\times52:0.7\times37$, i.e., 2.5:1. Specifically, when the upper chuck 421*y* moves downward by 2.5, the lower chuck 421*m* moves upward by 1.

The chucking force exerted by the upper and lower chucks 421*y* and 421*m* is determined by the force of the spring 421*k* which is anchored to the solenoid 421*c*. As shown in FIG. 32, the spring 421*k* stretches more as the thickness of the paper stack to be gripped by the chucks 421*y* and 421*m* increases. More specifically, an arrangement is made such that the chucking force increases as the number of paper sheets to be gripped by the chuck section 421 increases, thereby eliminating dislocation or similar occurrence ascribable to short chucking force.

Figure 37:
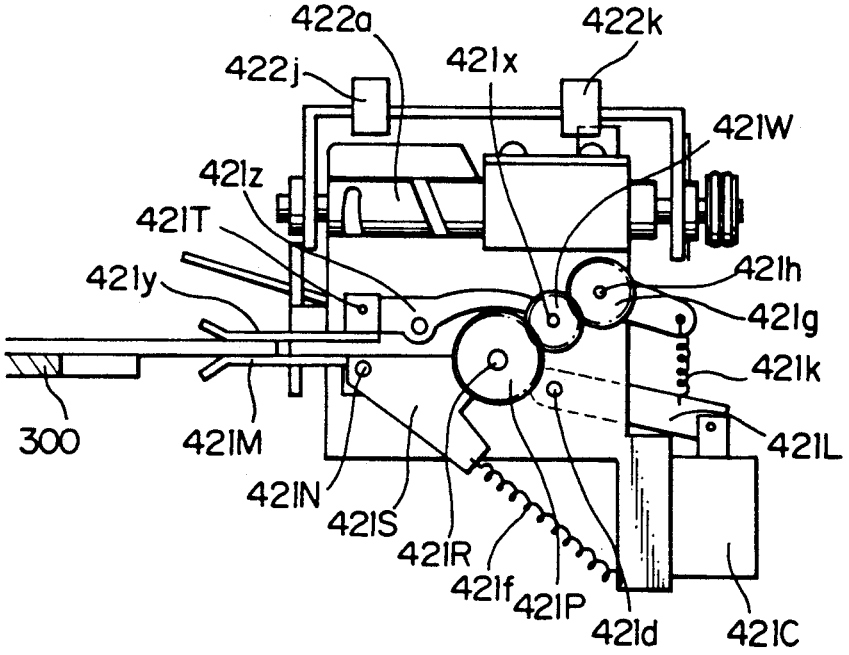
Figure 38:
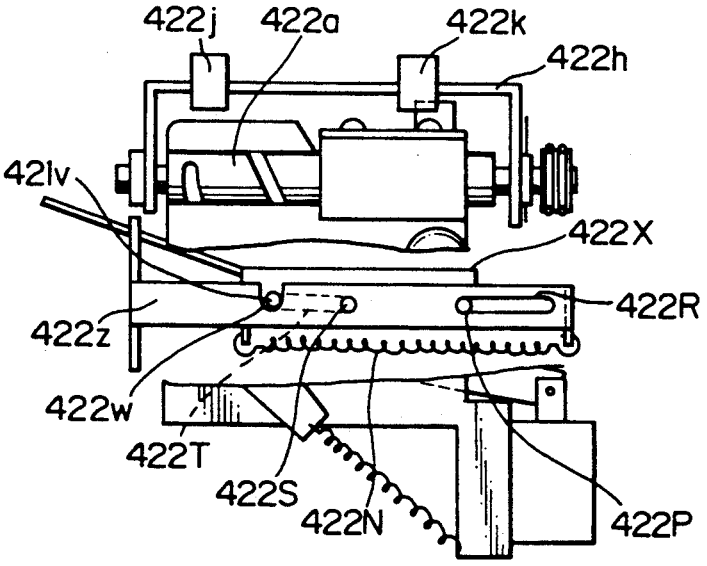

Therefore, the motor 422*f* is reversed to cause the chuck section 421 to return to the original position while gripping the paper stack, as shown in FIG. 37. The paper stack is, therefore, moved substantially in the horizontal direction toward the stapler 401. As soon as the end portion of the paper stack reaches the stapling position, the paper stack is stopped there. As best shown in FIGS. 34, 36 and 38, the push bar 422*z* is moved by the reverse rotation of the motor 422*f* to the position shown in FIG. 38, because the pin 421*v* is received in the notch 422*w*. A slot 422*t* is formed through a bracket 422*x*, and a pin studded on the push 422*z* is received in the slot 422*t*. Also, a slot 422*r* is formed through the push bar 422*z*, and a pin 422*p* studded on the bracket 422*x* is received in the slot 422*r*. The bracket 422*x* is affixed to the frame 422*b*. The bracket 422*x* and push bar 422*z* are tied to each other by a spring 422*n*. In this configuration, when the motor 422*f* is reversed, the push bar 422*z* is shifted from the position of FIG. 36 to the position of FIG. 38. The push bar 422*z* itself is pulled by the spring 422*n* to the left as viewed in FIG. 38. Subsequently, the stapler 401 is actuated to drive a staple into the end portion of the paper stack.

On the completion of the stapling operation, the solenoid 421*c* is deenergized. As a result, the upper chuck 421*y* and lower chuck 421*m* are opened by the force of the spring 421*f*, i.e., they are returned from the position shown in FIG. 37 to the position shown in FIGS. 32 and 34. Simultaneously, the pin 421*v* is released from the notch 422*w* of the push bar 422*z*. The push bar 422*z* is, therefore, returned instantaneously from the position of FIG. 38 to the position of FIG. 34 under the action of the spring 422*n* while pushing the paper sheet to the original position.

Figure 43:
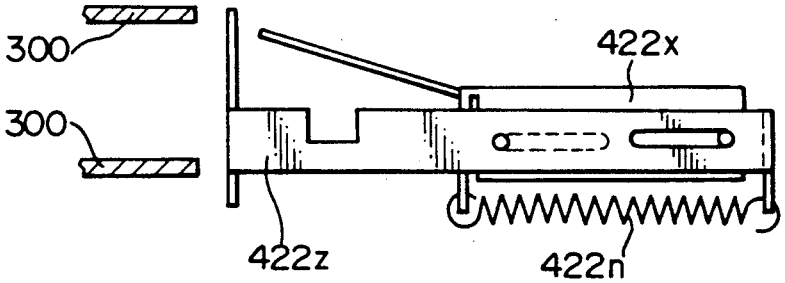
Figure 44:
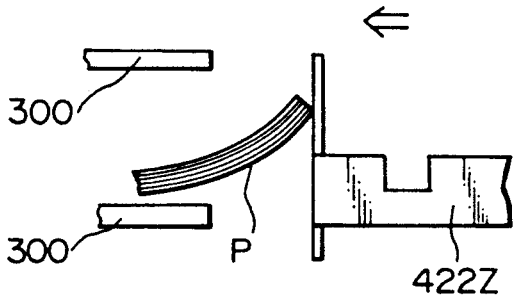

FIG. 43 shows a relationship of the push bar 422*z*, bracket 422*x* and spring 422*n* to one another. The pushing end of the push bar 422*z* is dimensioned greater than the distance between nearby bins 300 so as to surely return the paper stack to the bin 300. Part of the bracket 422 projects obliquely upward toward the bin 300. As shown in FIG. 44, if such a projection of the bracket 422 is absent, relatively soft paper sheets P or noticeably curled paper sheets P are apt to slip upward when pushed by the push bar 422*z* toward the bin 300.

Subsequently, the stapler 401 and paper moving device 402 are shifted to the next bin and operated in the above-described manner to staple a paper stack loaded therein.

Figure 39:
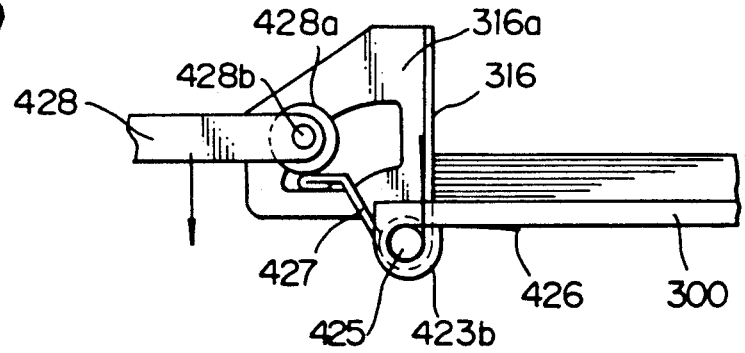
Figure 40:
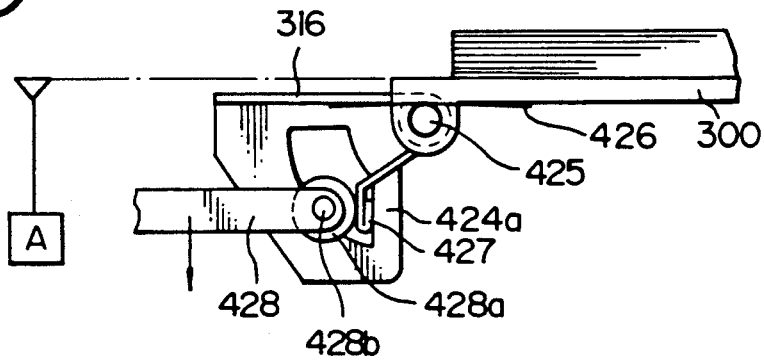

As shown in FIG. 39, the bin fence 316 extends upward from the edge of the bin 300 that faces the stapler 401. The bin fence 316 is supported at its lower end by a shaft 425 which extends along the underside of the bin 300. The bin fence 316 is, therefore, tiltable to an open position shown in FIG. 40. The shaft 425 is in turn rotatably supported by bearing pieces 423*b* which extend downward from opposite edges of the bin 300. A coil spring 426 is wound around the shaft 425. Opposite ends of the coil spring 426 are seated on the underside of the bin 300 and the back of the bin fence 316, respectively. The coil spring 426 constantly biases the bin fence 316 toward the upright position shown in FIG. 39. The bin fence 316 is opened in association with the vertical movement of the stapler 401 by fence tilting members, i.e., a movable plate 427 and a release plate 428 which is mounted on the stapler 401. Part of the movable plate 427 is received in a sectorial opening which is formed through an ear 424*a* extending out from the bin fence 316. When the movable plate 427 is rotated downward, it abuts against the edge of the sectorial opening to thereby tilt the bin fence 316 downward. When the movable plate 427 is rotated upward, it does not contact the bin fence 316 and is, therefore, freely rotatable. A roller 428*a* is mounted on the release plate 428 and located in a position where it is capable of contacting the movable plate 427. When the stapler 401 is moved up and down, the roller 428*a* contacts the movable plate 427 to rotate the movable plate 427.

During a sort mode operation, the bin fence 316 is held in the upright position by the coil spring 426, as shown in FIG. 39. In this condition, paper sheets sequentially distributed to the bin 300 are accurately positioned with their ends butting against the bin fence 316. When the sort mode operation ends, the stapler 401 begins moving downward. Consequently, the roller 428*a* on the release plate 428 which is mounted on the stapler 401 contacts the movable plate 427 of the bin 300, thereby rotating the movable plate 427 downward to the position shown in FIG. 40. The movable plate 427 in turn tilts the bin fence 316 against the action of the spring 426, whereby the bin 300 is opened. As this instant, the bin fence 316 and movable plate 427 are lowered to a position below the surface of the bin 300 which is indicated by a dash-and-dot line in FIG. 40. Then, the previously stated stapling operation is executed.

As soon as the stapled paper stack is returned to the original position on the bin 300 or while such a papper stack is moved toward the bin 300, the stapler 401 is lowered to the next bin. At this time, the roller 428*a* on the release plate 428 moves away from the movable plate 427 resulting in the bin fence 316 being restored to the upright position by the spring 426. The bin opening and stapling movements described so far are executed with all of the bins to which paper sheets have been distributed.

Figure 41:
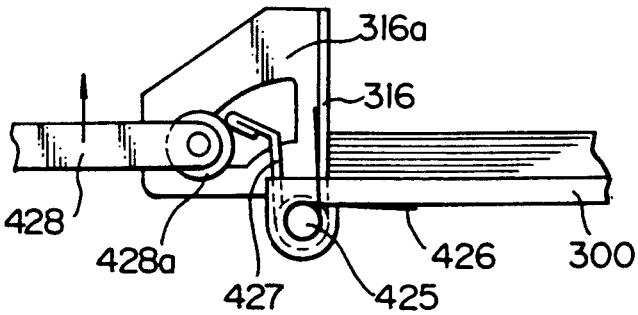

After stapling all the paper stacks on the bins 300, the stapler 401 is raised to the uppermost position or home position which is above the first or uppermost bin 300. When the roller 428*a* on the release plate 428 contacts the underside of the movable plate 427 in the event of the return of the stapler 401, the movable plate 427 simply moves upward, as shown in FIG. 41, and does not rotate the bin fence 316 at all. As the roller 428*a* moves clear of the movable plate 427, the movable plate 427 regains the position shown in FIG. 39 due to gravity.

Figure 42:
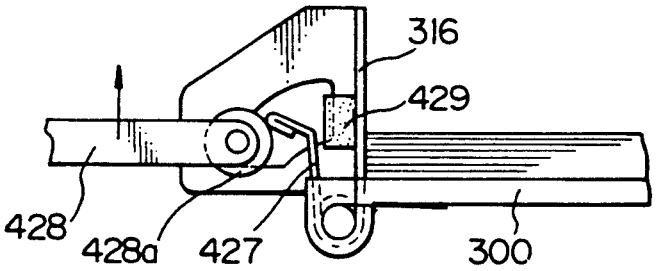

FIG. 42 shows a modification of the arrangement described above with reference to FIGS. 39 to 41. As shown, an elastic member 429 is fitted on the bin fence 316 for receiving the movable plate 427. When the movable plate 427 is moved upward by the roller 428*a* during the return of the stapler 401 as stated above, it abuts against the eleastic member 429 and then springs back to the position shown in FIG. 39.

A procedure for replacing the staple cartridge of the stapler 401 will be described with reference to FIGS. 46 to 50. In the illustrative embodiment, the stapler 401 is sustained upside down because a copier body, now shown, has a paper reversing device and drives copies face down thereoutof.

Figure 46:
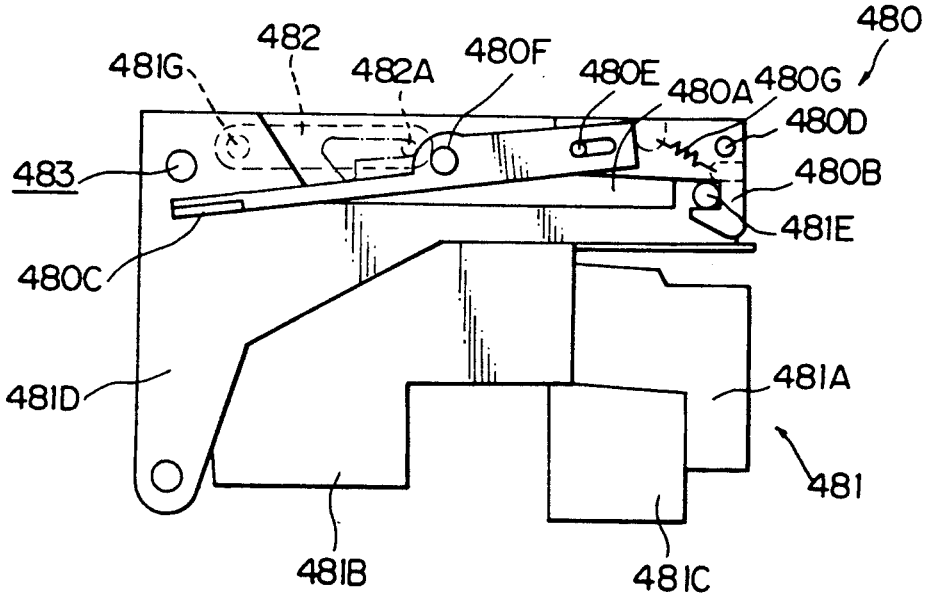
FIGS. 46 to 50 are front views showing how a staple cartridge loaded on the stapler is replaced.
Figure 47:
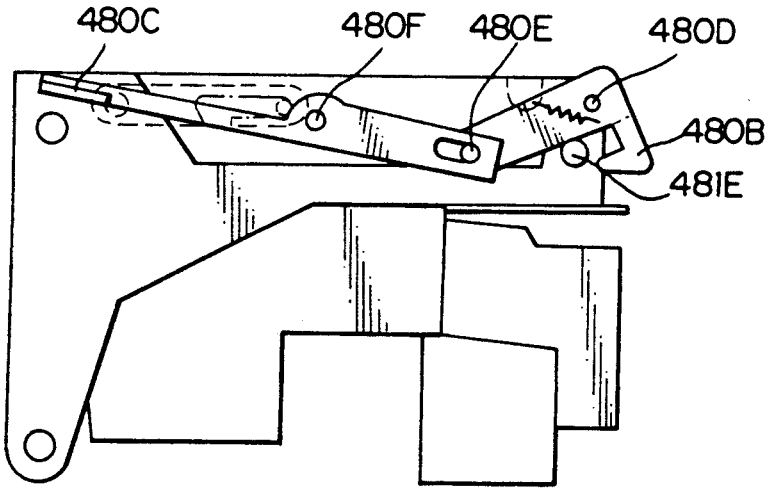
Figure 48:
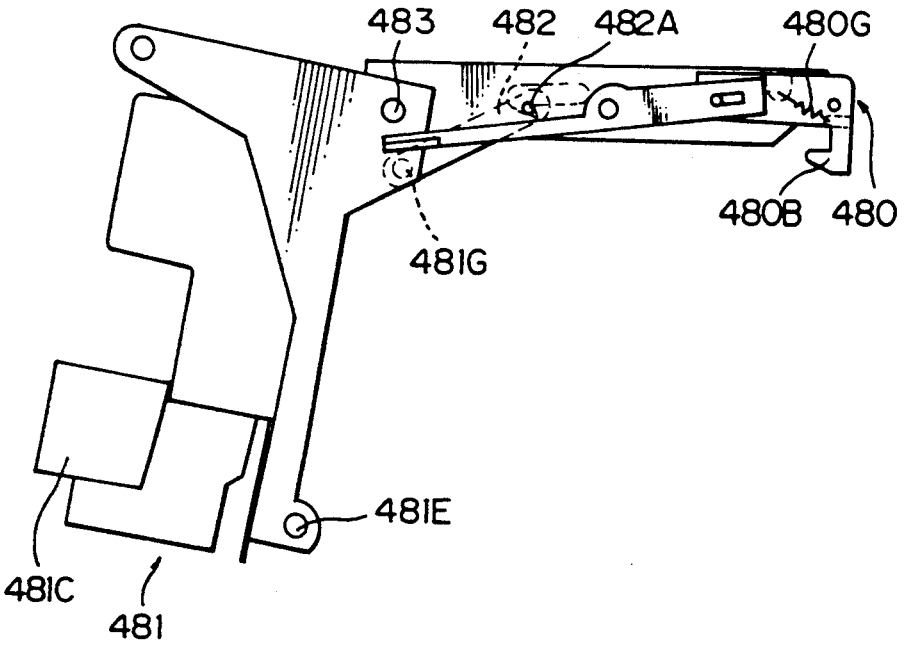
Figure 49:
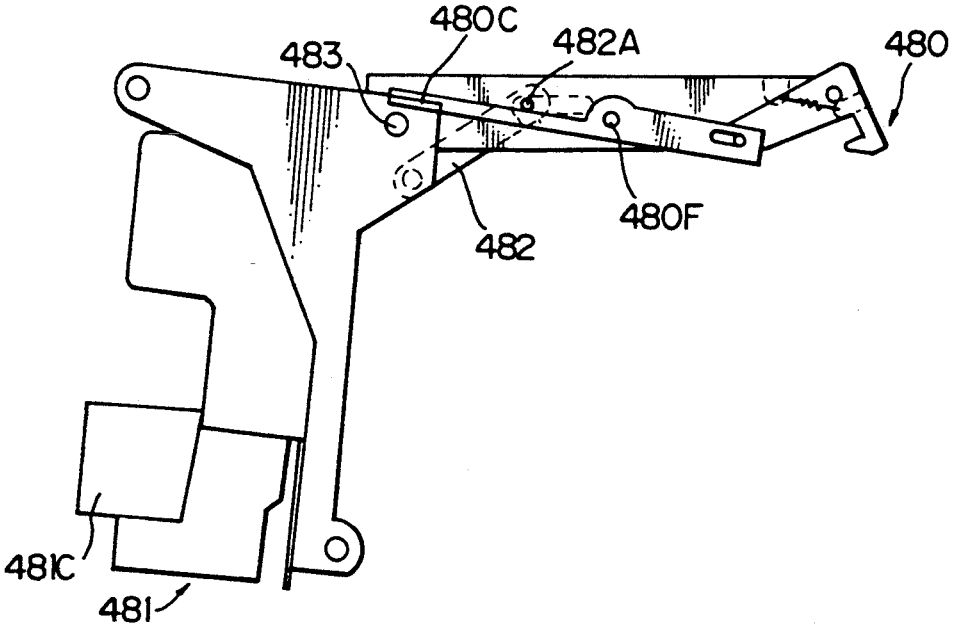
Figure 50:
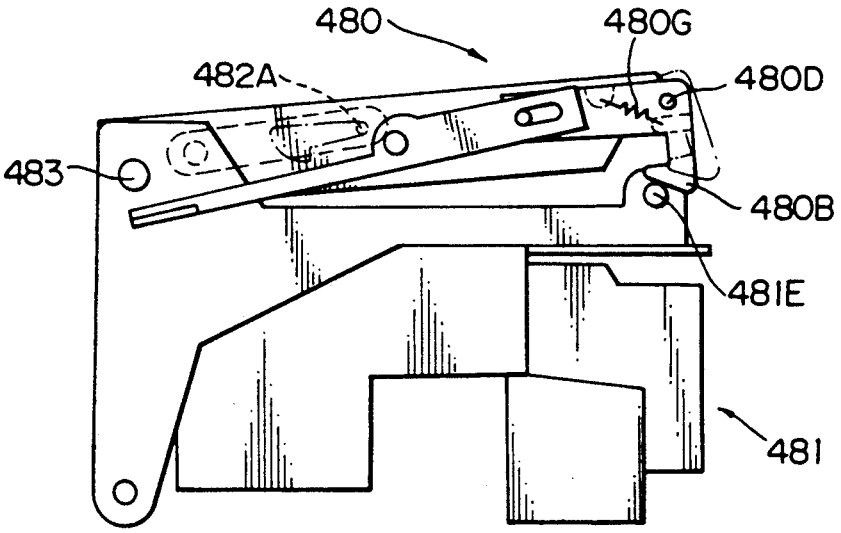

As shown in FIG. 46, when a release lever 480 is pushed upward, it is rotated clockwise about a shaft 480F. Then, a shaft 480E slides in a slot so that a release pawl 480 is rotated counterclockwise about a shaft 480D to release a shaft 481E (FIG. 47). When the shaft 481E is released as mentioned, a stapling section 481 is rotatable clockwise about a shaft 483. The release pawl 480B is returned to the initial position by a spring 480G. When the stapling section 481 is moved clockwise, its shaft 482A slides in a slot and, when locked by the slot, locks the stapling section 481 in position. In the locked position, the stapling section 481 is slightly inclined relative to the vertical and almost protruded to the outside of the sorter, facilitating the replacement of a staple cartridge 481C. After the replacement of the staple cartridge 481C, the release lever 480C is rotated upward or clockwise about the shaft 480F. This unlocks the shaft 482A to allow the stapling section 481 to move counterclockwise about the shaft 483. The release lever 480C is returned to the original position by the spring 480G. As shown in FIG. 50, when the stapling section 481 is moved counterclockwise as mentioned above, the shaft 481E abuts against and opens the release pawl 480B. After the shaft 481E has moved away from the release pawl 480B, the pawl 480B is closed by the spring 480G to lock the stapling position 481 in place. Such a procedure promotes easy replacement of a stapler cartridge.

Figures 53, 53A:
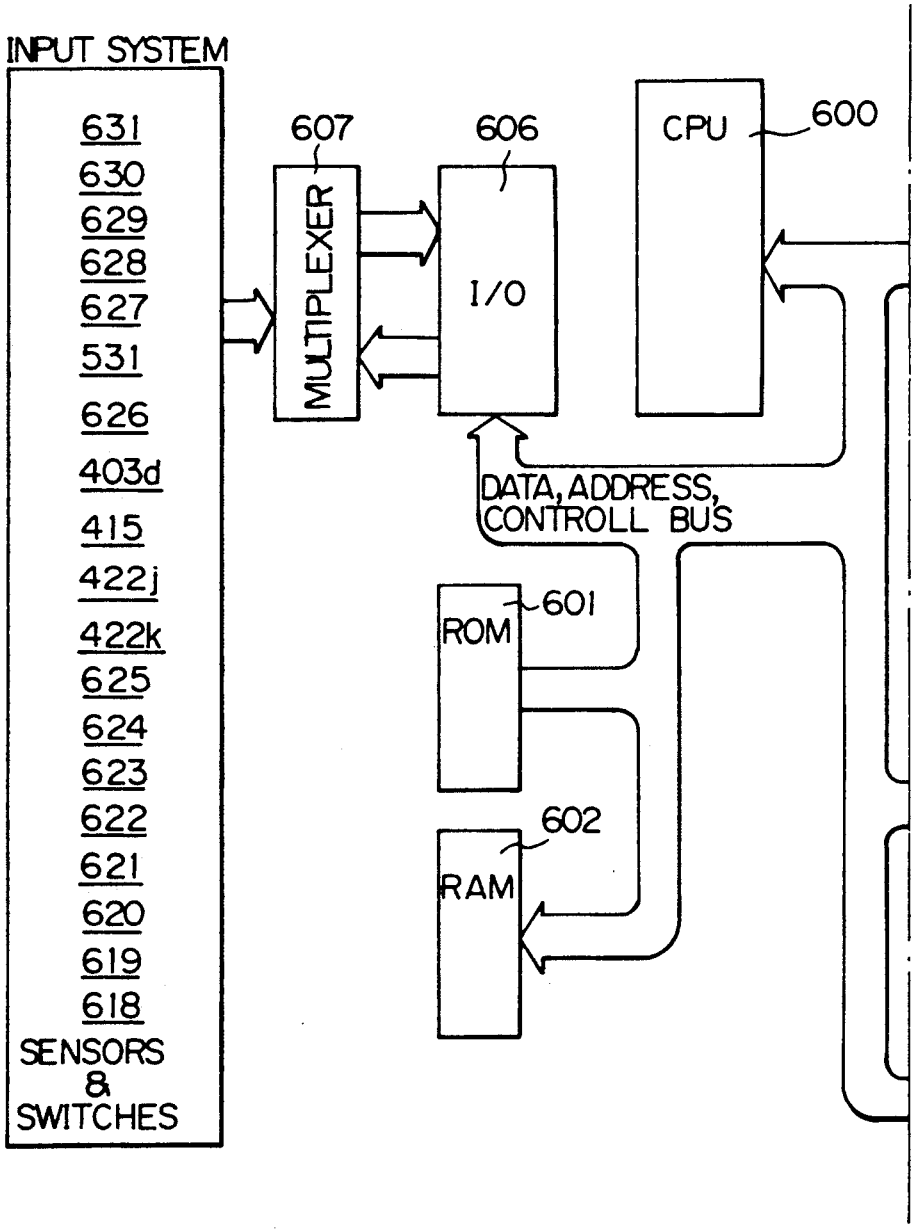
FIGS. 53A and B are a schematic block diagram of a control system for controlling the paper handling apparatus.
Figure 53B:
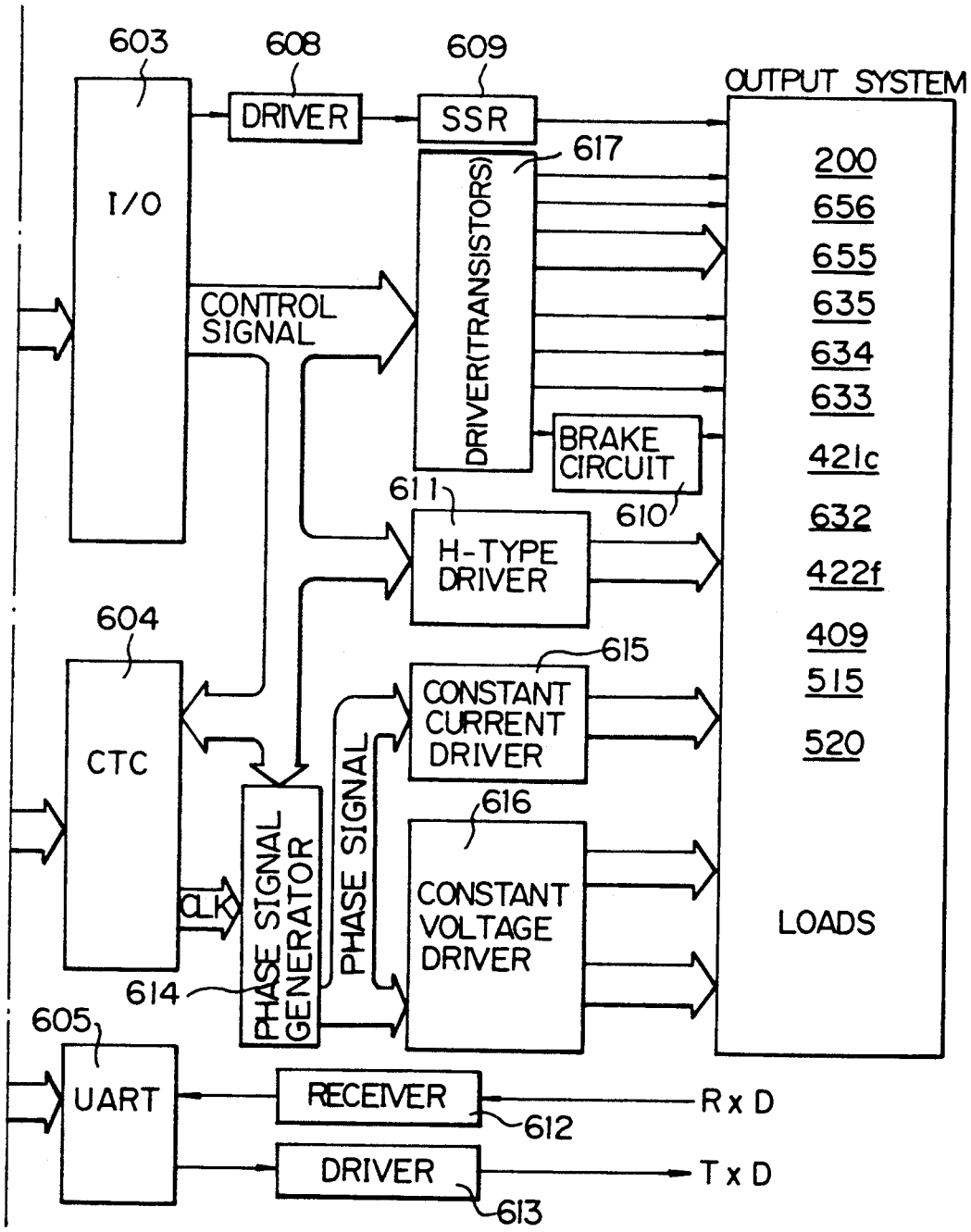

Referring to FIG. 53, a control system applicable to the illustrative embodiment is shown which is implemented as a microcomputer control system. As shown, the control system has a CPU 600, a ROM 601, a RAM 602, I/O ports 603 and 606, a clock timer controller 604 (CTC) 604, and a universal asynchronous receiver/-transceiver (UART) 605. The ROM 601 is loaded with programs. The CPU 600 receives output signals of an input system, i.e., sensors and switches via a multiplexer 607 and the I/O port 606. In response, the CPU 600 controls various loads which will be described via the I/O port 603, CTC 604, various drivers 608, 611, 615, 616 and 617, a phase signal generator 614, and SSR609. The CPU 600 interchanges various statuses and command signals with the copier via the UART 605 and a receiver 612 and a driver 613.

The sensors and switches may include an upper bin sensor 631, a lower bin sensor 630, an upper entry sensor 629, a lower entry sensor 628, a size home sensor 627, a size sensor 531, a pivot home sensor 626, an upper and lower home sensor 403*d*, an upper and lower position sensor 415, a pre-chuck sensor 422*j*, a post-chuck sensor 422*k*, a staple home sensor 625, a staple sensor 624, a paper sensor 623, a top cover switch 622, a left door switch 621, a right door switch 620, an inlet sensor 619, and a paper discharge sensor 618. The loads (output system) may include the drive motor (AC motor), a NO STAPLE indicator 656, a STAPLING indicator 655, a deflector solenoid (SOL) 635, a changeover SOL 634, an electromagnetic clutch (CL) 421*c*, a staple motor (DC motor) 632, the chuck motor (DC motor, reversible) 422*f*, the elevator motor (stepping motor) 409, a size motor (stepping motor 515, and the pivot motor (stepping motor) 520. The copier sends to the sorter and stapler a sorter start signal, a copier discharge signal, a mode signal, a size signal, a staple start signal, a staple end signal, a serviceman call reset signal (S.C. reset), etc. On the other hand, the sorter and stapler sends to the copier a discharge signal, a door cover open signal, a jam signal, a short bin signal, a failure signal, a no staple signal, and end-of-staple signal, a ready-to-staple signal, a ready-to-sort signal, etc.

Figure 54A:
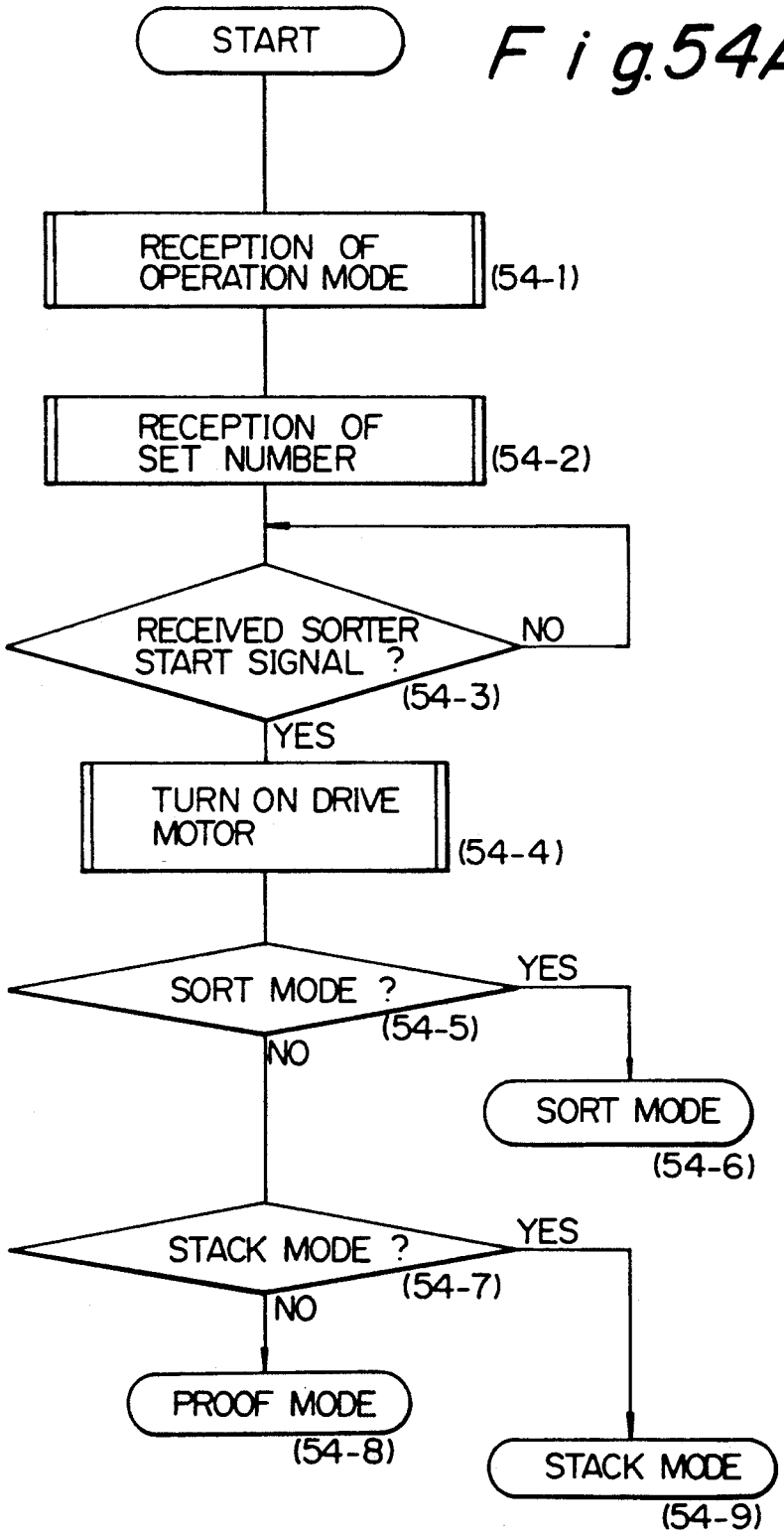
Figures 1, 54B:
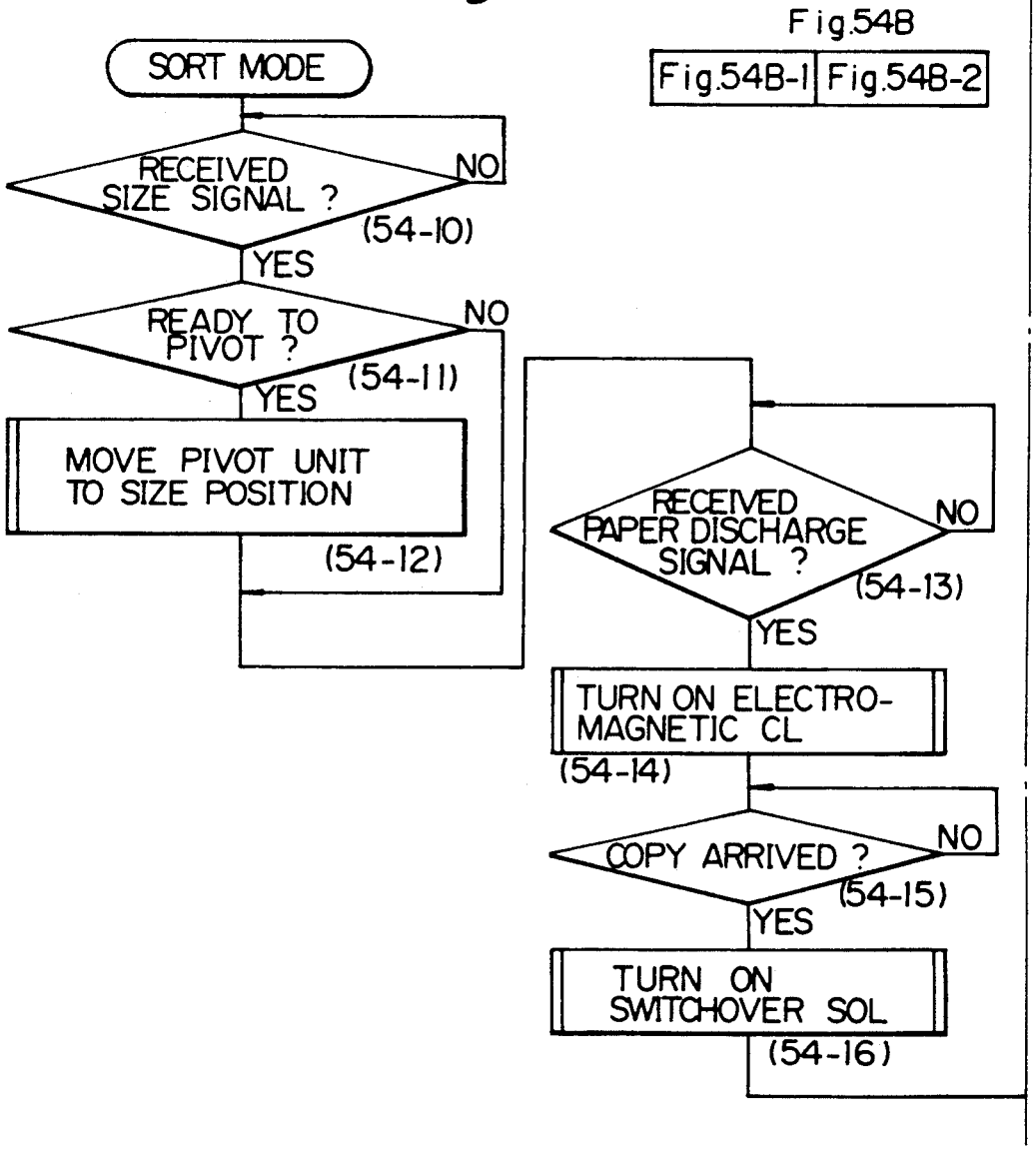
Figures 2, 54B:
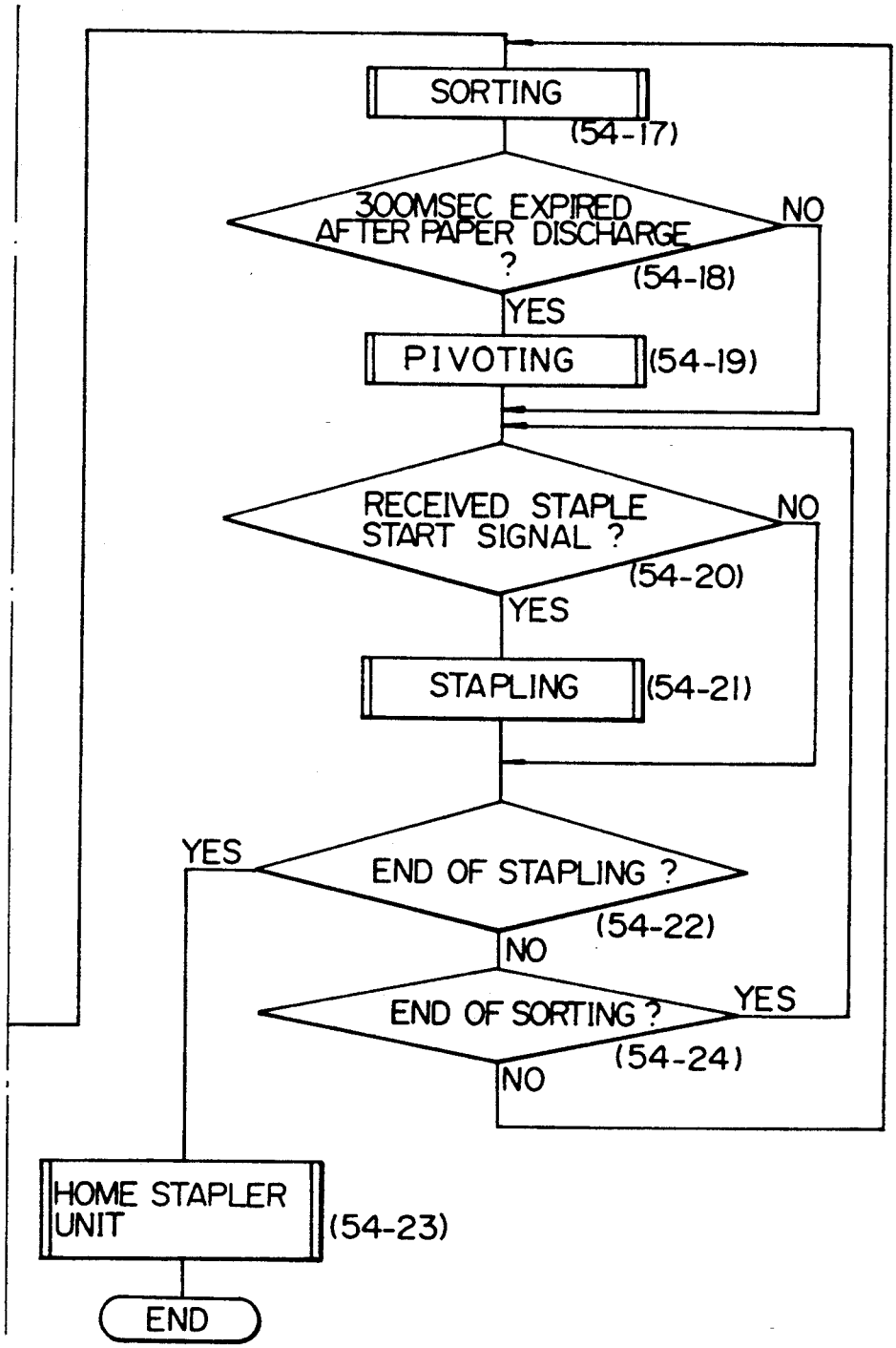

The operation and control particular to the illustrative embodiment will be described by using flowcharts. FIGS. 54A and 54B demonstrate the general operation of the embodiment.

First, an operation mode signal from the copier is received (step 54-1), and then a set number signal from the copier is received (step 54-2). After starting a copying operation, the copier sends a sorter start signal (step 54-3). In response, the drive motor 200 is energized (step 54-4) to set up a sort mode (steps 54-5 and 54-6). Before the arrival of the sorter start signal, a waiting state is maintained. As shown in FIG. 54B, in the sort mode, a size signal indicative of the size of paper sheets fed from the copier arrives a little later than the sorter start signal (step 54-10). In response to the size signal, whether or not the pivoting device is ready is determined (step 54-11). If answer of the step 54-11 is YES, the pivoting device is moved to a particular position matching the size signal (step 54-12).

Figure 56A:
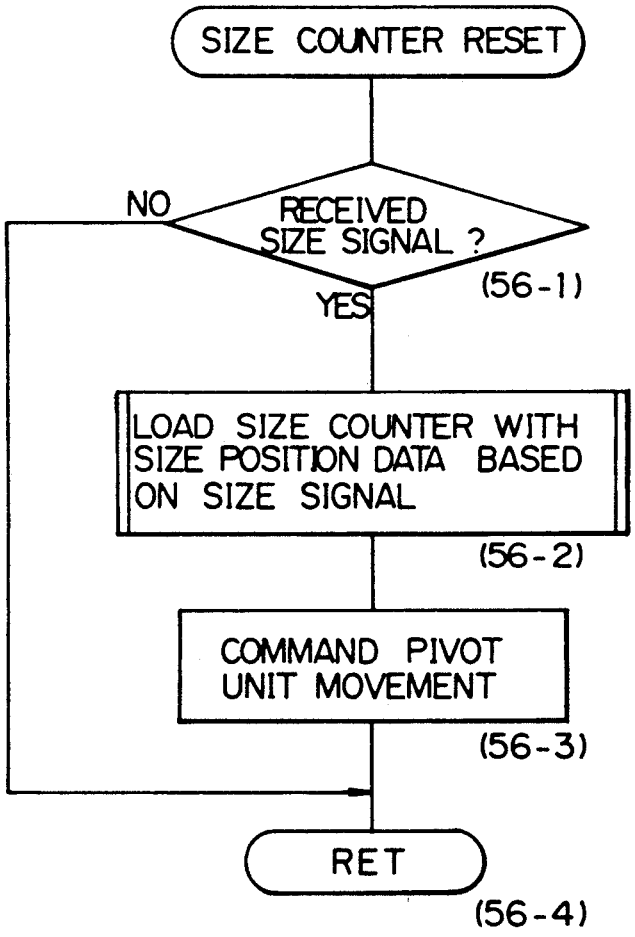
Figures 1, 56B:
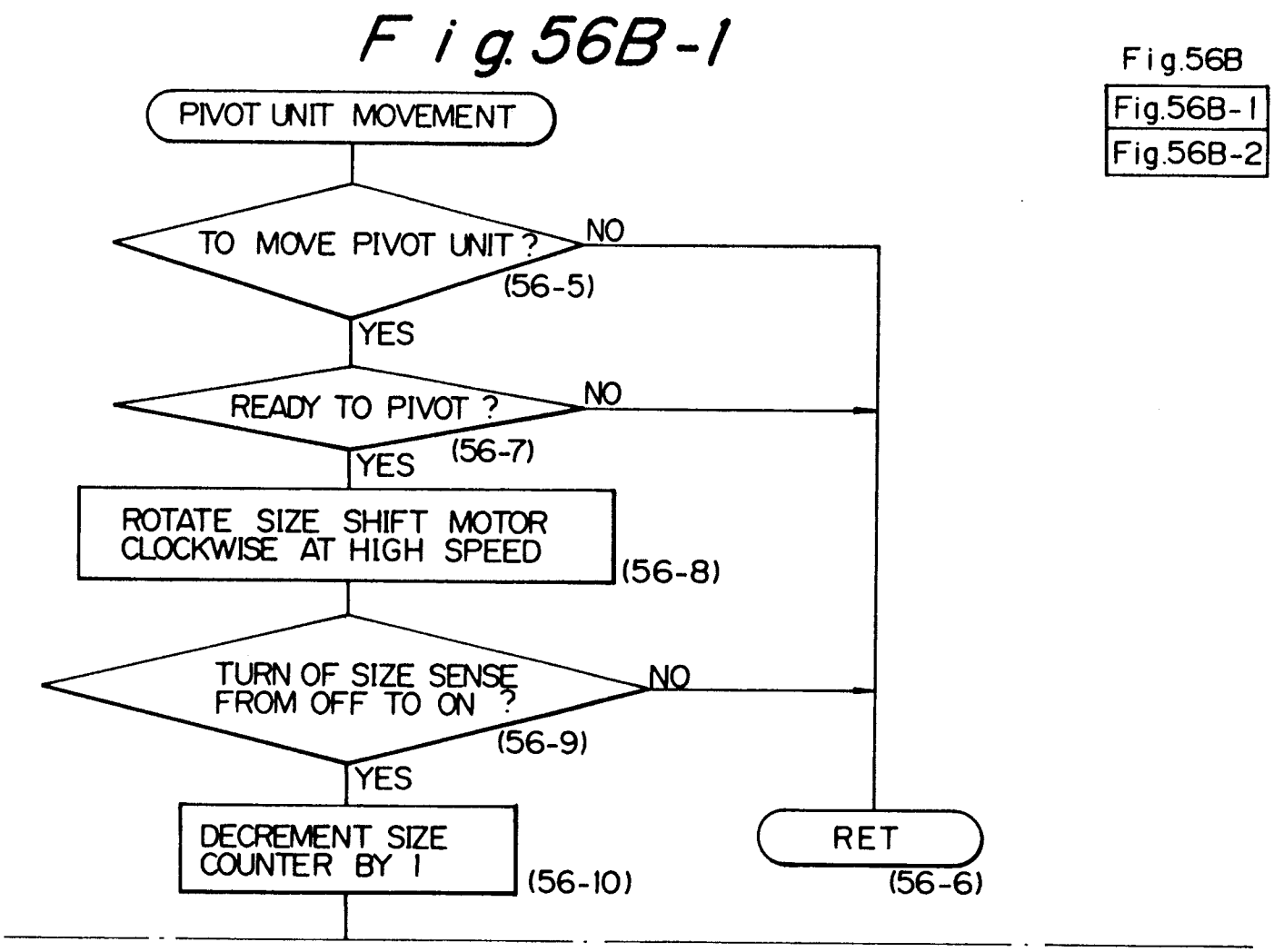
Figures 2, 56B:
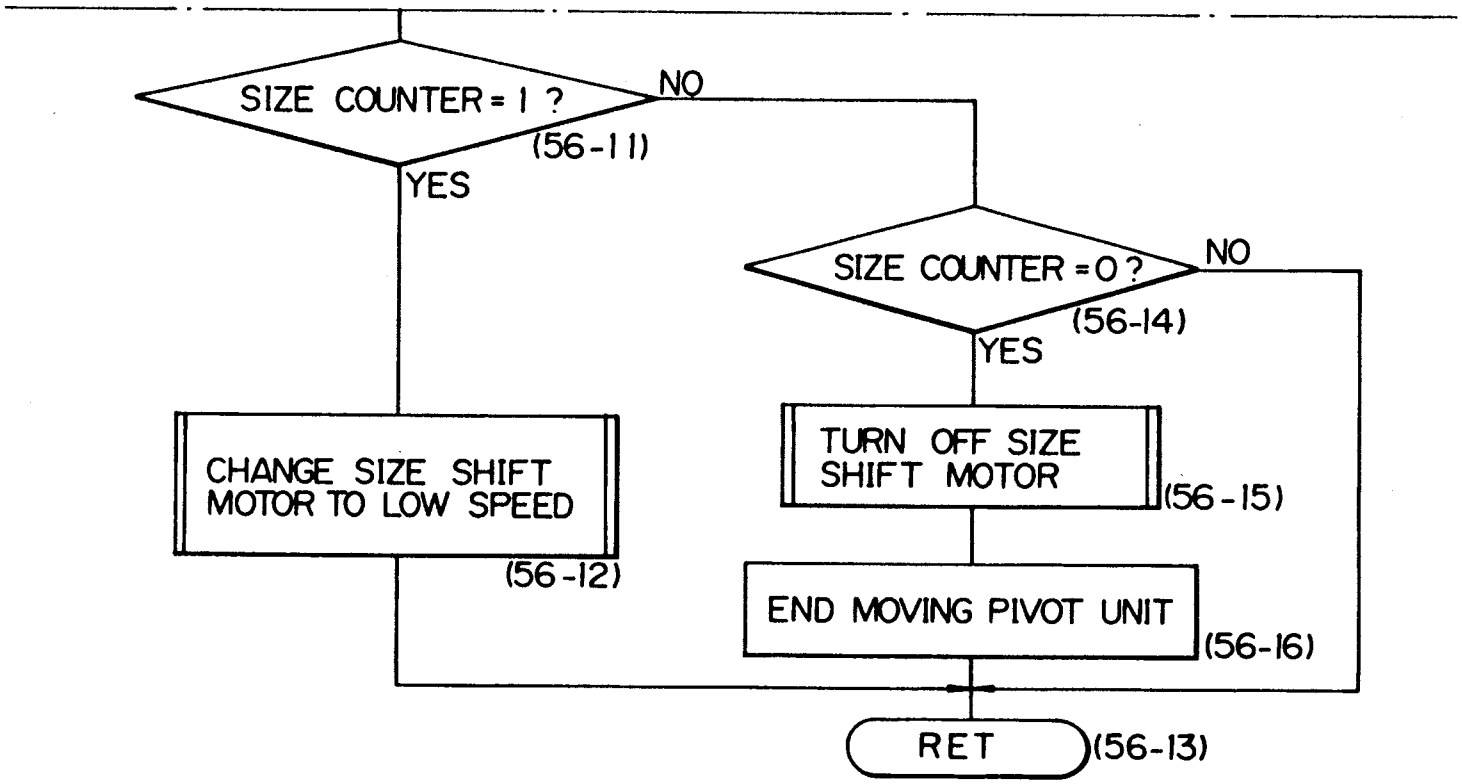

The subroutines included in the general operation as stated above are shown in FIGS. 56A and 56B. In FIG. 56A, a size counter preset subroutine is such that if the size signal has been received (step 56-1), size position data matching the size signal is loaded in a size counter (step 56-2) and a pivoting unit shift command is delivered (step 56-3). Then, the program returns (step 54-4). If the answer of the step 56-1 is NO, the program directly returns.

In FIG. 56B, the pivoting device (unit) shift subroutine is shown. If the pivoting unit is not to be moved (step 56-5), the program returns (step 56-6). If the answer of the step 56-5 is YES, whether or not the pivoting unit is ready to move is determined (56-7). If the answer of the step 56-7 is YES, the size motor 515 is rotated clockwise at a high speed (step 56-8). Then, whether or not the size sensor 531 has turned from OFF to ON is determined (step 56-9). If the answer of the step 56-9 is NO, the program returns (step 56-6). If the answer of the step 56-9 is YES, the size counter is decremented by 1 (step 56-10) and the size counter is checked (step 56-11). If the size counter is 1, the speed of the size shift motor 515 is lowered (step 56-12) and the program returns (step 56-13). If the size counter is 0 (step 56-14), the size shift motor 515 is deenergized (step 56-15) and the program returns.

Referring again to FIG. 54B, the copier sends a discharge signal when it drives a copy (paper sheet) thereoutof (step 54-13). On the reception of the discharge signal, the electromagnetic clutch (CL) is turned on (step 54-14). As the copy arrives at the sorter, the inlet sensor 619 is turned on (step 54-15) to in turn energize the changeover SOL 634 (step 54-16). The sorter is now ready to distribute the copy to the first bin. Among the deflector SOLs 635 to 654 each being associated with respective one of the bins, one associated with the first bin is energized a little later than the turn-on of the inlet sensor 619 to guide the copy to the bin (step 54-17). On the lapse of a suitable period of time necessary for the copy to be fully laid on the bin (e.g. 300 milliseconds, step 54-18), the pivot motor 520 is energized to move the pushing member to accurately position the copy on the bin (step 54-19). Specifically, the pushing member is moved when the trailing edge of the copy is sensed.

Figure 57:
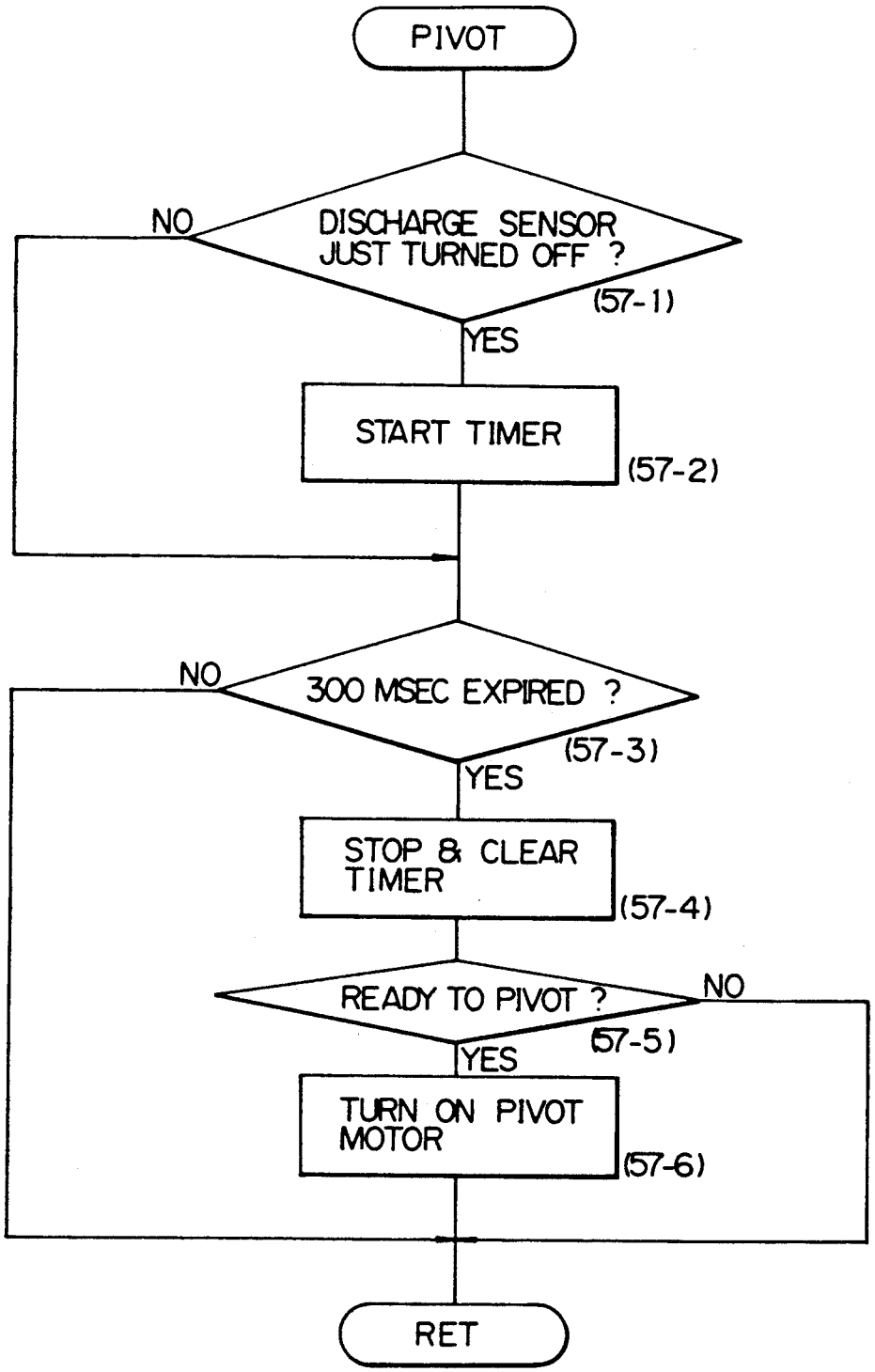
FIG. 57 is a flowchart demonstrating a pivoting operation.

The pivotal movement of the pushing member will be described specifically with reference to the subroutine of FIG. 57. When the copy is driven out onto the bin, either one of the upper and lower entry sensors 629 and 628 is turned on. At the end of the discharge, the entry sensor 629 or 628 turns from ON to OFF (step 57-1). The turn from ON to OFF is representative of the trailing edge of the copy. On the turn of the entry sensor 629 or 628 as mentioned above, a timer built in the CPU 600 is started (step 57-2). When a predetermined period of time, 300 milliseconds in the illustrative embodiment, expires as determined by monitoring the timer (step 57-3), the timer is stopped (step 57-4) and, if the pivoting unit is ready, the motor 520 is turned on to start a pivotal movement (step 57-6). This is repeated every time a copy is discharged onto the bin. However, when the number of copies sequentially stacked on the bin has exceeded the number which is available with the stapler unit (thirty copies in the illustrative embodiment), the pivot which will obstruct the sorting is interrupted, the pivoting unit is retracted to the home position, and the stapler unit is inhibited from binding the copies on the bin.

Figure 58:
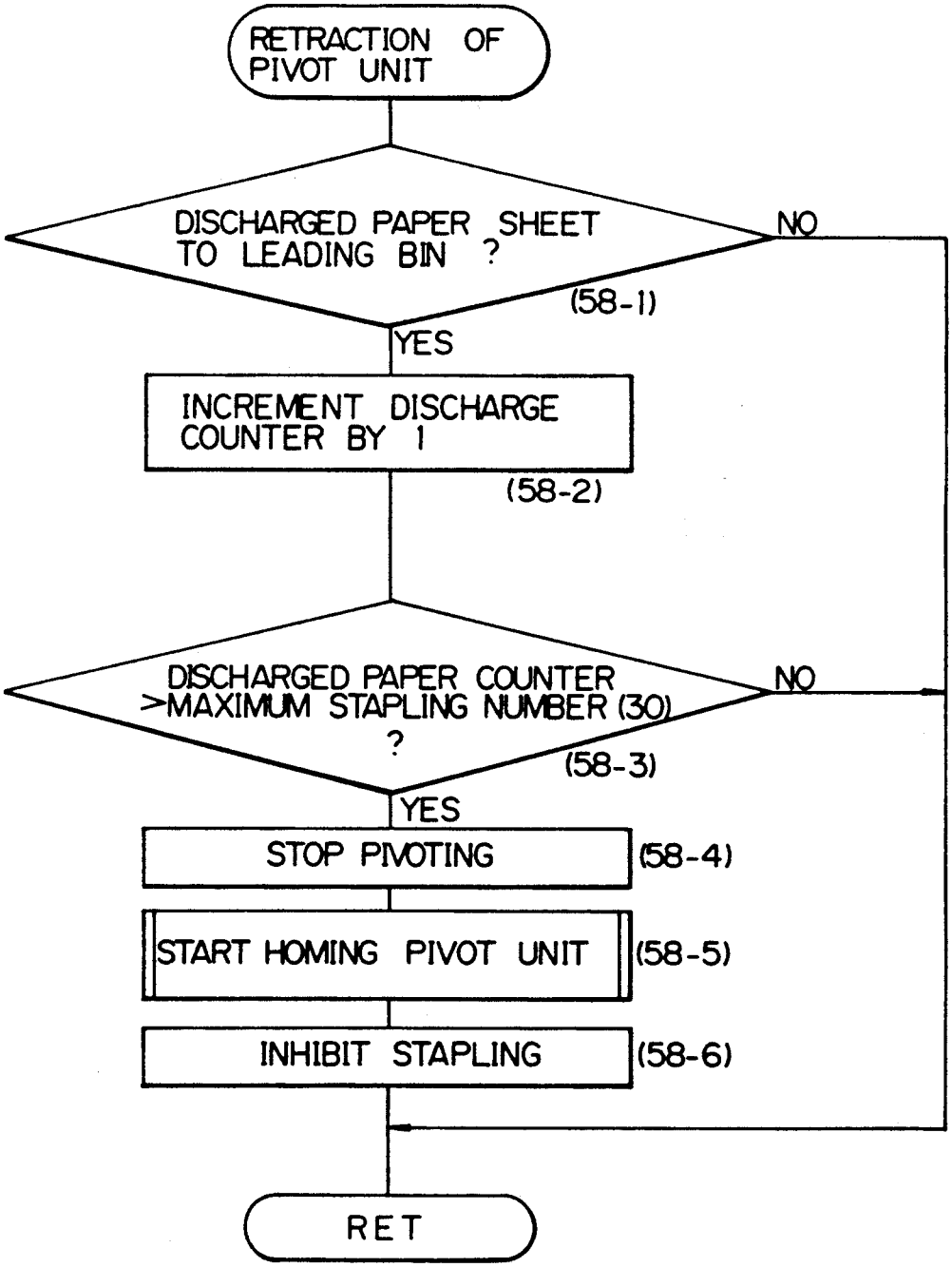
FIG. 58 is a flowchart showing a procedure for retracting the pivoting unit.

The retraction of the pivoting unit is represented by a subroutine in FIG. 58. As shown, when a copy is discharged onto the leading bin (step 58-1), it is counted (step 58-2). When the number of discharged copies has exceeded the number which can be stapled (step 58-3), the pivotting motion is interrupted (step 58-4) and the pivoting unit is retracted to the home position (step 58-5). The next copy and successive copies discharged onto the bin are not regulated in position. At the same time, the stapling operation with the previously discharged copies is also inhibited (step 58-6).

The stapling operation is as follows. In FIG. 54B, when a staple start command is received (step 54-20), a stapling operation begins (step 54-21). When the stapling operation ends (step 54-22), the stapler shift unit is moved to the home position (step 54-23). The stapling operation is executed in response to a command of software (step 54-24). Hence, as FIG. 54B indicates, the stapling operation of the illustrative embodiment may be controlled such that it occurs before the end of a sorting operation, i.e., in parallel with and alternatively with the latter in order to promote efficient paper handling. With the illustrative embodiment, two different stapling modes are available, i.e., a manual staple mode and an automatic staple mode. The manual staple mode allows paper sheets to be stapled after being sorted, while the automatic staple mode begins stapling a stack of paper sheets fully distributed to the first bin automatically without interrupting the sorting operation.

Figures 1, 55A:
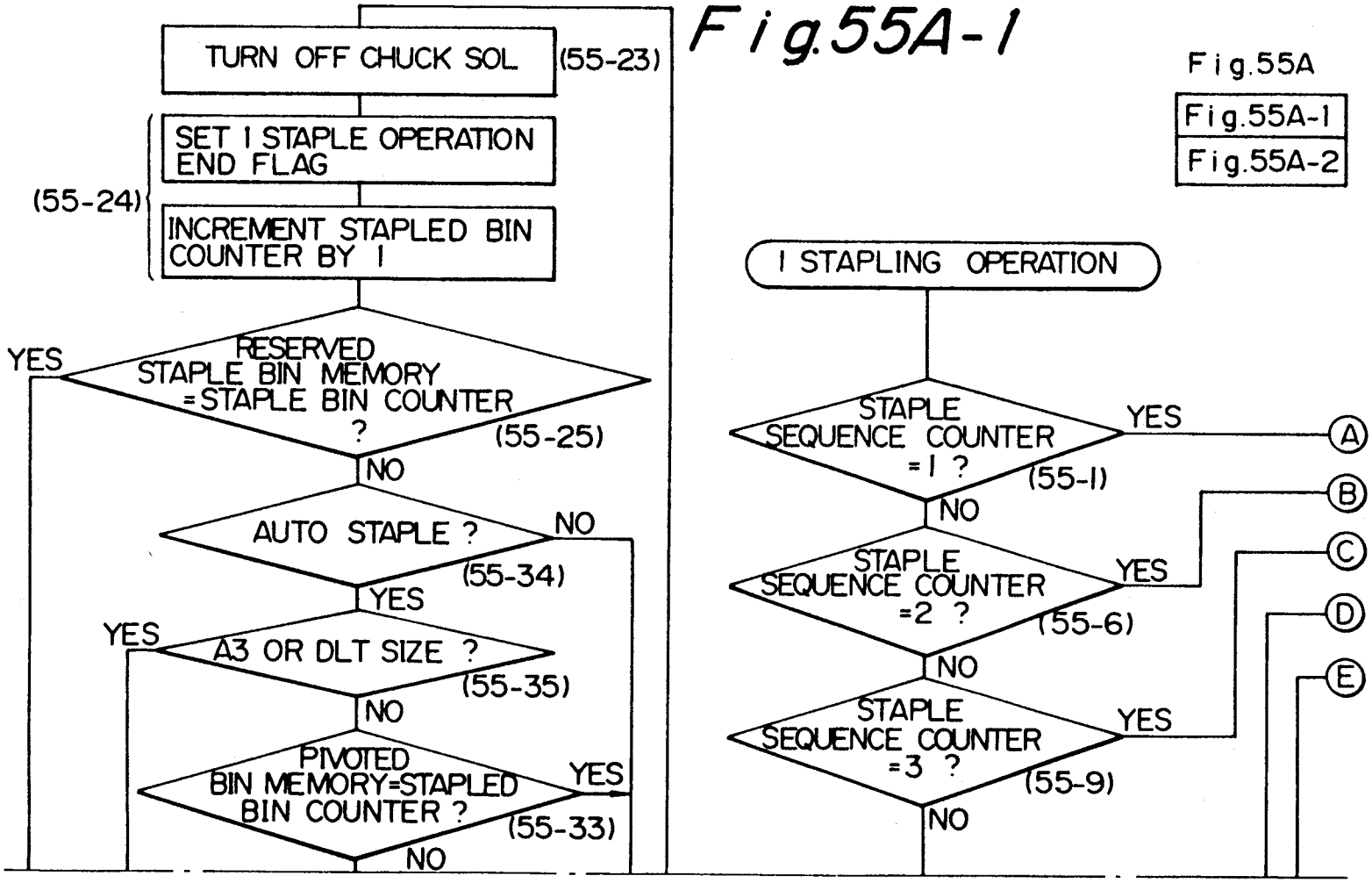
Figures 2, 55A:
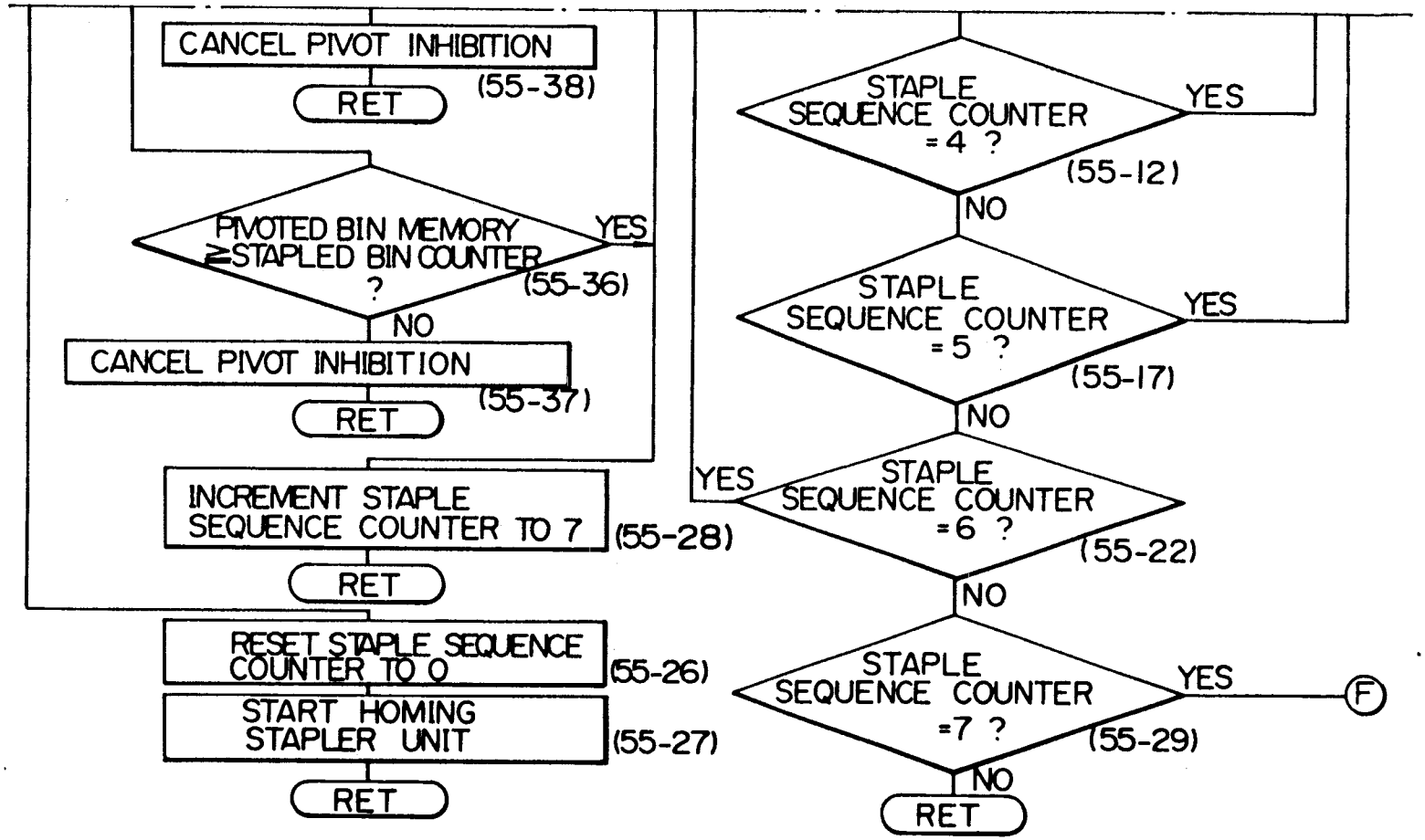
Figures 1, 55B:
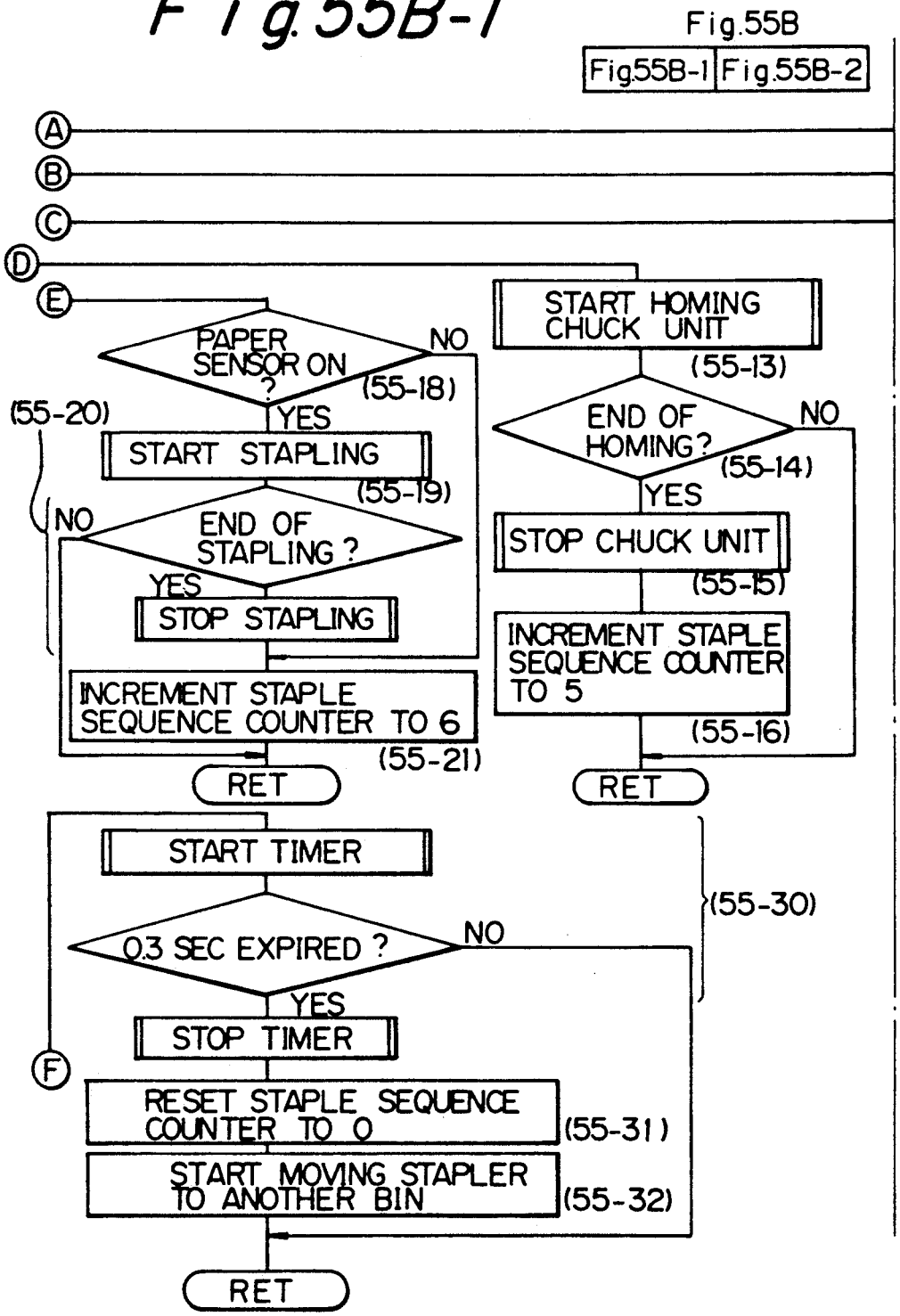
Figures 2, 55B:
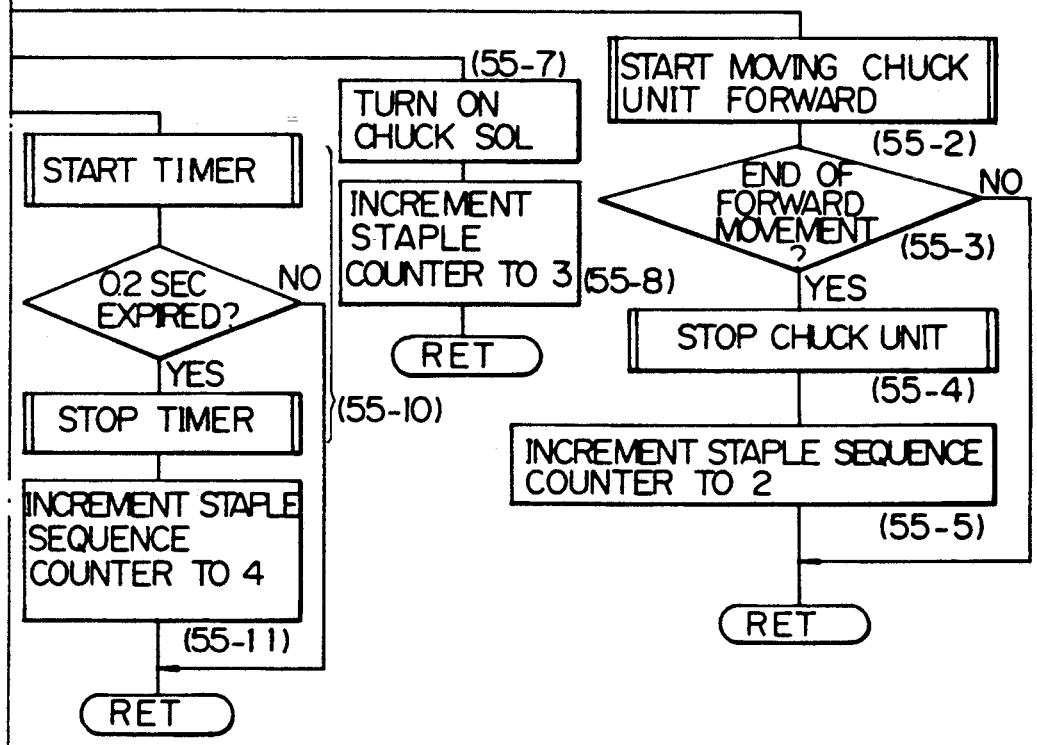

Referring to FIGS. 55A and 55B, a subroutine associated with the manual staple mode is shown. A manual staple mode operation begins in response to a staple start signal which the copier sends after a sorting operation and if copies are present on the bins. First, the stapler 401 is moved from the home position to the bin loaded with a paper stack to be stapled first. Thereafter, the program proceeds based on the value of a staple sequence counter as shown in FIGS. 55A and 55B. Specifically, when the stapler 401 reaches the leading bin, the staple sequence counter is incremented from 0 to 1 (step 55-1). When the staple sequence counter is 1, the chuck motor 422*f* is turned on to move the chuck unit forward (step 55-2). As the pre-chuck sensor 422*j* responsive to the end of the forward movement of the chuck unit is turned on (step 55-3), the chuck unit is brought to a stop (step 55-4) while the staple sequence counter is incremented to 2 (step 55-5). When the staple sequence counter is 2 (step 55-6), the chuck SOL 421*c* is turned on (step 55-7) and the staple sequence counter is incremented to 3 (step 55-8). When the staple sequence counter is 3 (step 55-9), the current state is held for 0.2 second and, on the lapse of 0.2 second (step 55-10), the staple sequence counter is incremented to 4 (step 55-11). When the staple sequence counter is 4 (step 55-12), the chuck motor 422*f* is turned on to return the chuck unit to the home position (step 55-13). As the post-chuck sensor 422*k* is turned on (step 55-14), the return of the chuck unit to the home position is terminated (step 55-15) and the staple sequence counter is incremented to 5 (step 55-16).

When the staple sequence counter is 5 (step 55-17), the paper sensor 623 is checked to see if paper sheets are present (step 55-18). If the answer of the step 55-18 is YES, a stapling action is performed (step 55-19). When the stapling action is completed (step 55-20), the staple sequence counter is incremented to 6 (step 55-12). If the answer of the step 55-18 is NO, no stapling actions are performed. When the staple sequence counter is 6 (step 55-22), the chuck SOL 421*c* is turned off (step 55-23), a stapled bin counter is incremented, and the pivot motor is energized to position the stapled paper stack (step 55-24). Then, the stapled bin counter is compared with a reserved bin memory which indicates the number of bins loaded with paper stacks to be stapled. If the stapled bin counter equals the reserved bin memory (step 55-25), the staple sequence counter is reset to 0 and the stapling operation is ended (step 55-26). Subsequently, the elevator motor 409 is turned on to move the stapler unit to the home position (step 55-27). How the value of the reserved bin memory is calculated and how the stapled paper stack is positioned will be described later. When the stapled bin counter is smaller than the reserved bin memory, the staple sequence counter is incremented to 7 (step 55-28). When the staple sequence counter is 7, the current state is held for 0.3 second and, on the lapse of 0.3 second (step 55-30), the staple sequence counter is reset to 0 (step 55-30). At the same time, the start of a shift of the stapler to the next bin is commanded as will be described with reference to FIG. 55C.

Figure 55C:
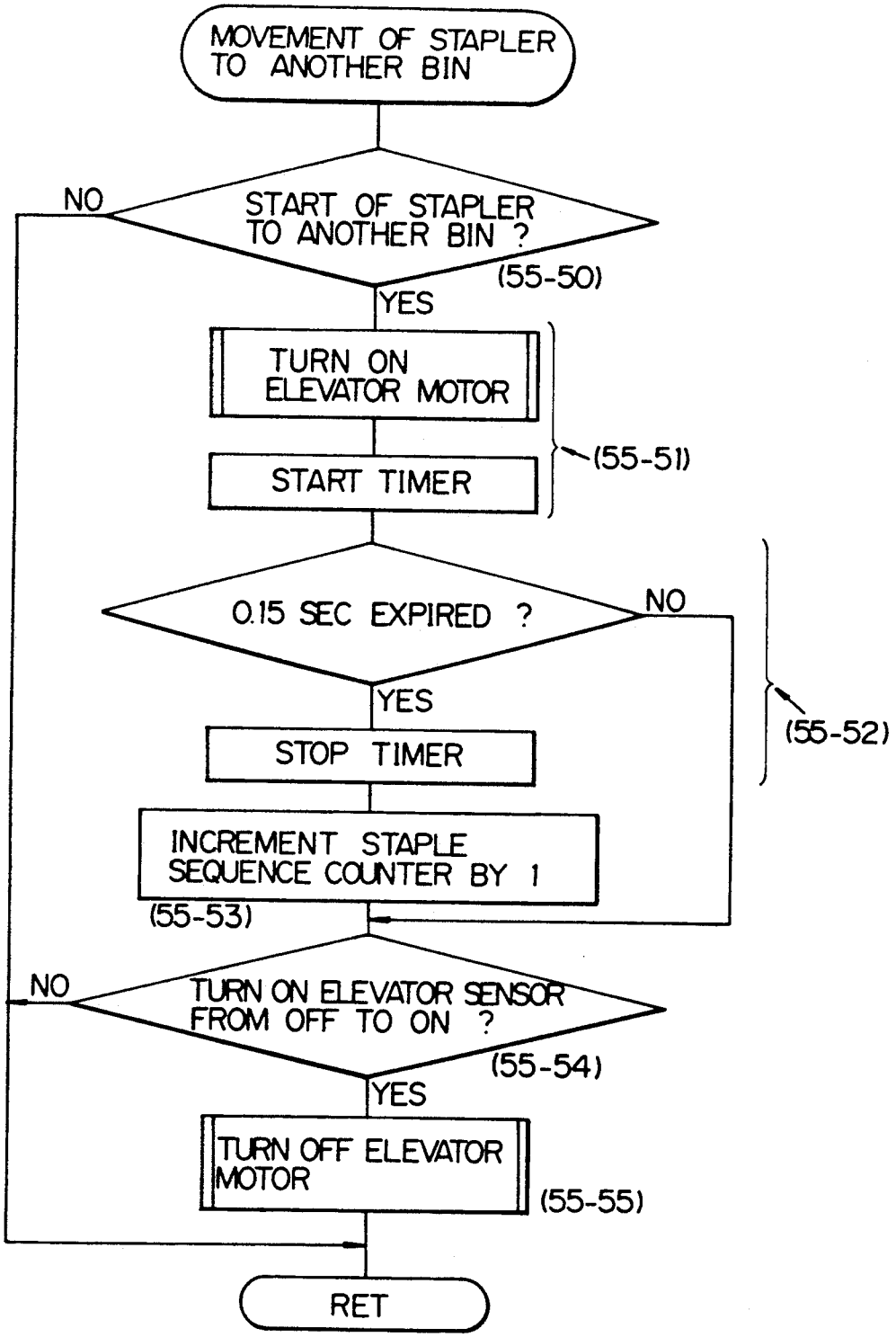

In FIG. 55C, whether or not the start of a shift of the stapler has been commanded is determined. If it has been commanded (stap 55-50), the elevator motor 409 is turned on and the timer is started (step 55-51). When a predetermined period of time expires (step 55-52), the staple sequence counter is incremented to 1 (step 55-53) to start moving the stapler to the next bin. Whether or not the up-down position sensor 415 has been turned on is determined (step 55-54). If the answer of the step 55-54 is YES, the elevator motor 409 is turned off to end the shift of the stapler. In the illustrative embodiment, the stapler starts on a stapling operation for the next bin about 100 milliseconds before the end of the shift to that bin in order to reduce the stapling time. The sequence of steps described above is repeated until the stapled bin counter equals the reserved bin counter.

The automatic or auto staple mode will be described with reference to FIGS. 55A to 55B. While a sorting operation is under way, the copier sends a staple start signal at the time when it discharges the first copy of the last document. After the reception of the staple start signal and the distribution of the first copy of the last document, a stapling operation begins when that copy is positioned by the pivoting device. Specifically, the stapler 401 is brought from the home position to the bin loaded with a paper stack to be stapled first. As soon as the stapler 401 reaches the first bin, the operation proceeds on the basis of the value of the staple sequence counter as shown in FIGS. 55A and 55B. When the stapler 401 is positioned at the first bin, the stapler sequence counter is incremented from 0 to 1 (step 55-1). When the staple sequence counter is 1, the chuck motor 422*f* is energized to move the chuck unit forward (step 55-2). When the pre-chuck sensor 422*j* responsive to the end of the forward movement of the chuck unit is turned on (step 55-3), the chuck unit is brought to a stop (step 55-4) while the staple sequence counter is incremented to 2. When the staple sequence counter is 2 (step 55-6), the chuck SOL 421*c* is turned on (step 55-7) while the staple sequence counter is incremented to 3 (step 55-8).

When the staple sequence counter is 3, the current state is held for 0.2 second and, on the lapse of 0.2 second (step 55-10), the staple sequence counter is incremented to 4 (step 55-11). When the staple sequence counter is 4 (step 55-12), the chuck motor 422*f* is turned on to move the chuck unit to the home position (step 55-13). As the post-chuck sensor 422*k* responsive to the end of the movement of the chuck unit to the home position is turned on (step 55-14), the movement to the home position is terminated (step 55-15) while the staple sequence counter is incremented to 5 (step 55-16). When the staple sequence counter if 5 (step 55-17), the output of the paper sensor 623 is checked to see if paper sheets are present (step 55-18). If the answer of the step 55-18 is YES, a stapling action is performed (step 55-19). When the end of the stapling action is detected (step 55-20), the staple sequence counter is incremented to 6 (step 55-21). If the answer of the paper sensor 623 is NO, no stapling actions are performed. When the staple sequence counter is 6 (step 55-22), the chuck SOL 421*c* is turned off (step 55-23), the stapled bin counter is incremented, and the pivot motor is energized to position the stapled paper stack. Then, the stapled bin counter is compared with the reserved bin memory. If they compare equal (step 55-25), the staple sequence counter is reset to 0 and the stapling operation is ended (step 55-26). Subsequently, the motor 409 is turned on to move the stapling device 400 to the home position (step 55-27).

When the stapled bin counter is smaller than the reserved bin memory, the stapled bin counter is compared with a pivoted bin memory indicative of up to which bin the pivotal movement has occurred (step 55-33). If the stapled bin counter is smaller than the pivoted bin memory, the staple sequence counter is incremented to 7. If the stapled bin counter is equal to or greater than the pivoted bin memory (step 55-33), the staple is held in the current position and pivot inhibition processing is cancelled (step 55-38) to urge the pivotal movement to occur. In this manner, which of the paper positioning means (pivot motor) and the stapling means (stapling device 400) should be activated prior to the other is determined.

If the paper sheets have a predetermined size (step 55-35) and the pivoted bin memory is greater than the stapled bin memory by 2 or more, the staple sequence counter is incremented to 7 (step 55-36). If the former is greater than the latter by 1 or less, the stapler is held in the current position while the pivot inhibition processing is cancelled (step 55-37) to urge the pivot to occur. The pivot inhibition processing and the calculation associated with the pivoted bin memory will be described later. By the procedure described above, the pivotal movement can be effected at least twice with a paper stack of interest before the paper stack is stapled.

After the pivotal movement, when the pivoted bin memory becomes greater than the stapled bin memory or, in the case of a predetermined size, when the former becomes greater than the latter by 2 or more, the staple sequence counter is incremented to 7 (step 55-28). When the staple sequence counter is 7, the current state is held for 0.3 second and, on the lapse of 0.3 second, the start of a shift of the stapler to the next bin is commanded as described with reference to FIG. 55B.

Figure 59A:
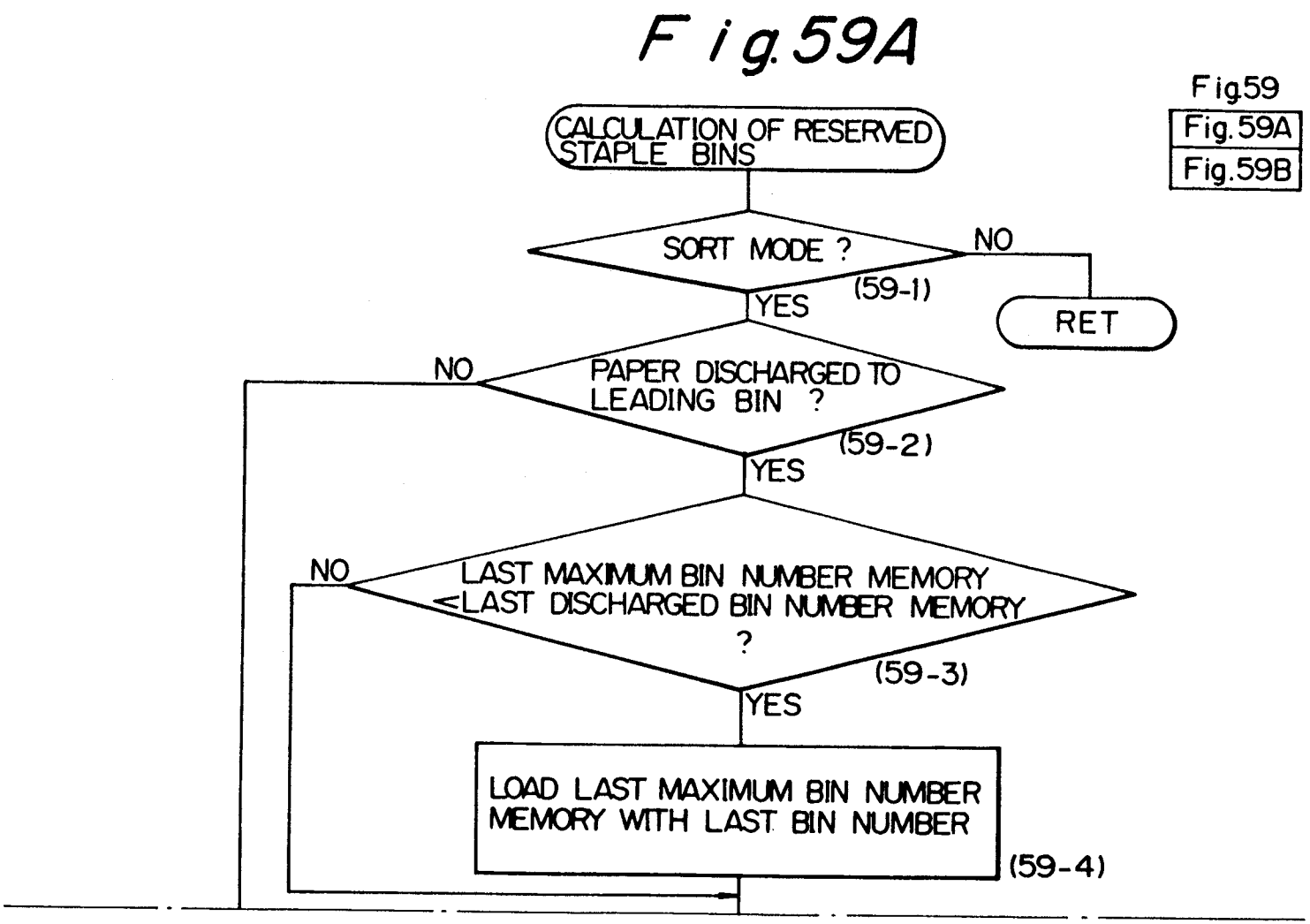
FIGS. 59A and B are a flowchart showing a calculation procedure associated with reserved staple bins.
Figure 59B:
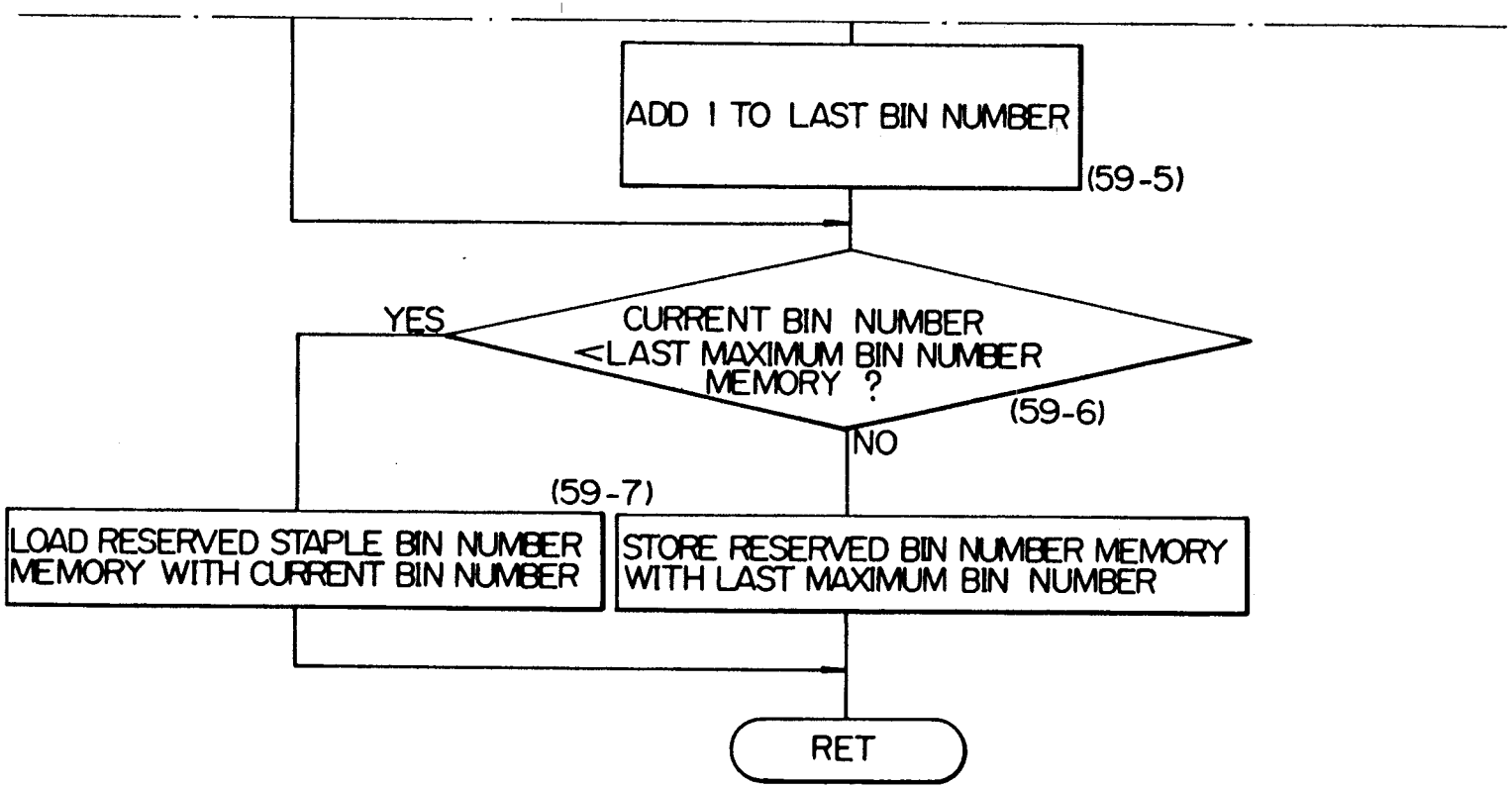

The number of reserved bins for stapling is calculated by a subroutine which is shown in FIG. 59. In the illustrative embodiment, the calculation is implemented by three different memories, i.e., a memory for storing up to which bin copies have been discharged document by document while a sort mode operation is under way (hereinafter referred to as a last bin number memory), a memory for storing up to which bin copies have been discharged at maximum by one sorting sequence (hereinafter referred to as a last maximum bin number memory), and a memory for indicating up to which bin a stapling operation should be performed (hereinafter referred to as a reserved bin number memory). The contents of these memories are shifted, as follows.

After the copier has started on a copying operation in the sort mode (step 59-1), the last bin number memory and the last maximum bin number memory are compared at the time when a copy sheet is discharged onto the first bin of the sorter (step 59-2). If the last bin number memory is greater than the last maximum bin number memory, the content of the last bin number memory is substituted for the content of the last maximum bin number memory (step 58-4) while 1 is substituted for the last bin number memory (step 59-5). As copies are sequentially distributed to the second bin and successive bins, the content of the last bin number memory is sequentially increased by 1 each time. The number assigned to a bin into which a copy is being discharged is constantly compared with the last maximum bin number memory (step 59-6), and one of them which is smaller than the other is loaded in the reserved bin number memory (step 59-7). Since the content of the reserved bin number memory is dependent on the situation, the above procedure is practicable even in the automatic staple mode wherein a stapling operation is effected while discharging copies.

Specifically, assume that ten bins, five bins and seven bins are reserved for the first document, second document, and third document. First, a copy of the first document is discharged onto the first bin or leading bin. At this instant, the last maximum bin number M and the last bin number stored in the individual memories are 0, so that the answer of the step 59-3 is NO. Then, the last bin number memory is loaded with 1 (step 59-5). In a step 59-6, the number assigned to the bin onto which a copy is being discharged and the content of the last maximum bin number memory are compared. When a copy of the first document is discharged to the tenth bin, the current bin number is 10 and the last bin number M is 0, i.e., the current bin number is greater than the last bin number. Hence, the answer of the step 59-6 is NO resulting in the reserved bin number memory being loaded with 0.

Subsequently, a copy of the second document is distributed to the first bin. At this time, the last maximum bin number M is 0 while the last discharged bin number (counted up by another routine) is 10. Therefore, the answer of the step 59-3 is YES resulting in the last maximum bin number M being loaded with 10. When a copy of the second document has been discharged onto the fifth bin as determined in the step 59-6, the current bin number is 5 and the last maximum bin number M is 10. As a result, the reserved bin number memory is loaded with 5.

Finally, a copy of the third document is distributed to the first bin. At this time, the last maximum bin number M is 10 while the last bin number is 5, so that the answer of the step 59-3 is NO. Then, the last maximum bin number M remains in 10. When a copy of the third document has been discharged onto the seventh bin, the current bin number is 7 while the last maximum bin number is 10. Hence, the answer of the step 59-6 is YES. Then, the reserved bin number memory is loaded with 7. Thereafter, a stapling operation is repeated with those bins to which copies of the last document have been distributed.

By the above procedure, it is possible to activate the binding means 400 at the bins which are loaded with copies of the last document, i.e., to bind sets of copies having all the pages as far as possible. It may appear that this purpose is achievable without resorting to the complicated procedure described above. Specifically, a simple procedure wherein the current bin number is monitored and entered in the reserved bin number memory may suffice. The above sequence of steps is adopted intentionally for the following purpose.

Assume that seven bins, five bins and ten bins are reserved for the first document, second document, and third document, respectively. First, a copy of the first document is distributed to the first bin or leading bin. At this instant, both the last maximum bin number M and the last bin number are 0 and, hence, the answer of the step 59-3 is NO. Then, the last bin number memory is loaded with 1 (step 59-5). This means that the last bin number is reset document by document. After the step 59-5, the current bin number and the last maximum bin number are compared in the step 59-6. When a copy of the first document has been distributed to the seventh bin, the current bin number is 7 while the last maximum bin number M is 0. At this time, the answer of the step 59-6 is NO resulting in the reserved bin number memory being loaded with 0.

After the copies of the first document have been discharged onto the first to seventh bins, copies of the second document are sequentially distributed. When the copies of the second document have been distributed up to the fifth bin, the current bin number is 5 while the last maximum bin number M is 7. The answer of the step 59-7 is, therefore, YES. Hence, the reserved bin number memory is loaded with 5 in a step 59-7.

Thereafter, a copy of the third document is driven out onto the first bin. At this instant, the last bin number M is 7 while the last number of discharged copies is 5. Hence, the answer of the step 59-3 is NO so that the last maximum bin number M remains in 7. When copies of the third document have been discharged up to the tenth bin, the current bin number is 10 and the last maximum bin number M is 7. The answer of the step 59-6 is, therefore, NO. Consequently, the reserved bin number memory is loaded with 7. In this condition, paper stacks are stapled up to the seventh bin. Specifically, despite that copies of the last document have been distributed to the first to tenth bins, only the copies loaded on the first to seventh bins are stapled. This prevents a single copy stored in each of the eighth, ninth and tenth bins from being stapled. It is to be noted that when only one document is copied, the content of the reserved bin number memory is 0 and, therefore, stapling a single copy is of course inhibited.

The above procedure inhibits the binding means 400 from operating with those bins which store only a single copy despite the distribution of copies of the last document. This is successful in eliminating wasteful binding operations otherwise caused when the number of copies associated with the last document is changed.

Figure 60:
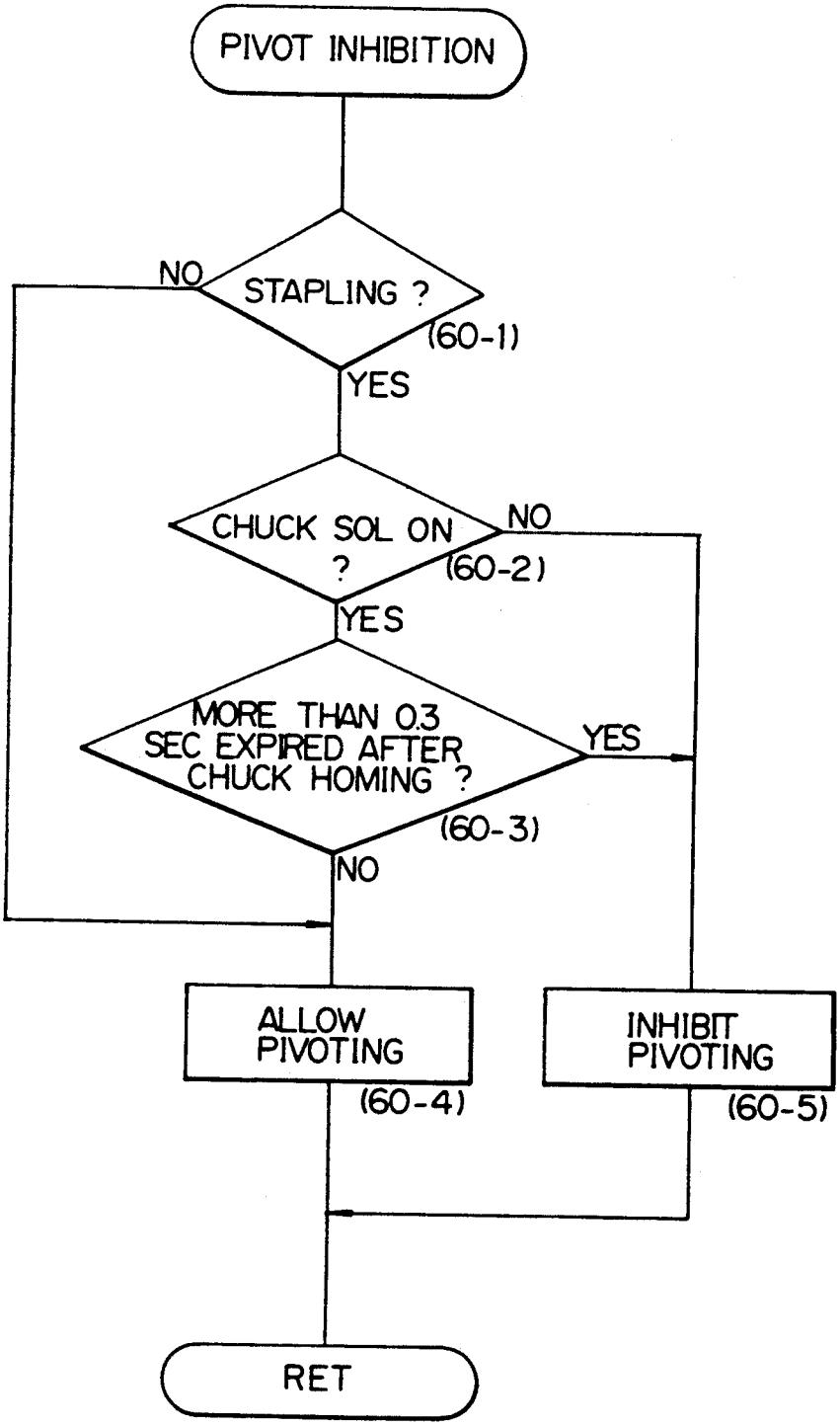
FIG. 60 is a flowchart showing pivot inhibition processing.

FIG. 60 shows a subroutine for inhibiting the pivotal movement with priority given to stapling. As shown, whether or not a stapling operation is under way is determined (step 60-1). If the answer of the step 60-1 is YES, whether or not the chuck SOL has been turned on is determined (step 60-2). If the answer of the step 60-2 is YES, whether or not 0.3 second has expired after the arrival of the chuck at the home position is determined (step 60-3). If the answer of the step 60-3 is NO, the pivotal movement is allowed to occur (step 60-4). If the answer of the step 60-2 is NO, the pivot is inhibited (step 60-5). If the answer of the step 60-3 is YES, the pivot is inhibited and the program returns. If the answer of the step 60-1 is NO, the program unconditionally returns while inhibiting the pivotal movement.

Figure 61:
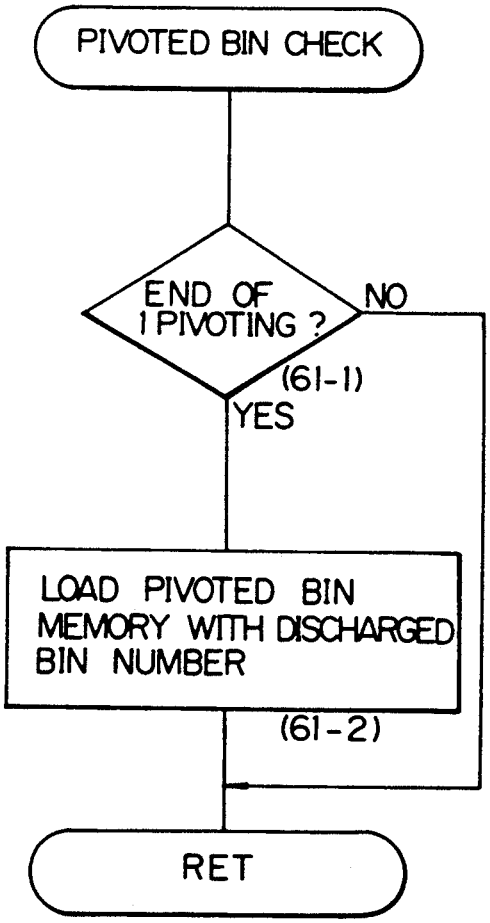
FIG. 61 is a flowchart showing a procedure for checking bins where a pivotal movement has occurred.

FIG. 61 shows a subroutine representative of the calculation which is associated with the pivoted bin memory. First, whether or not the pivoting motion has been effected once is determined (step 61-1). If the answer of the step 61-1 is NO, the program returns. If the answer of the step 61-1 is YES, the program returns after loading a rotated bin memory with the number of discharged bins (step 61-2). The words "number of discharged bins" mean up to which bin copies have been discharged, while the words "rotated bin memory" indicate up to which bin the pivotal movement has occurred.

Figure 62:
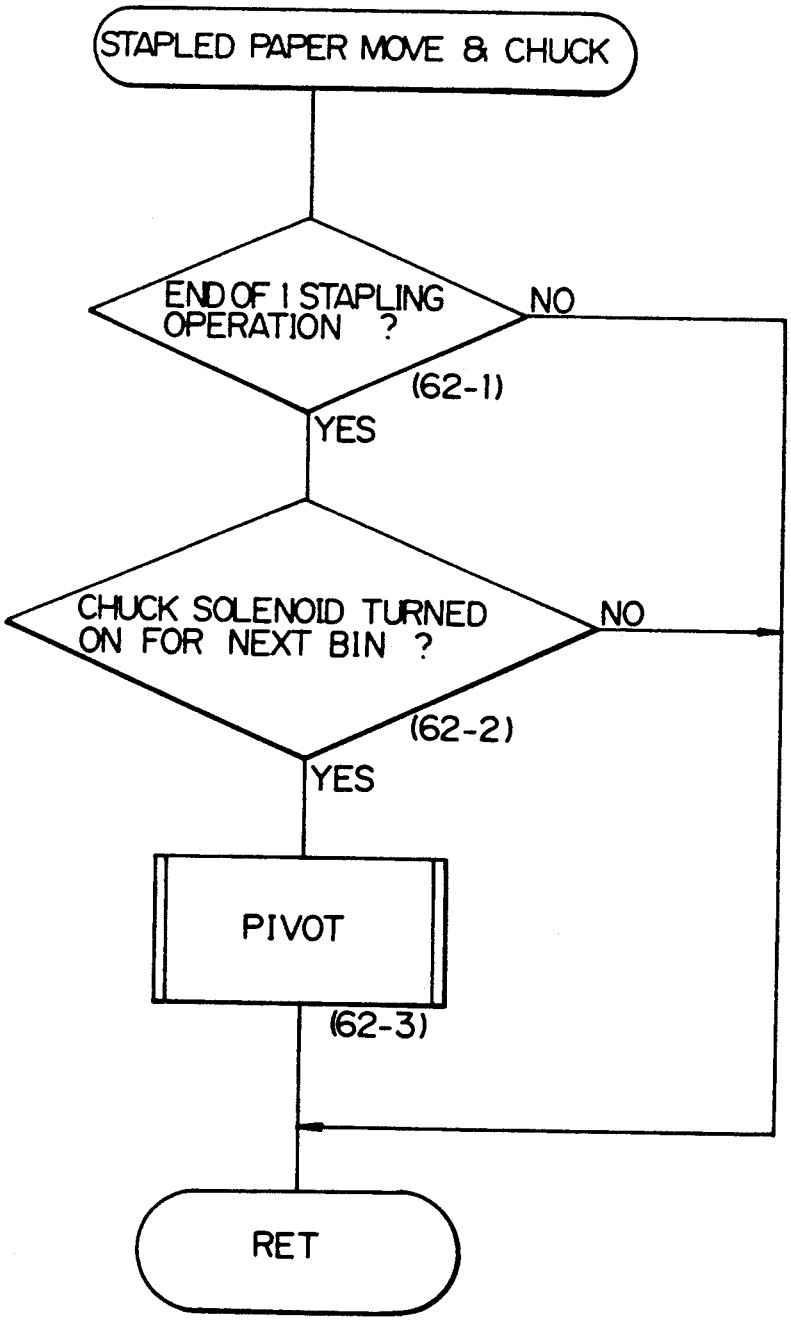
FIG. 62 is a flowchart showing processing associated with a chuck.

FIG. 62 shows a subroutine for positioning a stapled paper stack. As shown, after a stapling operation (step 62-1), the chuck SOL 421*c* is turned off. Then, the push bar 422*z* pushes the stapled copies (paper sheets) to return them to the region where the pivotable member of the pivoting device is rotatable. This is the end of one stapling operation. At this instant, an end-of-staple flag representative of the end of one stapling operation is set. After the end of one stapling operation as determined on the basis of such a flag, the stapler unit is shifted to the next bin for performing one stapling operation. When the chuck SOL is turned on during the stapling operation at the next bin as determined by a step 62-2, a pivotal movement is started (step 62-3) so as to shift the stapled paper stack on the previous bin to a predetermined position. The stapled paper stack so shifted will not adversely influence the positioning of paper sheets which are distributed to the next bin and successive bins.

The illustrative embodiment has some unique functions and operations in addition to the functions and operations described so far, as follows.

First, a block-by-block stapling function divides the bins into an upper block and a lower block and, after sorting copies to one of the blocks and stapling them, sorts copies to the other block and staples them. This function has two different modes, i.e., a mode A available only when the copy sizes associated with the upper and lower blocks are the same and a mode B available only when the copy size associated with one of the blocks to be dealt with later is greater than the copy size associated with the other block dealt with previously. These modes are switched over depending on the user.

Figure 63:
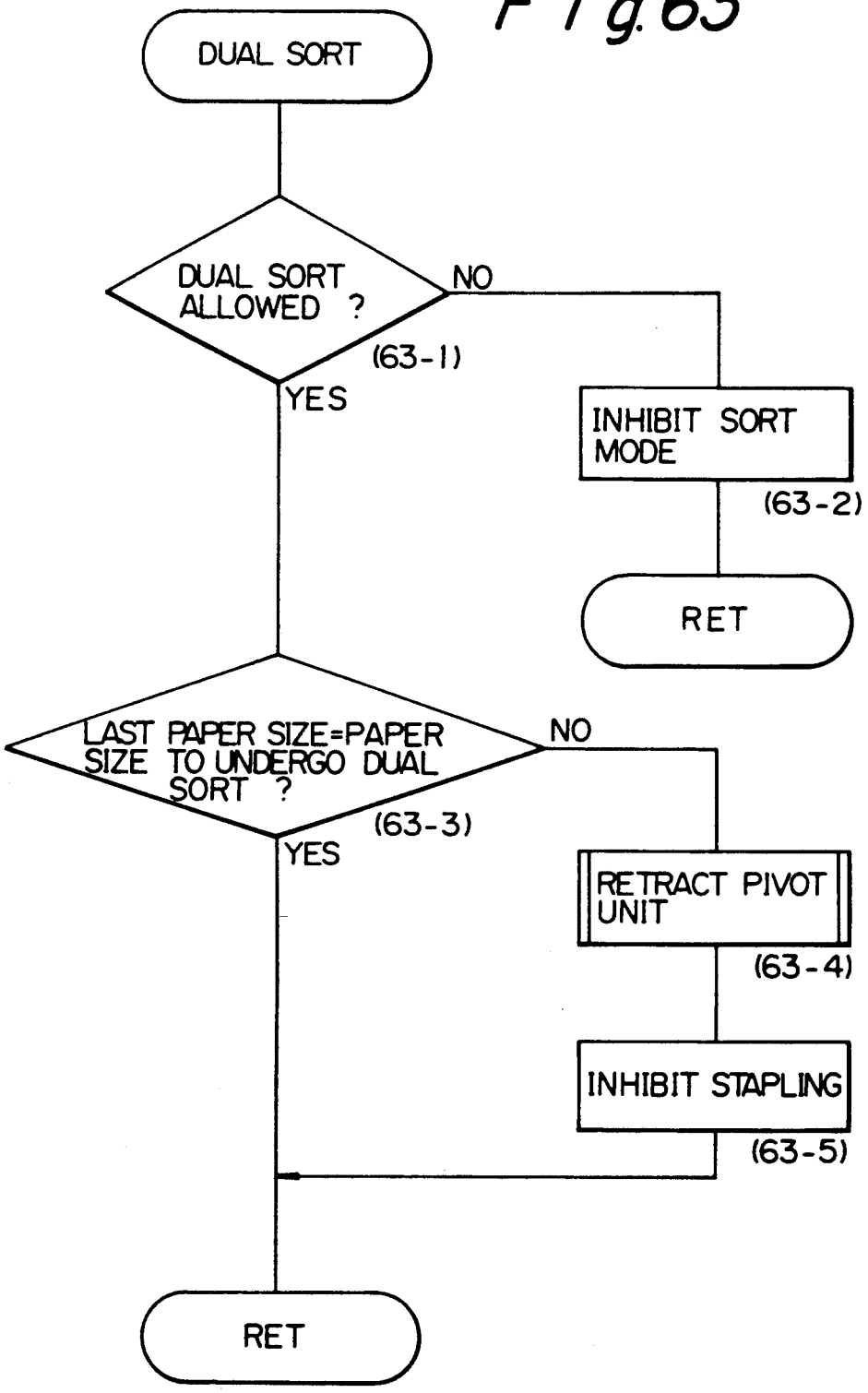
FIGS. 63 and 64 are flowcharts associated with dual sorting.

FIG. 63 indicates a subroutine for effecting the block-by-block, mode A stapling operation. Sorting copies to one block after dealing with the other block will hereinafter be referred to as dual sorting for convenience. When dual sorting is desired and if it is not allowable (step 63-1), the sort mode is inhibited (step 63-2) and an alarm is produced. If dual sorting is allowable, the paper size is sensed. If the paper size intended for dual sorting is the same as the previous paper size, the operation is continued. If the former is not the same as the latter (step 63-3), the pivoting section is retracted (step 63-4), stapling is inhibited (step 63-5), and the operation is continued.

Figure 64:
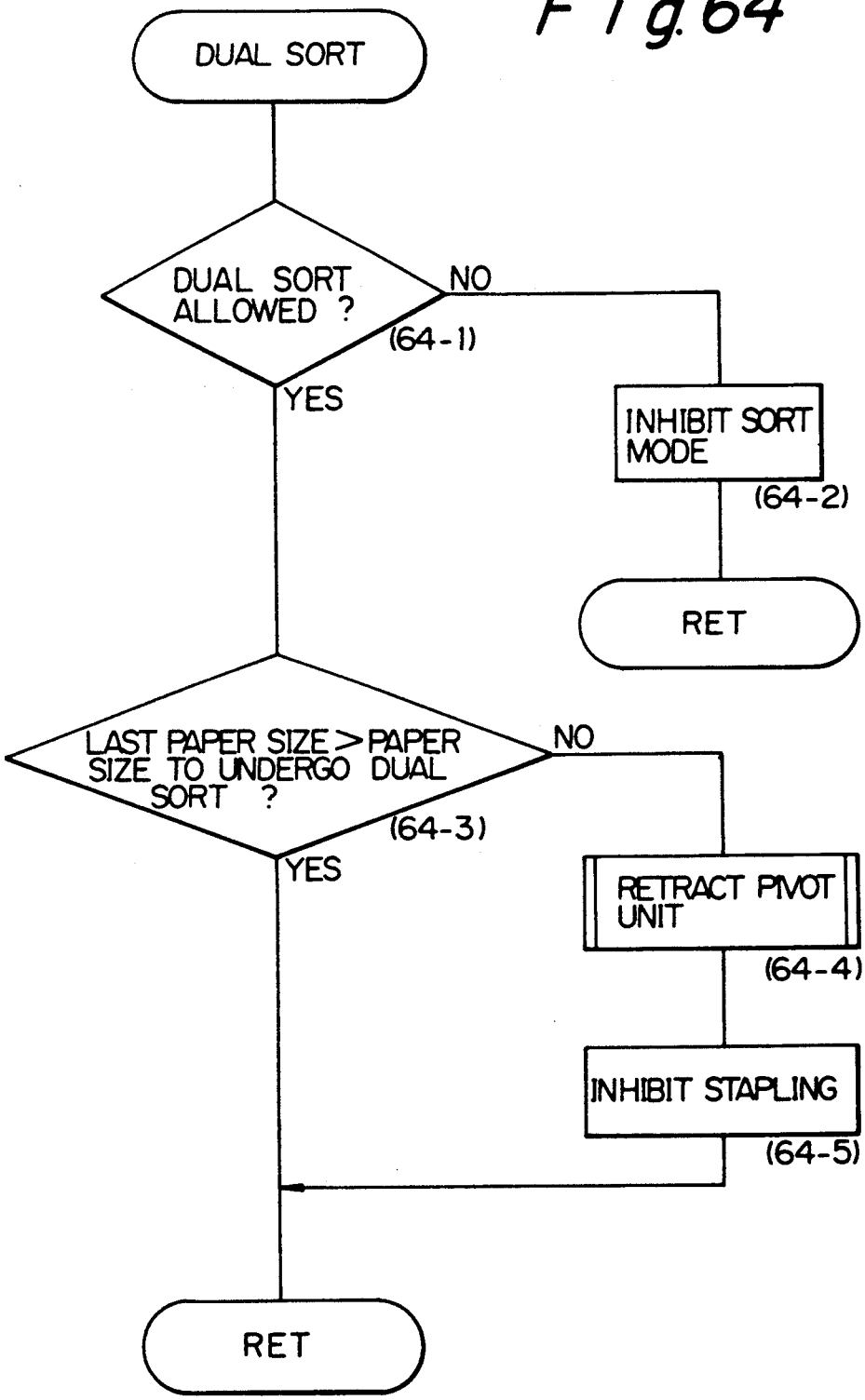

FIG. 64 shows a subroutine representative of the block-by-block, mode B processing. As shown, if dual sorting is not allowable (step 64-1), the sort mode is inhibited (step 64-2) and an alarm is produced. If dual sorting is allowable, the paper size is sensed. If the sensed paper size is equal to or greater than the previous paper size, the operation is continued. If the sensed paper size is smaller than the previous paper size (step 64-3), the pivoting section is retracted (step 64-4), stapling is inhibited (step 64-5), and the operation is continued.

While the block-by-block stapling function has been shown and described in relation to the inhibition of the stapling means 401, it is similarly applicable to the inhibition of the positioning means 502.

Figures 65, 65A:
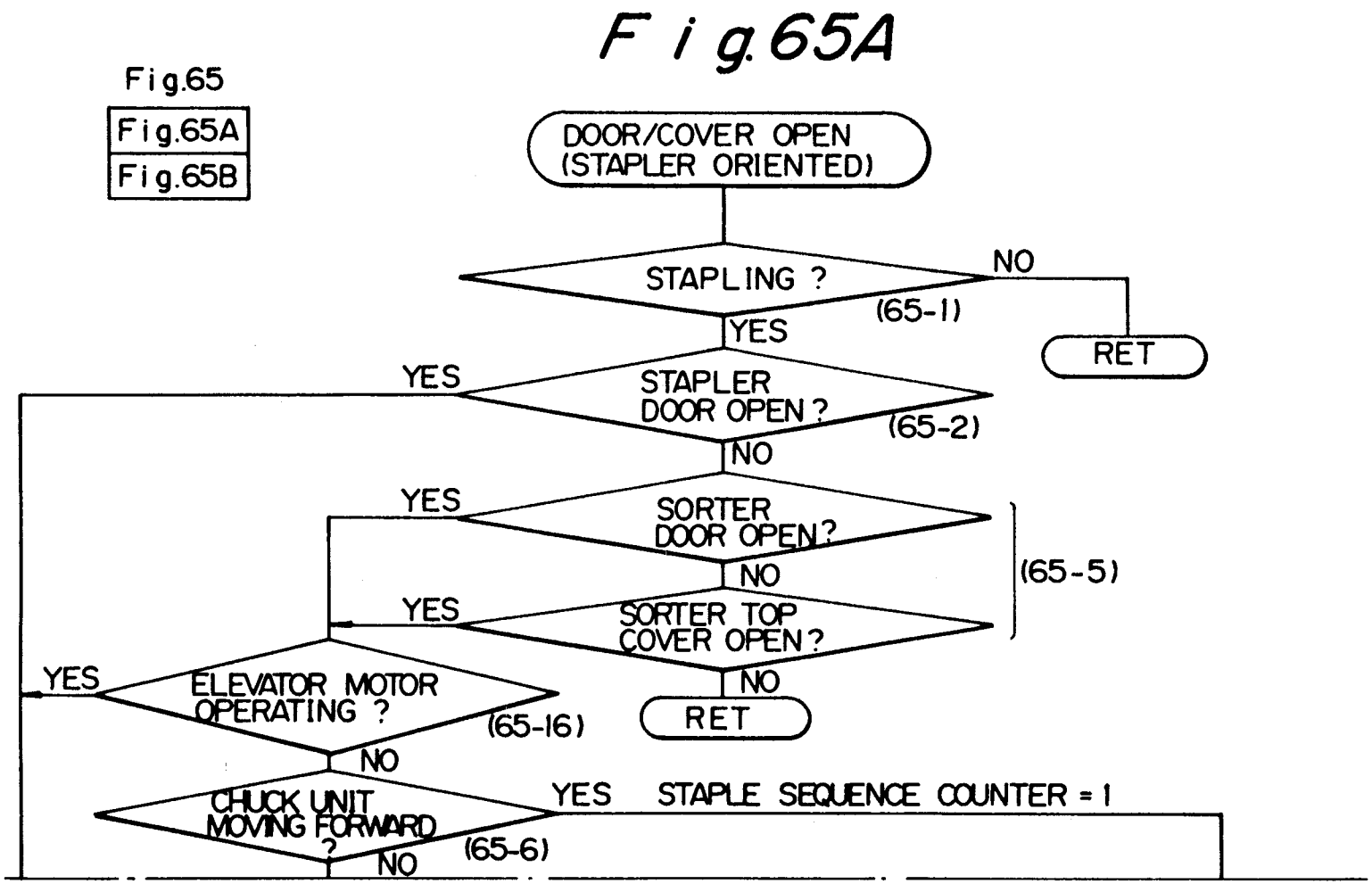
FIGS. 65A and B are a flowchart showing a procedure occurring when a door is opened while a stapling operation is under way.
Figure 65B:
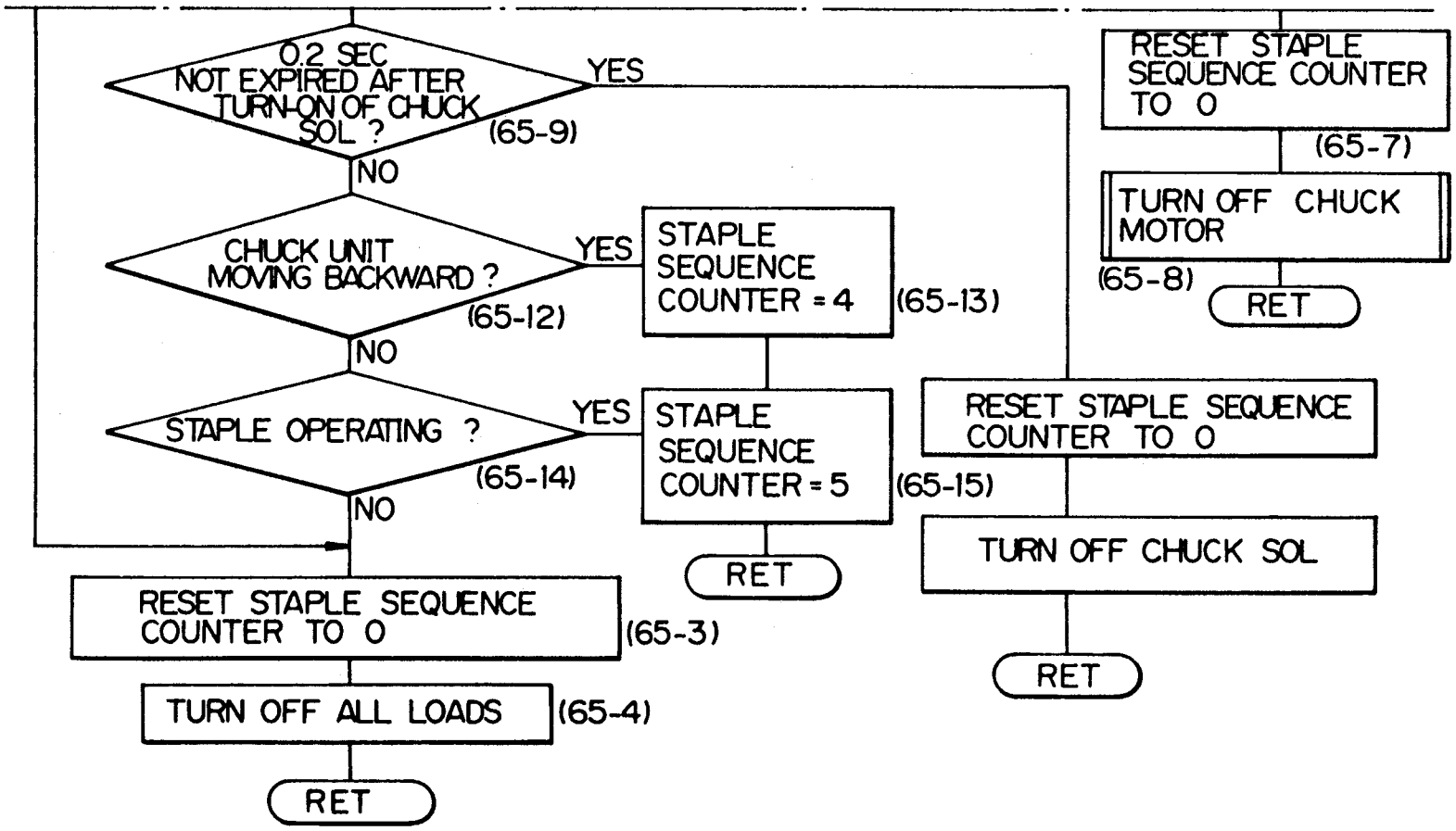

FIG. 65 shows a subroutine which is executed when a door is opened while staple processing is under way. As shown, when all the doors, i.e., a stapler door, sorter door and sorter top cover are closed, the operation is continued. When the stapler door is opened (step 65-2), the staple sequence counter is rest to 0 (step 65-3) and all the loads are turned off (step 65-4).

When either the sorter door or the sorter top cover is opened with the stapler door being closed while stapling processing is under way (hereinafter referred to as a state 1, step 65-5), the following sequence of steps are executed. Specifically, if the chuck unit is moving forward in the state 1, the staple sequence counter is reset to 0 (step 65-7) and the chuck motor is turned off (step 65-8). In the state 1, if the chuck unit has already moved forward and 0.2 second has not expired after the turn-on of the chuck SOL 431*c* (step 65-9), the staple sequence counter is reset to 0 (step 65-10) and the chuck solenoid 421*c* is turned off (step 65-11).

Assume that, in the state 1, the chuck unit has already moved forward and 0.2 second has expired after the turn-on of the chuck SOL (hereinafter referred to as a state 2). In the state 2, if the chuck unit is moving backward (step 65-12), the staple sequence counter is incremented to 4 (step 65-13) and the operation is continued. In the state 2, if the chuck unit has already moved backward and a stapling action is under way (step 65-14), the staple sequence counter is incremented to 5 (step 65-15) and the operation is continued. In the state 2, if the chuck unit has already moved backward and the stapling action has ended, the staple sequence counter is reset to 0 (step 65-3) and all the loads are turned off (step 65-4).

In the state 1, if the elevator motor 409 is operating (step 65-16), the staple sequence counter is reset to 0 and all the loads are turned off.

Figure 66:
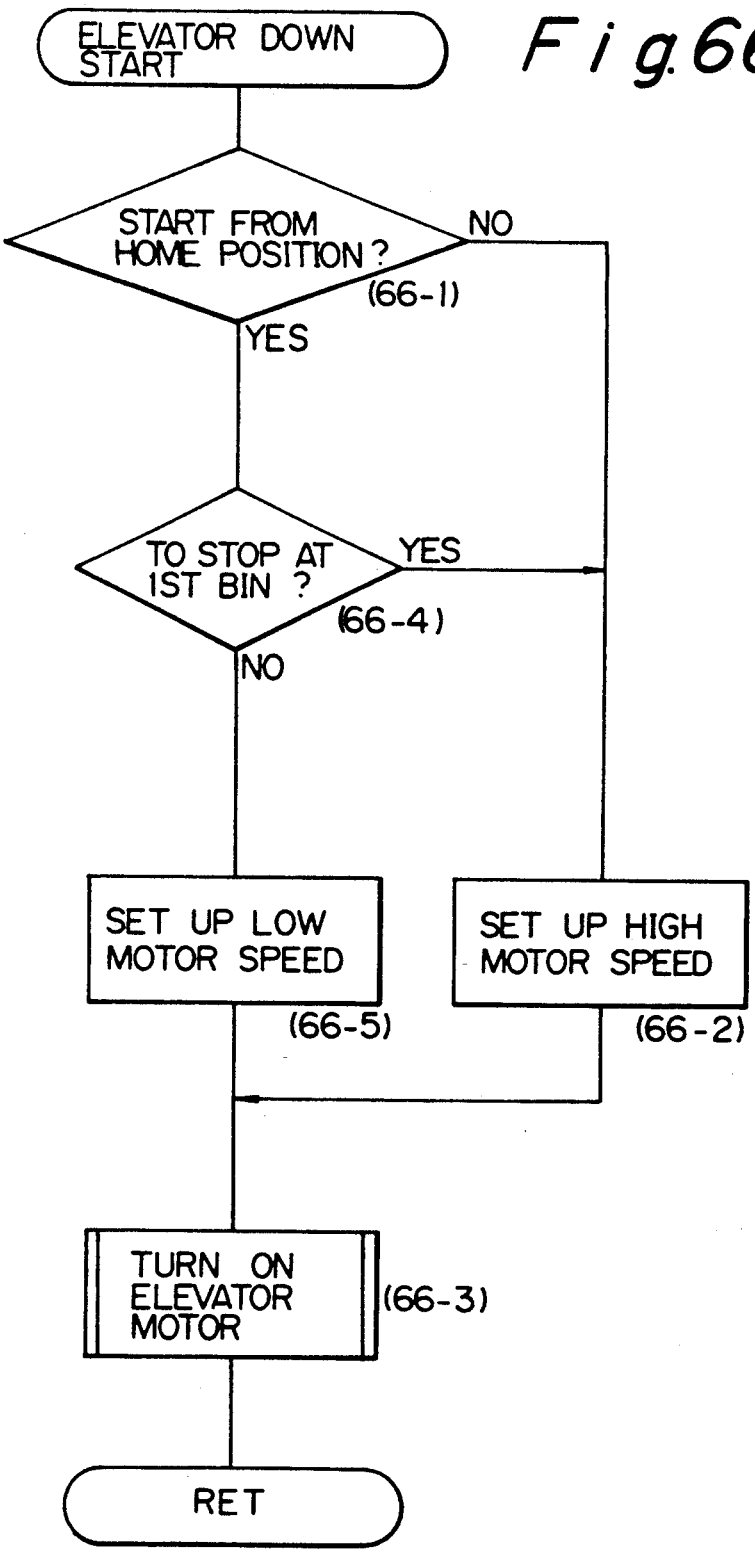
FIG. 66 is a flowchart associated with a downward movement of an elevator.

FIG. 66 shows a subroutine for varying the lowering speed of the stapler unit depending on the bin at which it starts on a stapling operation. Specifically, when the current position of the stapler unit is not the home position (step 66-1), a higher motor speed is selected (step 66-2) and the elevator motor 409 is rotated at the higher speed to lower the stapler unit (step 66-3). If the current position of the stapler unit is the home position, the lowering speed is varied depending on the bin number to be dealt with next. Specifically, when the stapler unit is to stop at the first bin (step 66-4), the higher motor speed is selected (step 66-2) and the elevator motor 409 is energized (step 66-3). If the stapler unit is to stop at the second bin or any one of the successive bins (step 66-4), a lower motor speed is selected and the elevator motor 409 is turned on (step 66-3).

A function of accelerating and decelerating the up-down movement will be described. This function is available for sequentially increasing the moving speed at the start of an up-down movement and, when a predetermined speed is reached, setting up a constant speed movement and for sequentially decreasing the moving speed from a position before a bin of interest and, when a predetermined speed is reached, setting up a constant speed movement until a stop at the bin of interest.

Figure 67A:
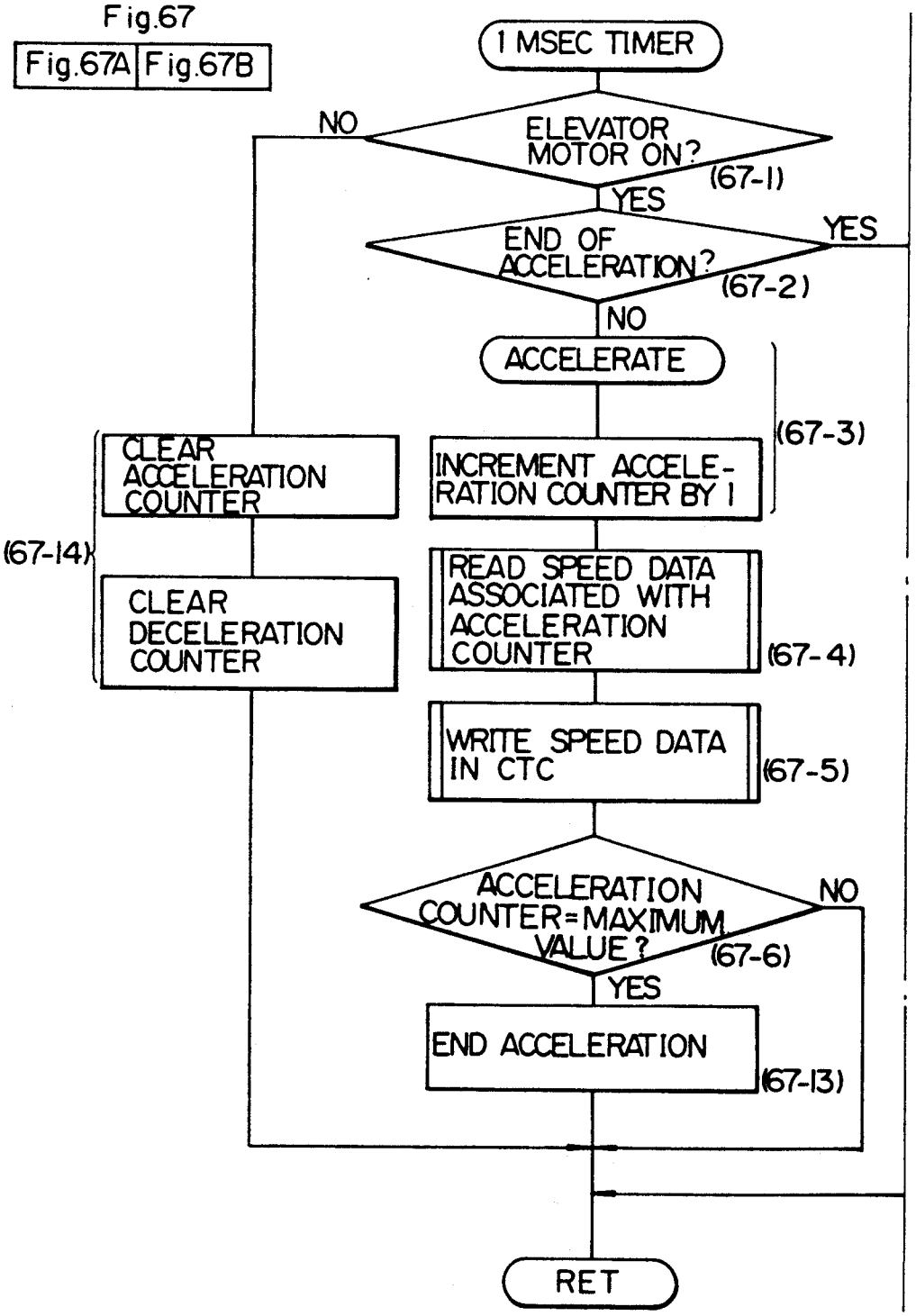
FIGS. 67A and B are a flowchart associated with up-down movements.
Figure 67B:
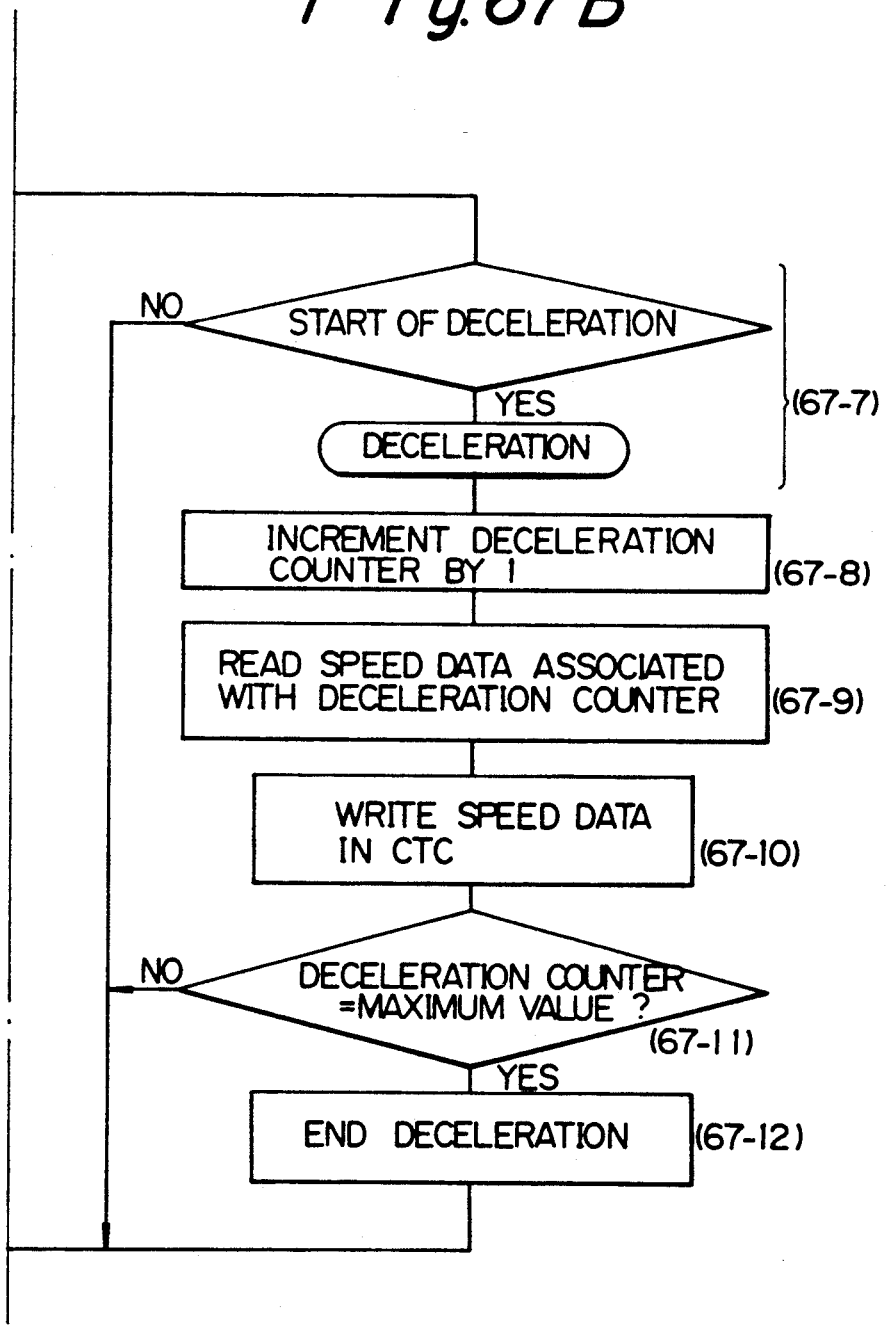

Specifically, FIG. 67 shows a subroutine which is called up every 1 millisecond for effecting the accelerating and decelerating function. As shown, after the elevator motor 409 has been turned on (step 67-1), if acceleration is not completed (step 67-2), an acceleration counter is incremented by 1 every time the subroutine is called up (step 67-3). The ROM 601 stores a group of speed data which are associated with the values of the acceleration counter. Particular speed data matching the increasing value of the acceleration counter is written in the CTC 604 (step 67-5). The CTC 604 generates a frequency associated with the speed data and feeds it to the phase signal generator 614 shown in FIG. 53. In response, the phase signal generator 614 delivers a phase signal to the constant current driver 615 so as to drive the elevator motor 409 at a speed associated with the speed data. As soon as the acceleration counter reaches a predetermined value (step 67-6), the acceleration is terminated (step 67-13) and the elevator motor 409 is rotated at a constant speed thereafter.

On the lapse of a predetermined period of time, deceleration begins (step 67-7). A deceleration counter is incremented by 1 every time the subroutine is called up (step 67-8). At this time, the ROM 601 stores a group of speed data which sequentially reduce the moving speed on the basis of he value of the deceleration counter (step 67-9). Speed data matching the value of the deceleration counter is set in the CTC 604 (step 67-10). Again, the CTC 604 generates a frequency associated with the speed data and feeds it to the phase signal generator 614. The phase signal generator 614 sends a phase signal to the constant current driver 615, whereby the elevator motor is operated at a speed associated with the speed data. When the deceleration counter reaches a predetermined value (step 67-11), the deceleration is terminated (step 67-12) and the elevator motor 409 is driven at a constant speed thereafter. When the stapler unit arrives at a bin of interest, the elevator motor 409 is turned off with the acceleration counter and deceleration counter being cleared (step 67-14).

Figure 68:
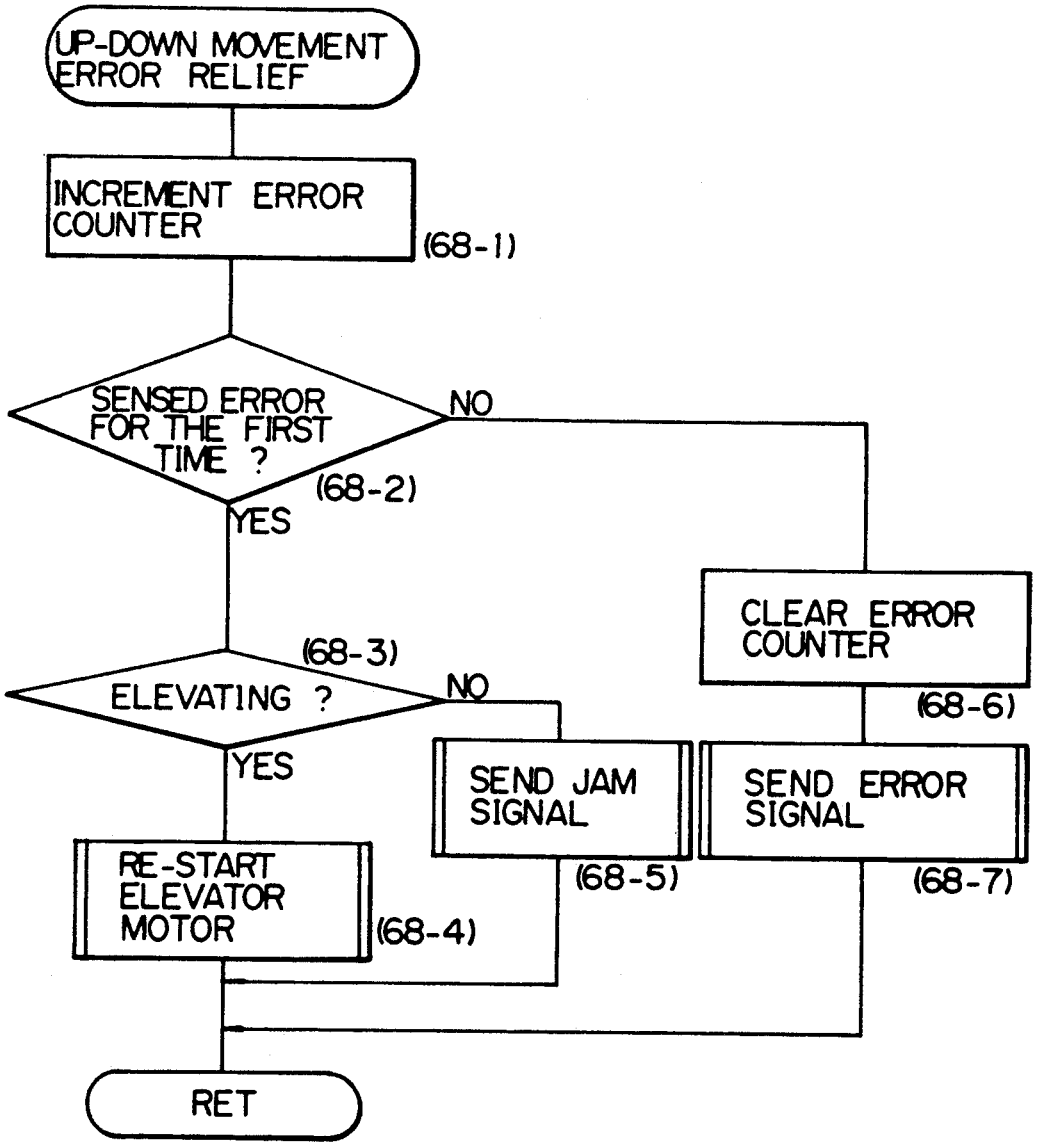
FIG. 68 is a flowchart showing an up-down movement error relief procedure.

FIG. 68 indicates an up-down movement error relief subroutine. When an error of the elevator motor 409 is detected and if that error counted (step 68-1) is the second error (step 68-2), an error signal is sent out to clear the count (step 68-6) and to produce a serviceman call (step 68-7). However, when the error is the first error (step 68-2) and if the elevator motor 409 is rotating for an upward movement (step 68-3), the motor 409 is restarted (step 68-4) to continue the operation. If the elevator motor 409 is rotating for a downward movement, a jam signal is sent out (step 68-5). More specifically, an arrangement may be made such that when an error occurs in the stapling means 401 or in the positioning means 502, a first interrupt signal for simply interrupting the discharge of paper sheets from the copier body and a second interrupt signal for interrupting the discharge and requesting an error reset signal are selectively produced. Then, the first interrupt signal will be transmitted on the first occurrence of an error, while the second interrupt signal will be transmitted on the second occurrence of an error. If desired, the first and second interrupt signals may serve as a jam signal and an error signal, respectively. It is to be noted that the errors stated above refer not only to the errors of the elevator motor 409 but also to the errors of the stapling means 401 and positioning means 502.

Referring to FIGS. 69 to 79, processing each being associated with a different error condition will be described.

Figures 69, 69A:
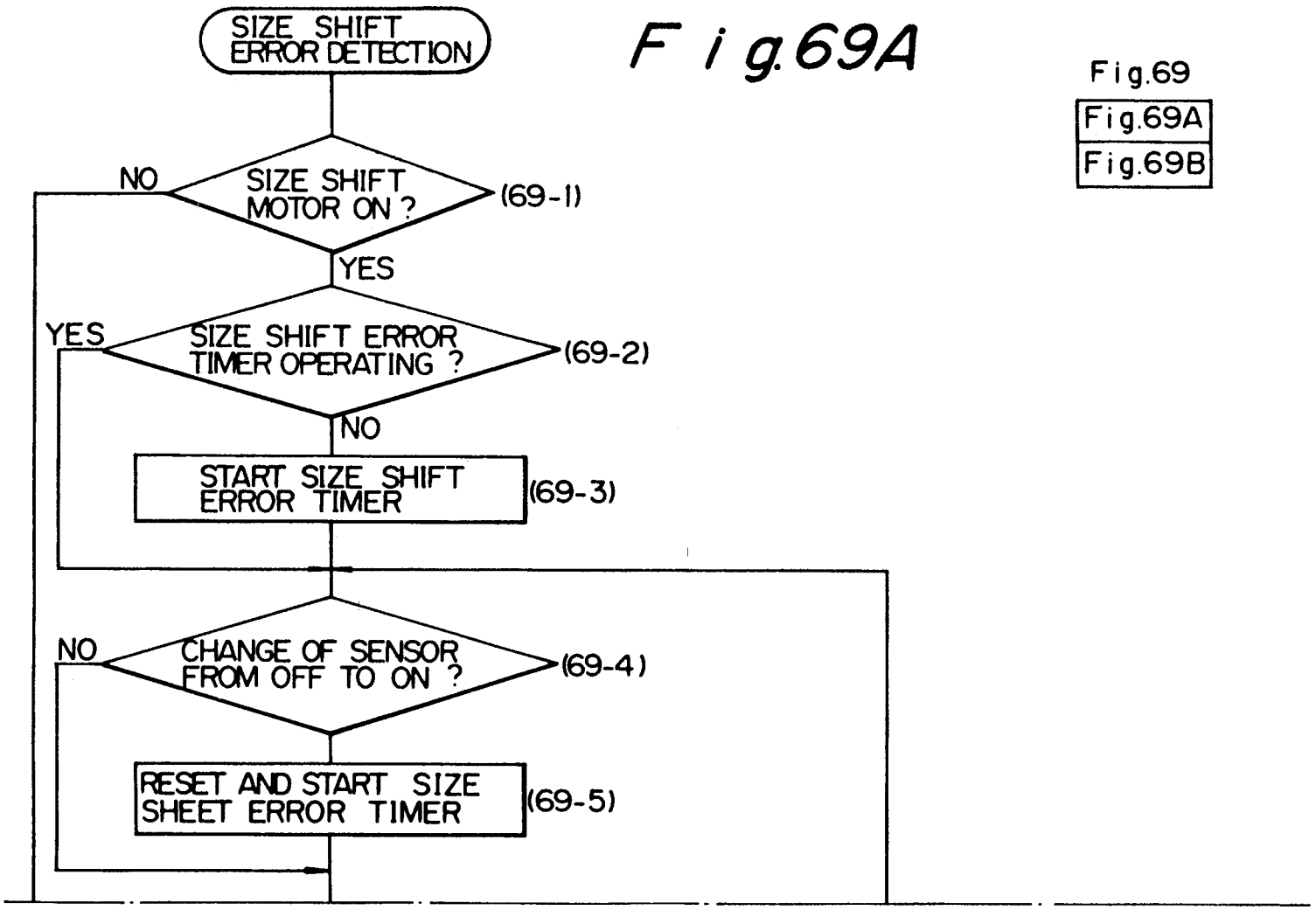
FIGS. 69A and B are a flowchart showing a size shift error relief procedure.
Figure 69B:
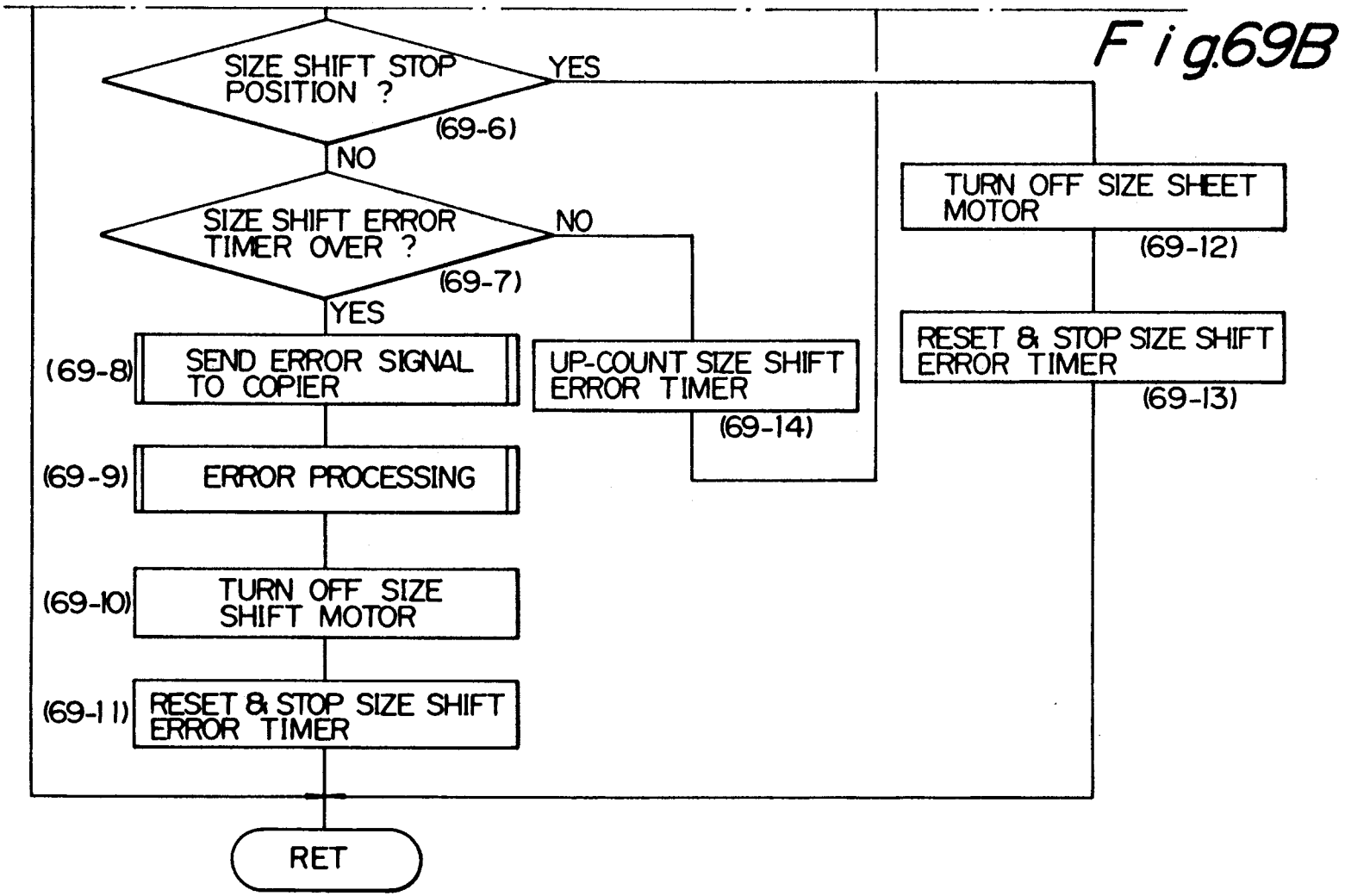

FIG. 69 indicates processing associated with size movement error detection. As shown, whether or not the size shift motor has been turned on is determined (step 69-1). If the answer of the step 69-1 is YES, whether or not a size shift error timer is operating is determined (step 69-2). If the answer of the step 69-2 is NO, it is started (step 69-3). Then, whether or not the size sensor has turned from OFF to ON is determined (step 69-4). If the answer of the step 69-2 is YES, the step 69-4 is executed by skipping the step 69-3. If the answer of the step 69-4 is YES, the size shift error timer is reset and started again (step 69-5) to see if a stop position of the size shift has been reached (step 69-6). If the answer of the step 69-6 is NO, whether or not the size shift error timer is over is determined (step 69-7). If the answer of the step 69-7 is YES, an error signal is sent to the copier (step 69-8) and a error processing subroutine is executed (step 69-9). After the step 69-9, the size shift motor is turned off (step 69-10), the size shift error timer is reset and stopped (step 69-11), and then the program returns. On the other hand, if the answer of the step 69-6 is YES, the size shift motor is turned off (step 69-12), the size shift error timer is reset and stopped (step 69-13), and then the program returns. If the answer of the step 69-7 is NO, the size shift error timer counts up (step 69-14) and the program returns to the step 69-4. If the answer of the step 69-1 is NO, the program returns immediately.

Figure 70A:
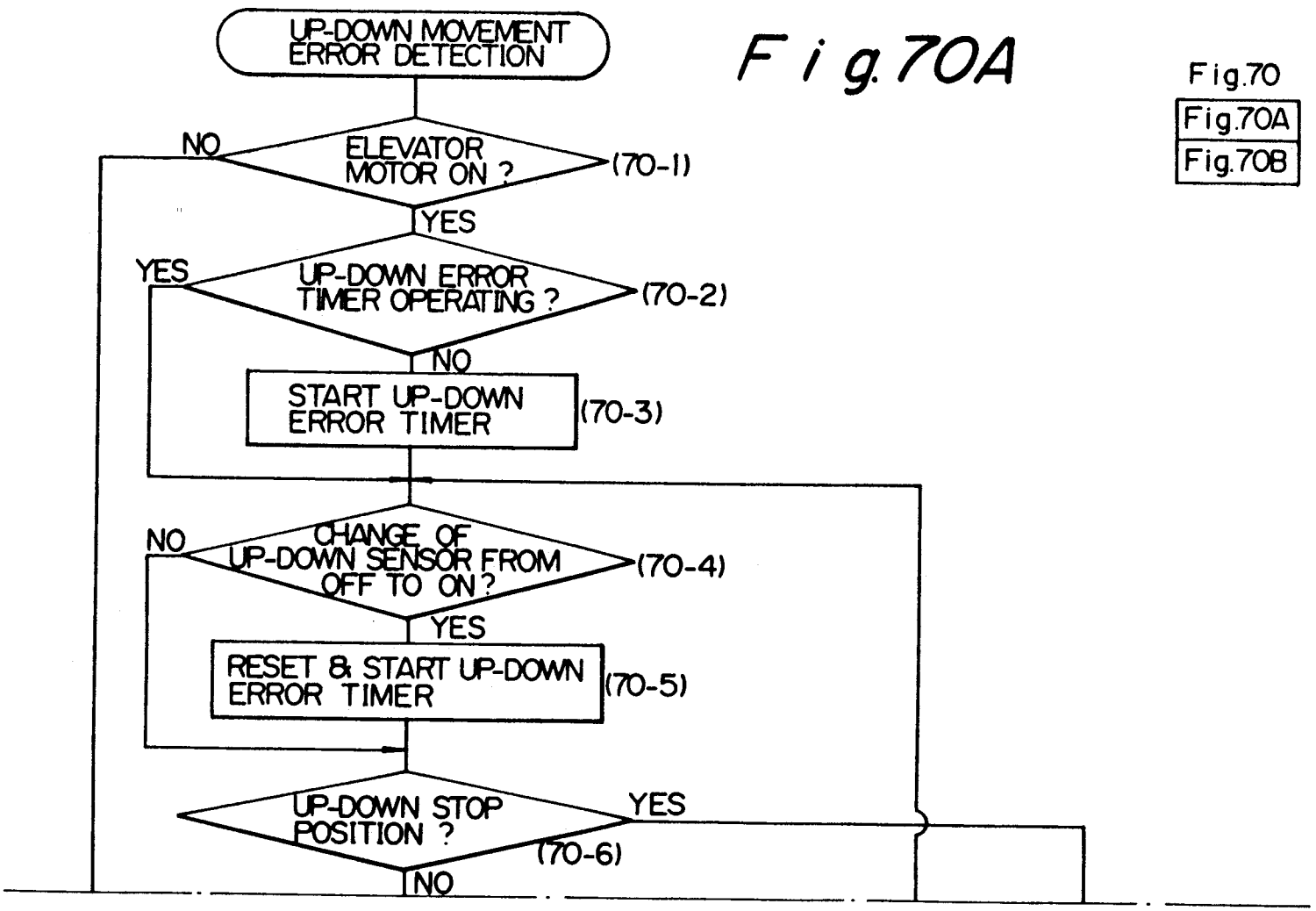
FIGS. 70A and B are a flowchart showing an up-down movement error detection procedure.
Figure 70B:
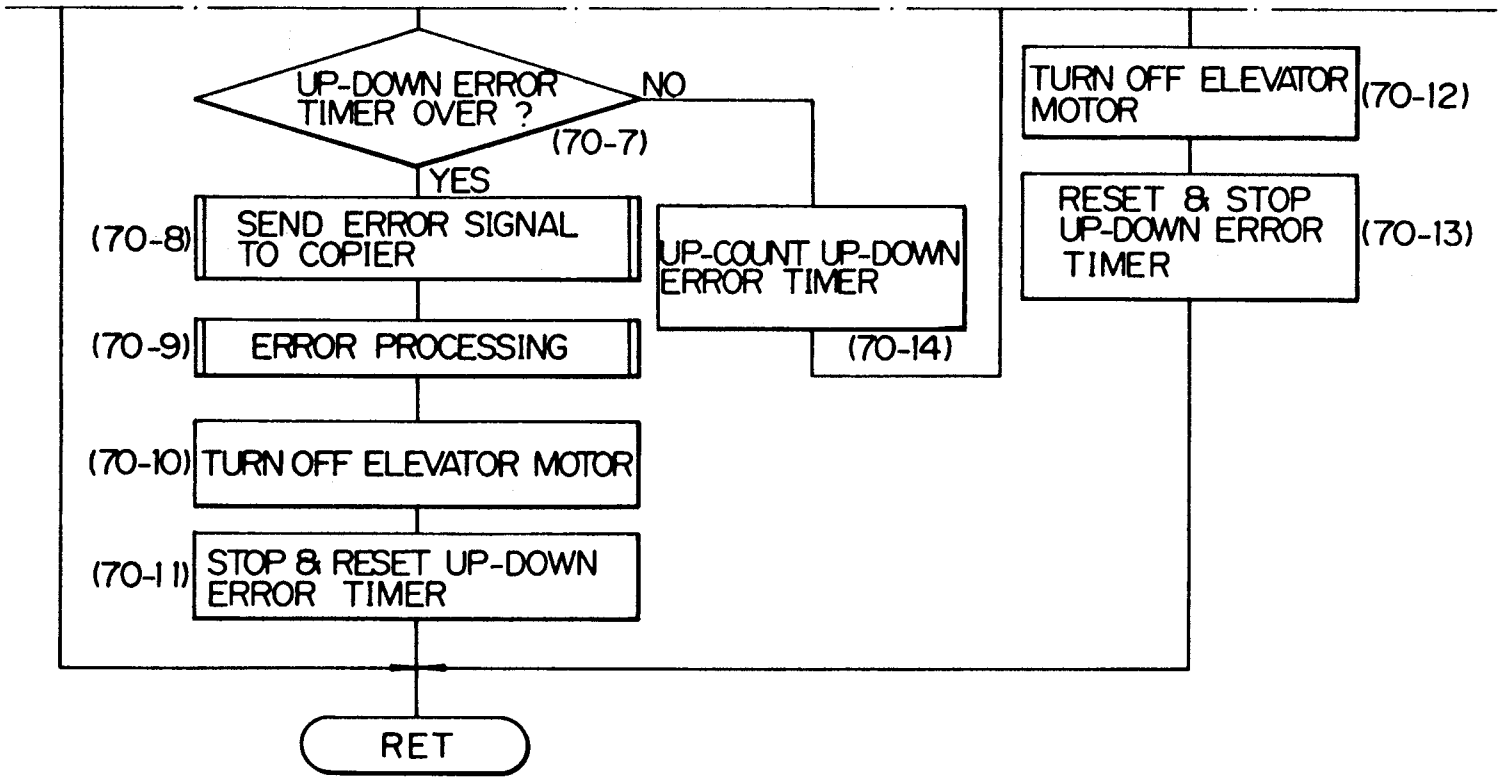

FIG. 70 is a flowchart demonstrating processing associated with up-down movement error detection. This processing begins with a step 70-1 for determining whether or not the elevator motor has turned on (step 70-1). If the answer of the step 70-1 is YES, whether or not an up-down movement error timer is operating is determined (step 70-2). If the answer of the step 70-2 is NO, it is started (step 70-3) and whether or not the up-down sensor has turned from OFF to ON is determined (step 70-4). If the answer of the step 70-2 is YES, the step 70-4 is effected by skipping the step 70-3.

When the up-down sensor has turned from OFF to ON as determined in the step 70-4, the up-down movement error timer is reset and the started again (step 70-5). Subsequently, whether or not the stapler unit has reached a stop position is determined (step 70-6). If the answer of the step 70-6 is NO, whether or not the up-down movement error timer is over is determined (step 70-7). If the answer of the step 70-7 is YES, an error signal is set to the copier (step 70-8) and an error processing subroutine is executed (step 70-9). After the step 70-9, the elevator motor is deenergized (step 70-10), the up-down movement error timer is stopped and reset, and then the program returns. If the answer of the step 70-6 is YES, the elevator motor is turned off (step 70-12), the up-down movement error timer is reset and stopped (step 70-13), and then the program returns. If the answer of the step 70-7 is NO, the up-down movement error timer up-counts (step 70-14) and the program returns to the step 70-4. If the answer of the step 70-1 is NO, the program directly returns.

Figures 71, 71A, 71B:
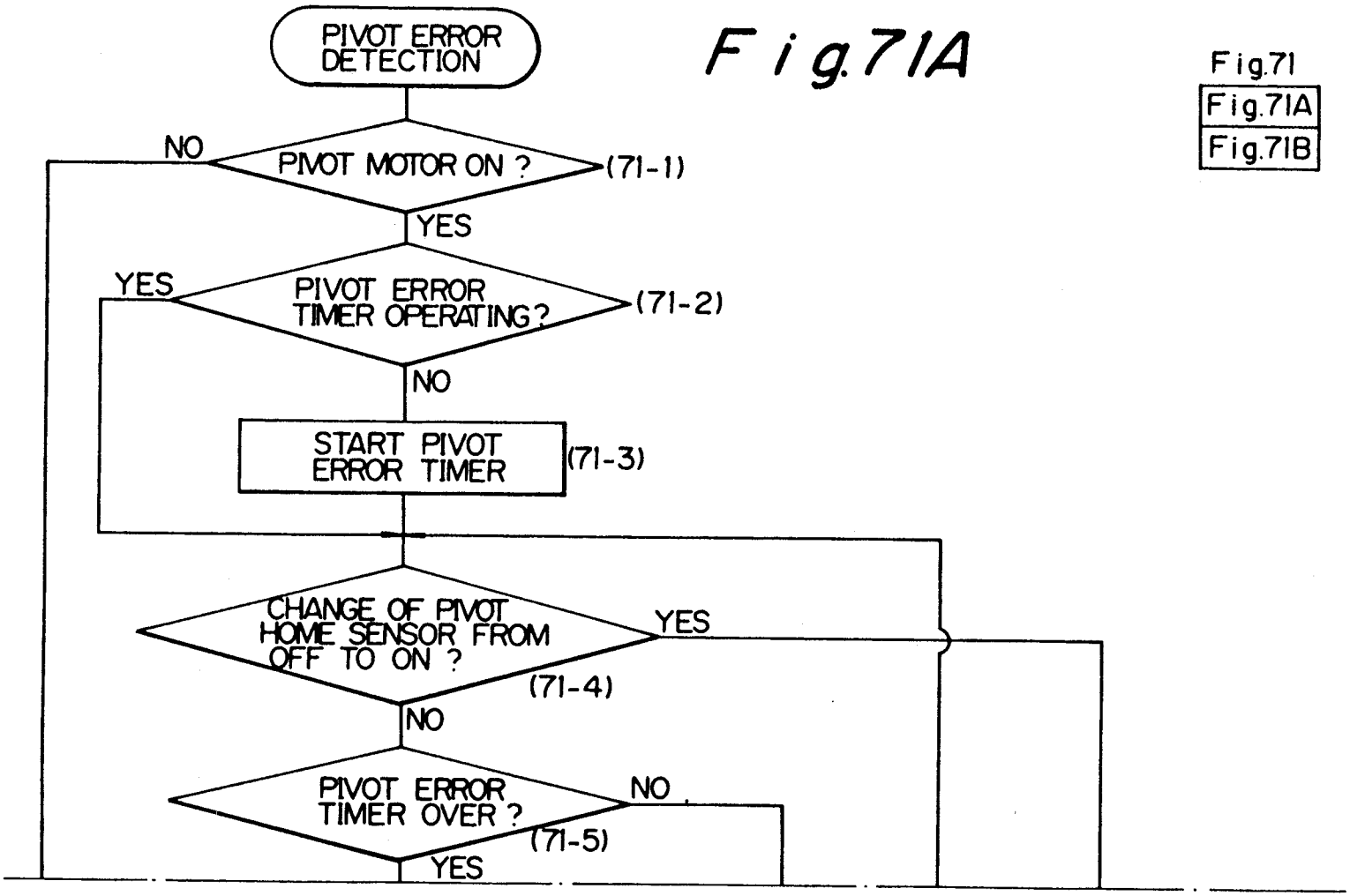
FIGS. 71A and B are a flowchart showing a pivot error detection procedure.
Figure 71B:
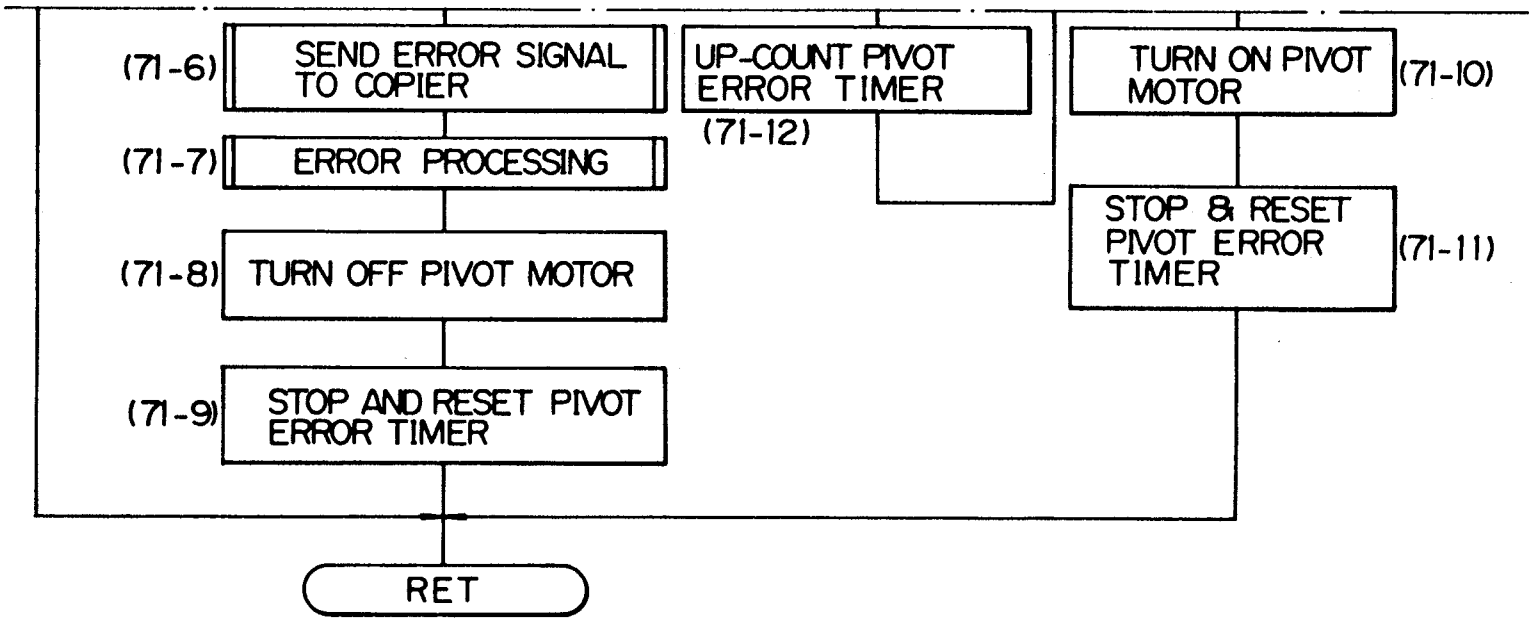

FIG. 71 is a flowchart demonstrating pivot error detection. As shown, whether or not the pivot motor has been turned on is determined (step 71-1) and, if it has been turned on, whether or not a pivot error timer is operating is determined (step 71-2). If the answer of the step 71-2 is NO, the pivot error timer is started (step 1-3) and whether or not a pivot home sensor has turned from OFF to ON is determined (step 71-4). If the answer of the step 71-2 is YES, the 71-4 is executed by skipping the step 71-3. If the answer of the step 71-4 is NO, whether or not the pivot error timer is over is determined (step 71-5). If the answer of the step 71-5 is YES, an error signal is sent to the copier (step 71-6) and an error processing subroutine is executed (step 71-7). After the step 71-7, the pivot motor is deenergized (step 71-8), the pivot error timer is stopped and reset (step 71-9), and then the program returns. If the answer of the step 71-4 is YES, the pivot motor is deenergized (step 71-10), the pivot error timer is stopped and reset (step 71-11), and then the program returns. If the answer of the step 71-5 is NO, the pivot error timer up-counts (step 71-12) and the program returns to the step 71-4. If the answer of the step 71-1 is NO, the program directly returns.

Figures 72, 72A:
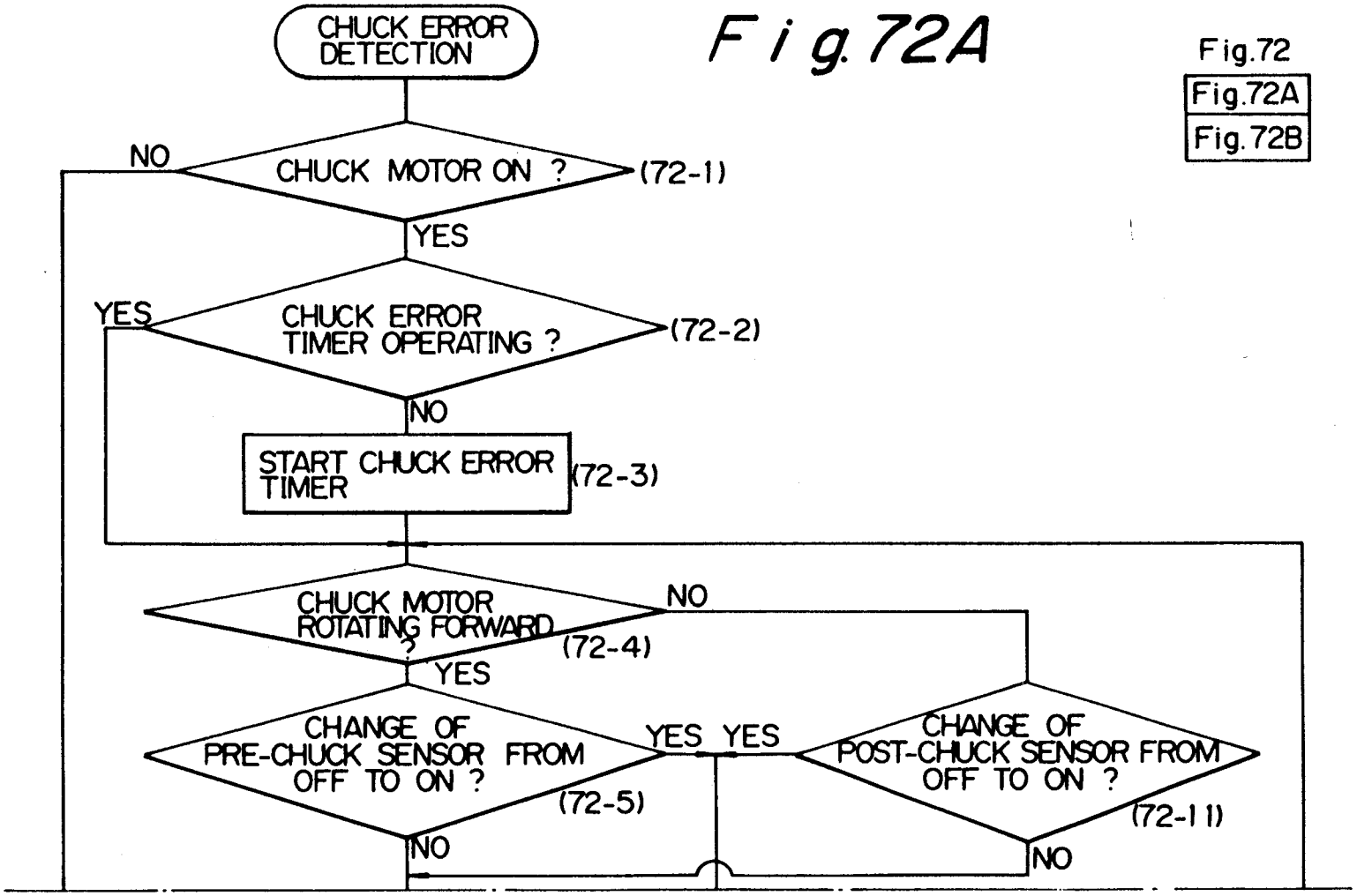
FIGS. 72A and B are a flowchart showing a chuck error detection procedure.
Figure 72B:
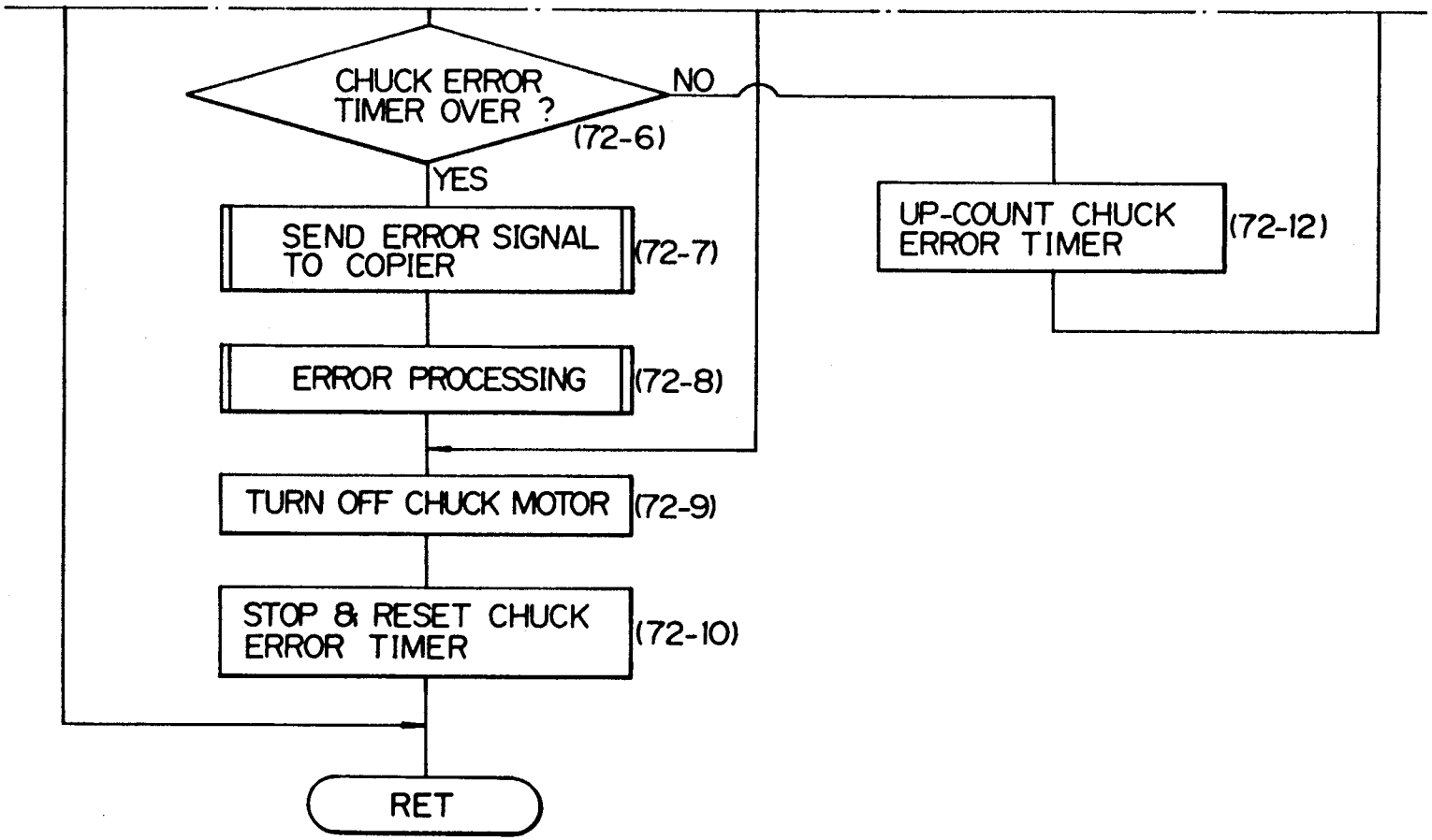

FIG. 72 indicates a chuck error detection procedure. This procedure begins with a step 72-1 for determining whether or not the chuck motor has been turned on. If the answer of the step 72-1 is YES, whether or not a chuck error timer is operating is determined (step 72-2). If the answer of the step 72-2 is NO, the chuck error timer is started (step 72-3) and whether or not the chuck motor is rotating forward is determined (step 72-4). If the answer of the step 72-2 is YES, the step 72-4 is executed by skipping the step 72-3. If the answer of the step 72-4 is YES, meaning that the chuck is moving forward, a step 72-5 is executed to see if the pre-chuck sensor has turned from OFF to ON. If the answer of the step 72-5 is NO, whether or not a chuck error timer is over is determined (step 72-6). If the answer of the step 72-6 is YES, an error signal is sent to the copier (step 72-7) and an error processing subroutine is executed (step 72-8). After the step 72-8, the chuck motor is turned off (step 72-9), the chuck error timer is stopped and reset (step 71-10), and then the program returns. If the answer of the step 72-4 is NO, meaning that the chuck is moving backward, whether or not the post-chuck sensor has turned from OFF to ON is determined (step 72-11). If the answer of the step 72-11 is NO, the step 72-6 and successive steps are executed. If the answer of the step 72-5 or that of the step 72-11 is YES, meaning that the chuck is moving forward or backward, the step 72-9 is executed because no errors exist. If the answer of the step 72-6 is NO, the chuck error timer up-counts (step 72-12) and the program returns to the step 72-4. If the answer of the step 72-1 is NO, the program directly returns.

Figures 73, 73A:
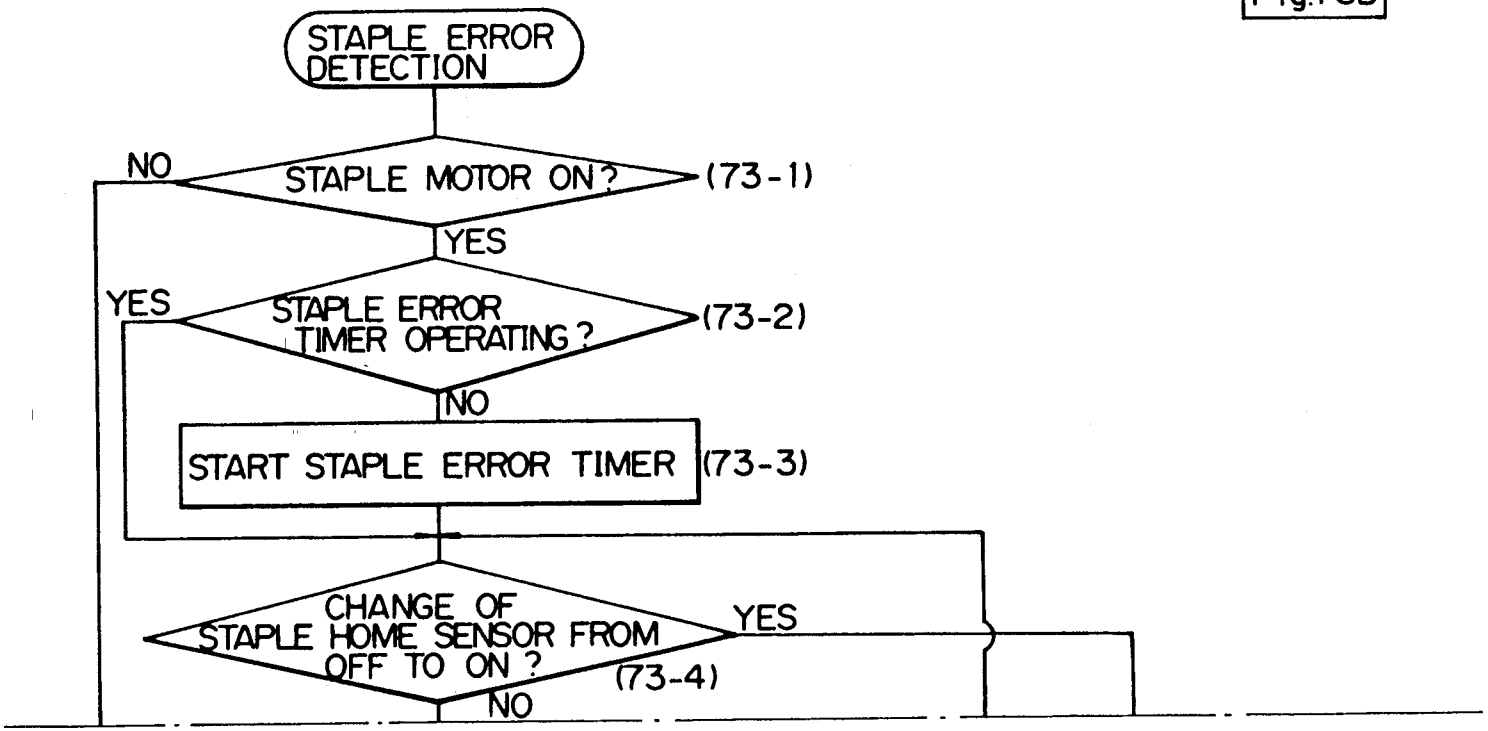
FIGS. 73A and B are a flowchart showing a staple error detection procedure.
Figure 73B:
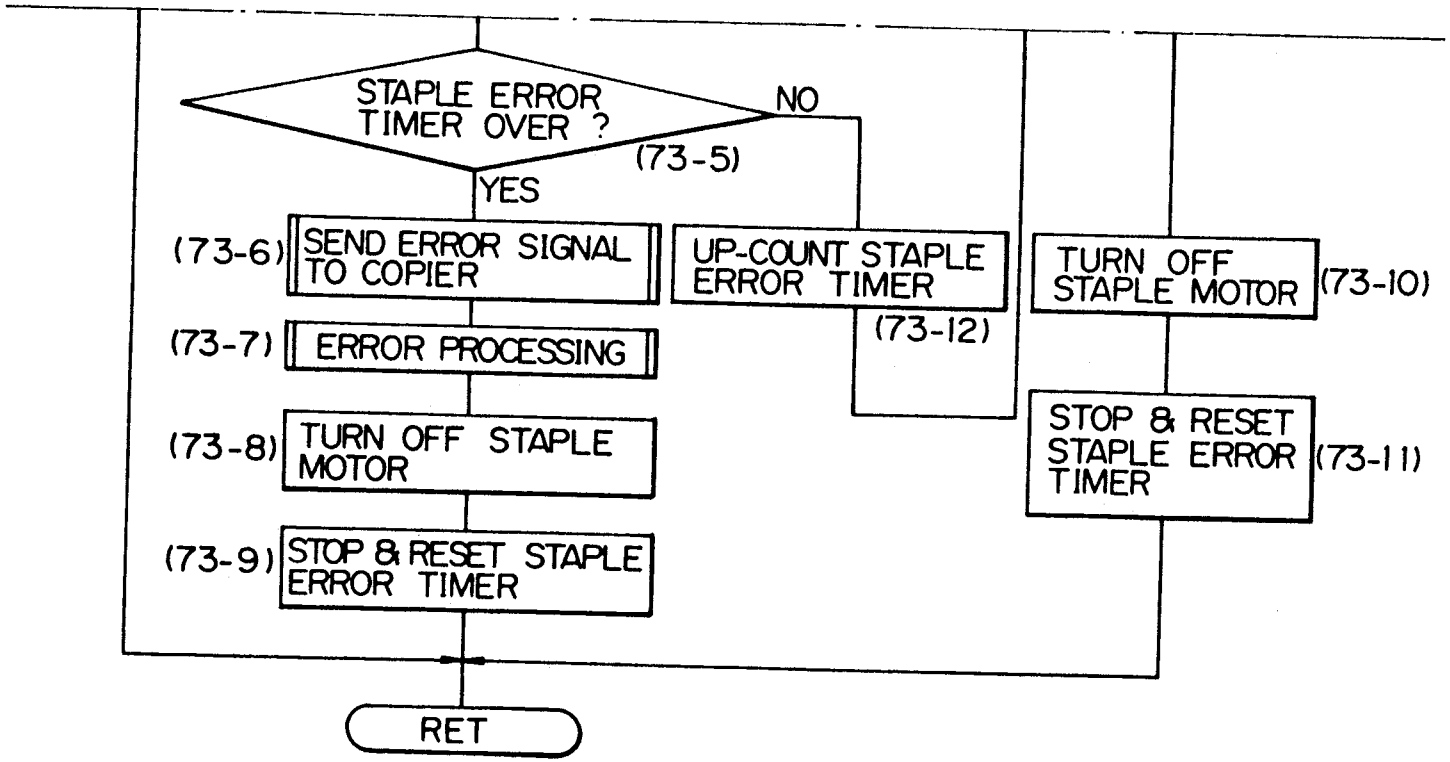

FIG. 73 is a flowchart showing a staple error detection procedure. As shown, whether or not the staple motor has been turned on is determined (step 73-1) and, if it has been turned off, whether or not a staple error timer is operating is determined (step 73-2). If the answer of the step 73-2 is NO, the staple error timer is started (step 73-3) and whether or not the staple home sensor has turned from OFF to ON is determined (step 73-4). If the answer of the step 73-2 is YES, the step 73-4 is executed by skipping the step 73-3. If the answer of the step 73-4 is NO, whether or not a staple error timer is over is determined (step 73-5). If the answer of this step 73-5 is YES, an error signal is sent to the copier (step 73-6) and an error processing subroutine is executed (step 73-7). After the step 73-7, the staple motor is turned off (step 73-8), the staple error timer is stopped and reset (step 73-9), and then the program returns. On the other hand, if the answer of the step 73-4 is YES, the staple motor is turned off (step 73-10), the staple error timer is stopped and reset (step 73-11), and then the program returns. If the answer of the step 73-5 is NO, the staple error counter up-counts (step 73-12) and the program returns to the step 73-4. If the answer of the step 73-1 is NO, the program directly returns.

Figures 74, 74A:
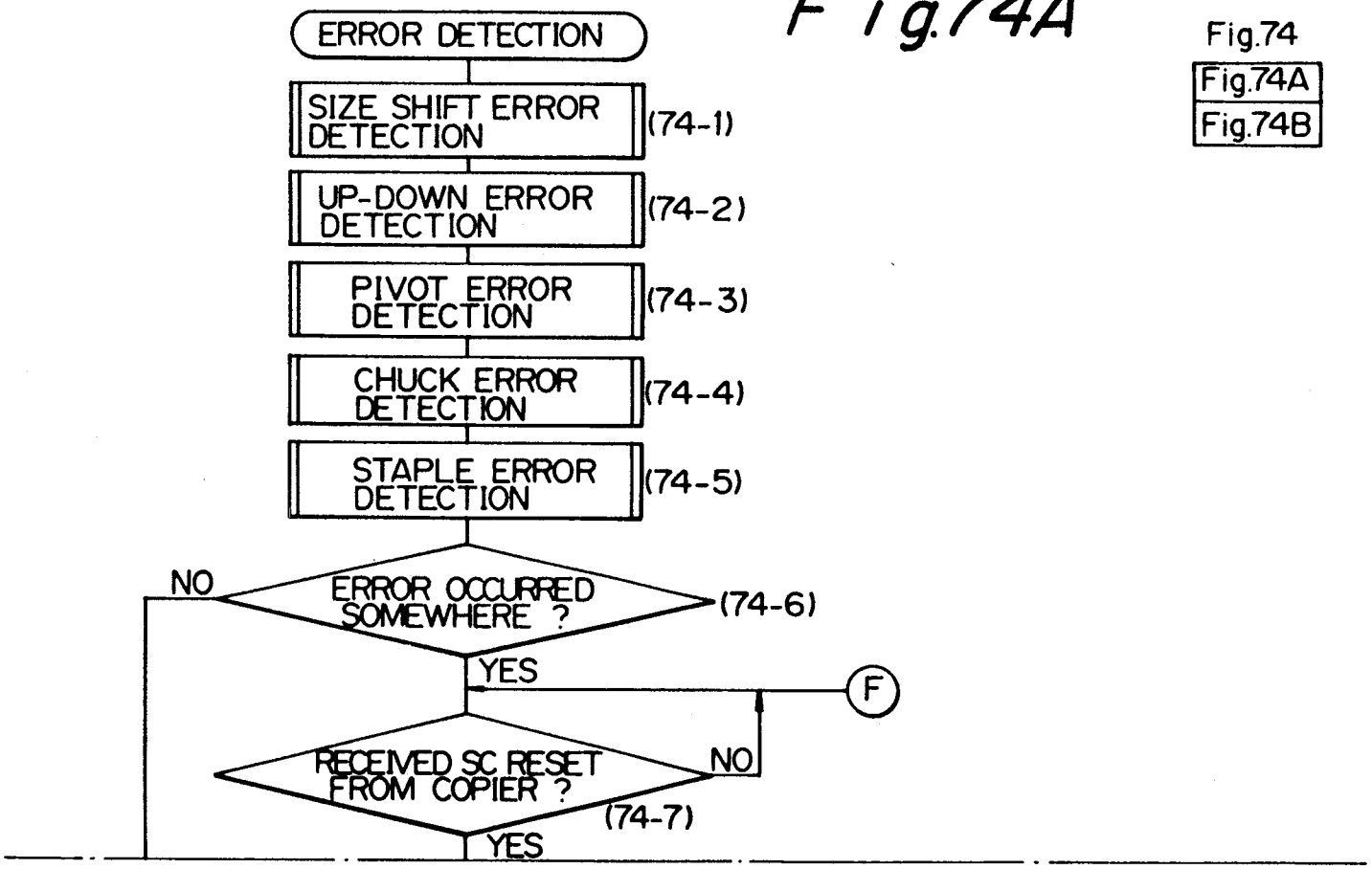
FIGS. 74A and B are a flowchart showing the general error detection processing.
Figure 74B:
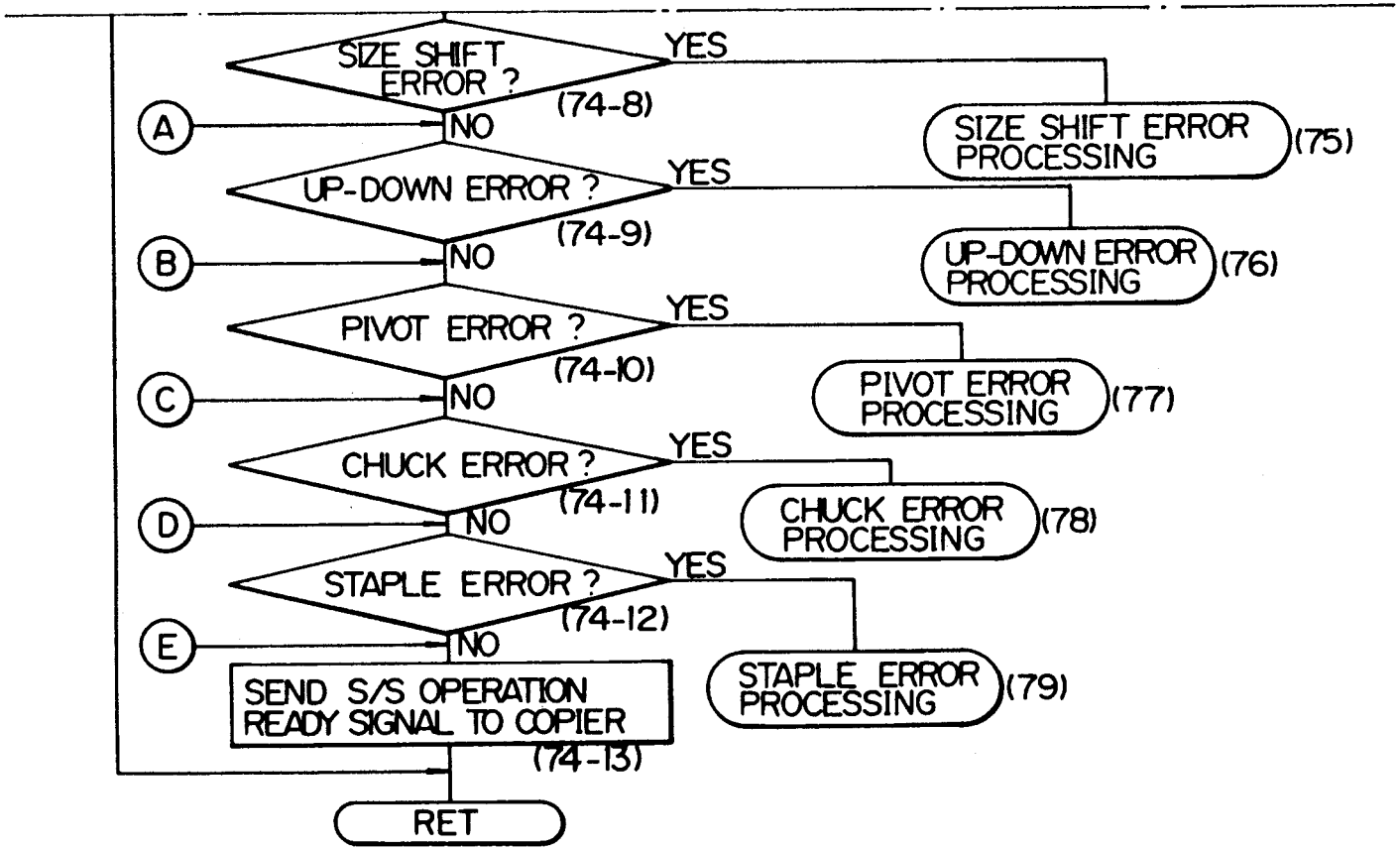

FIG. 74 shows a general procedure for detecting errors as described above. First, there are executed the size error detection subroutine (step 74-1 (processing shown in FIG. 69)), up-down movement error detection subroutine (step 74-2 (processing shown in FIG. 70)), pivot error detection subroutine (step 74-3 (processing shown in FIG. 71)), chuck error detection subroutine (step 74-4 (processing shown in FIG. 72)), and staple error detection subroutine (step 75-5 (processing shown in FIG. 73)). Then, where an error has occurred is determined (step 74-6). If no errors exist, the program of course returns. If any error exists, whether or not a serviceman call (SC) reset signal corresponding to a system reset signal has been received from the copier body is determined (step 74-7). If the answer of the step 74-4 is NO, the program waits until resetting occurs and, on the occurrence of resetting, locates the error.

Specifically, in the illustrative embodiment, whether or not the error is a size shift error is determined (step 74-8). If the answer of the step 74-8 is YES, a size error processing shown in FIG. 75 (step 75) is executed; if otherwise, whether or not the error is an up-down movement error is determined (step 74-9). If the answer of the step 74-9 is YES, up-down movement error processing shown in FIG. 76 (step 76) is executed; if otherwise, whether the error is a pivot error is determined (step 74-10). If the answer of the step 74-10 is YES, a pivot error processing shown in FIG. 77 (step 77) is executed; if otherwise, whether or not the error is a chuck error is determined (step 74-11). If the answer of the step 74-11 is YES, a chuck error processing shown in FIG. 78 (step 78) is executed; if otherwise, whether or not the error is a staple error is determined (step 74-12). If the answer of the step 74-12 is YES, a staple error processing shown in FIG. 79 (step 79) is executed; if otherwise, a sorter/stapler ready signal is sent to the copier (step 74-13) and the program returns.

Figure 75:
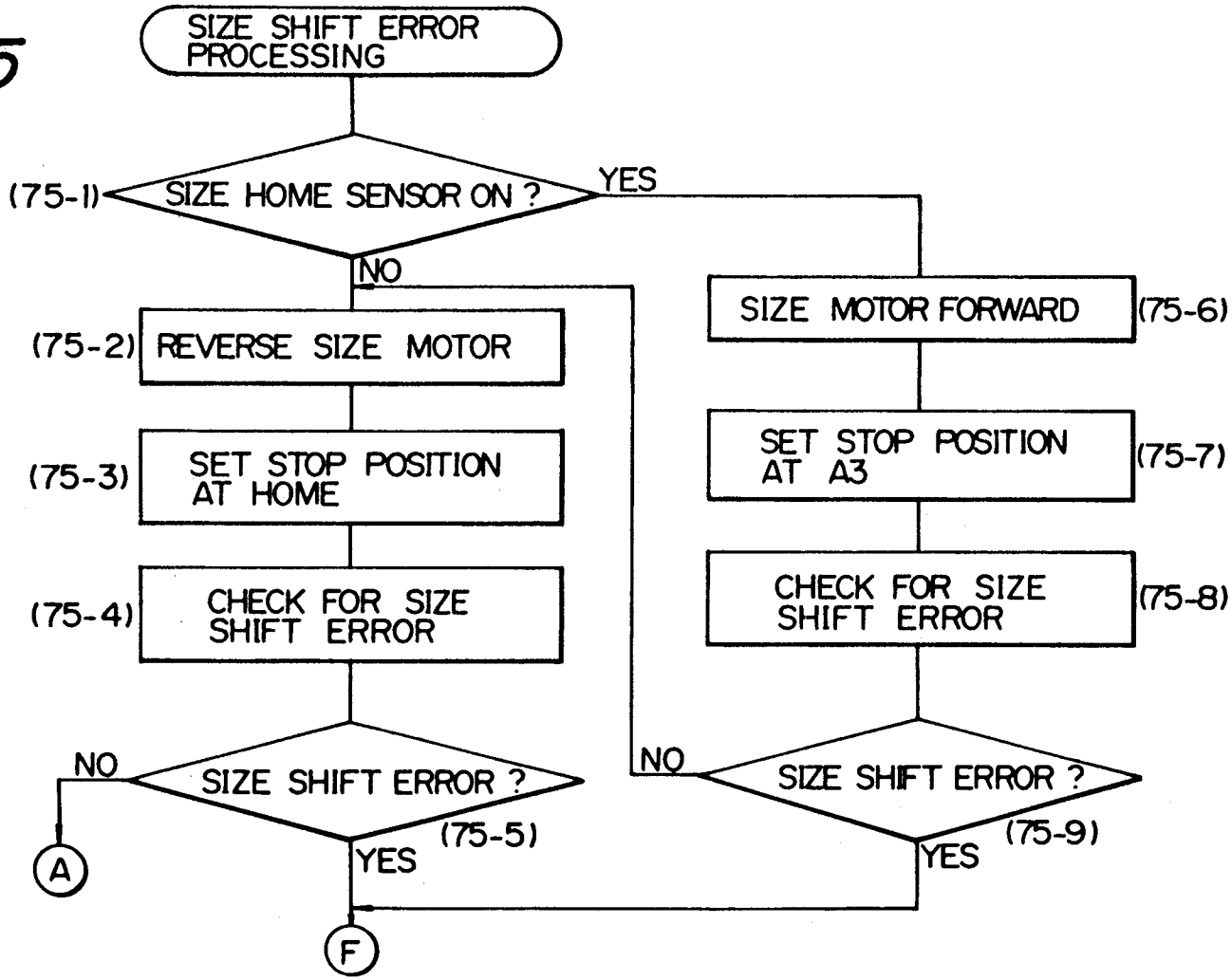
FIG. 75 is a flowchart showing size shift error processing.

In the size shift error processing shown in FIG. 75, i.e., step 75, whether or not the size home sensor has been turned on is determined (step 75-1). If the answer of the step 75-1 is NO, meaning that the pivoting unit is not in the home position, the size motor is reversed (step 75-2), the pivoting unit is stopped at the home position (step 75-3), and then the size shift error detecting procedure is executed (step 75-4). After the step 75-4, whether or not a size shift error exists is again determined in a step 75-5. If the answer of the step 75-5 is NO, meaning that the size shift error has been removed, the program jumps to the step 74-9 as indicated by letter A; if otherwise, the program jumps to the step 74-7 as indicated by letter F. If the answer of the step 75-1 is YES, the size motor is rotated forward (step 75-6), the pivoting unit is stopped at a position A3, for example (step 75-5), and then the size shift error detecting processing is executed (step 75-8). In a step 75-9, whether or not a size shift error exists is determined again. If the answer of the step 75-9 is NO, the size motor is reversed (step 75-2); if otherwise, the program jumps to the step 74-7 as indicated by letter F.

Figure 76:
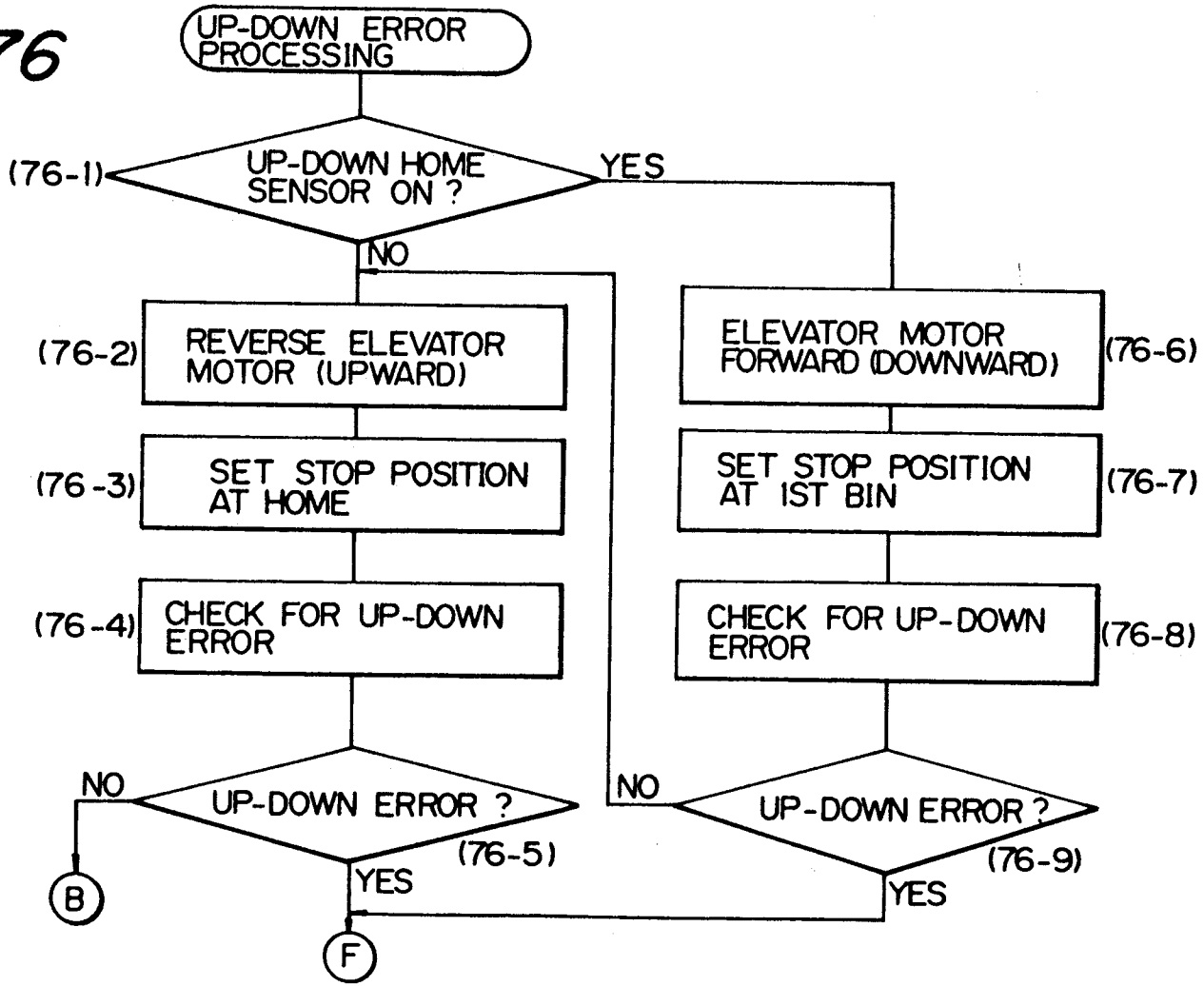
FIG. 76 is a flowchart showing an up-down movement error processing.

In the up-down movement error processing shown in FIG. 76, i.e., step 76, whether or not the up-down home sensor has been turned on is determined (step 76-1). If the answer of the step 76-1 is NO, meaning that the stapler unit is not in the home position, the elevator motor is reversed to raise the stapler unit (step 76-2), the stapler unit is stopped at the home position (step 76-3), and then the up-down movement error detection is executed (step 76-4). After the step 76-4, a step 76-5 is executed to see if an up-down movement error exists. If the answer of the step 76-5 is NO, meaning that the up-down movement error has been removed, the program jumps to the step 74-10 as indicated by letter B; if otherwise, it jumps to the step 74-7 as indicated by letter F. On the other hand, if the step 76-1 is YES, the elevator motor is rotated forward to lower the stapler unit (step 76-6), the stapler unit is stopped at the first bin, for example (step 76-7), and then the up-down movement error detection is executed (step 76-8). Whether or not an up-down movement error exists is again determined in a step 76-9. If the answer of the step 76-9 is NO, the elevator motor is reversed (step 76-2) and the successive steps are executed; if otherwise, the step 74-7 and successive steps are executed as indicated by letter F.

Figure 77:
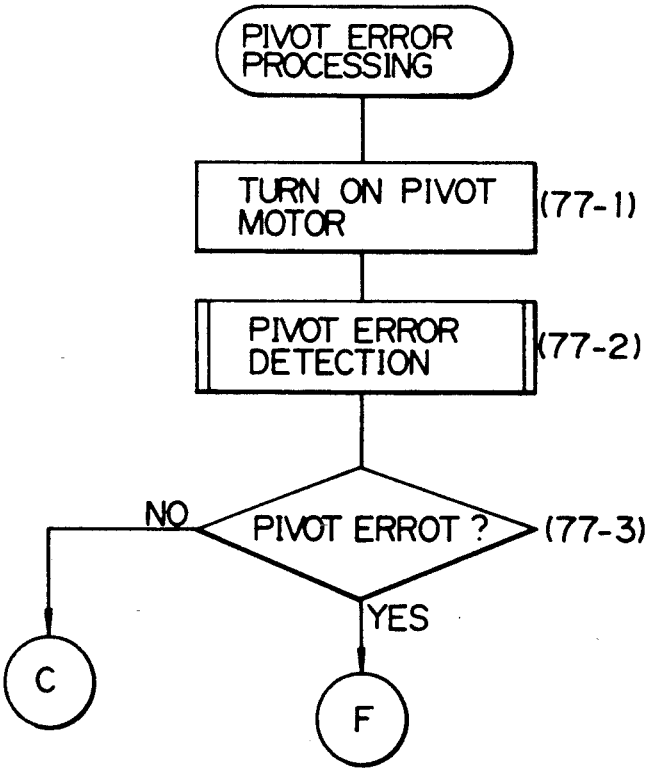
FIG. 77 is a flowchart showing pivot error processing.

In the pivot error processing shown in FIG. 77, i.e., step 77, the pivot motor is energized (step 77-1), and then the pivot error detection is executed (step 77-2). Whether or not a pivot error exists is determined (step 77-3). If the answer of the step 77-3 is NO, the program jumps to the step 74-11 as indicated by letter C; if otherwise, the program jumps to the step 74-7 as indicated by letter F.

Figure 78:
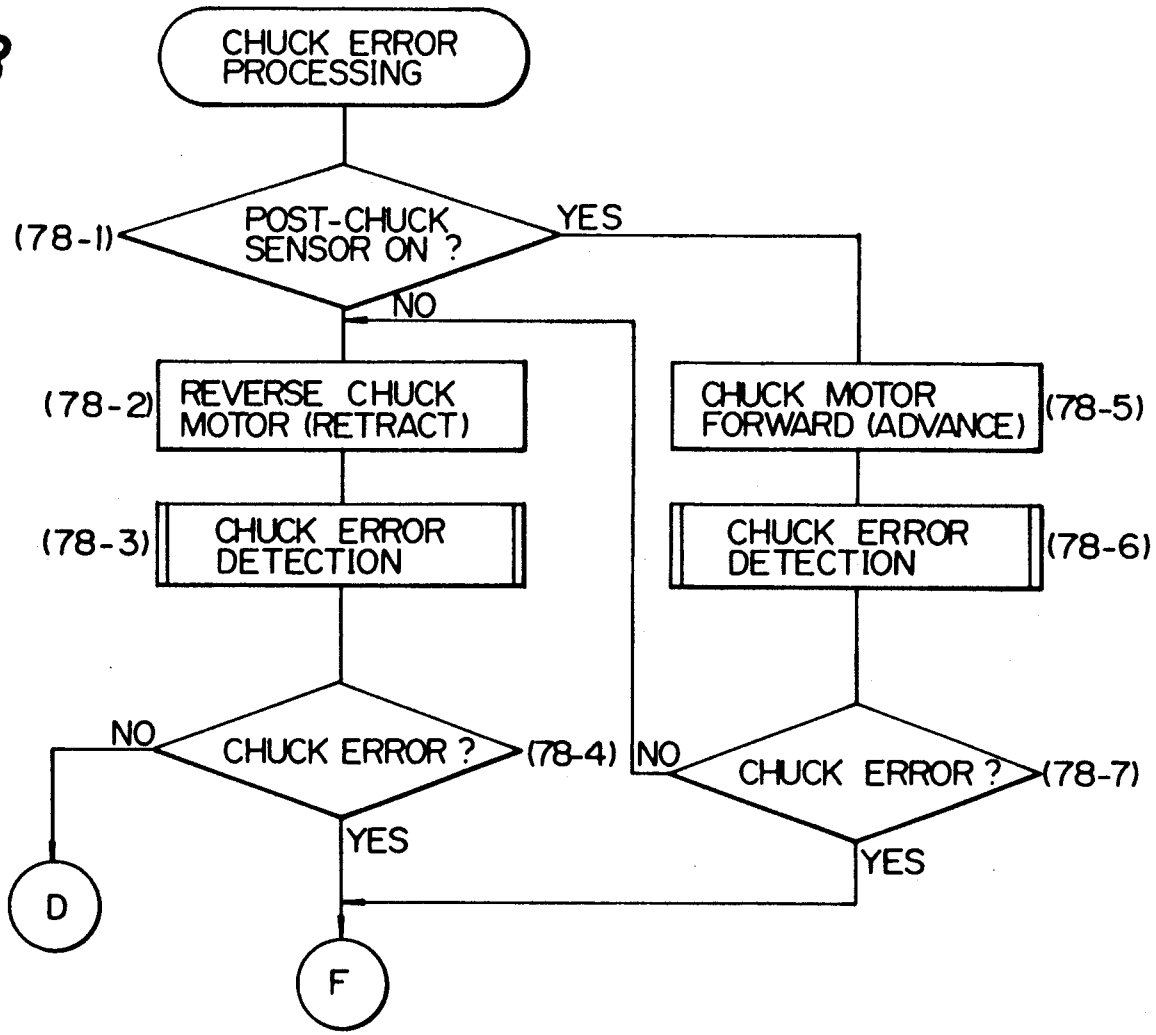
FIG. 78 is a flowchart showing chuck error processing.

In the chuck error processing shown in FIG. 78, i.e., step 78, whether or not the post-chuck sensor has been turned on is determined (step 78-1). If the answer of the step 78-1 is NO, the chuck motor is reversed to move the chuck backward (step 78-2), the chuck error detection is executed (step 78-3), and then whether or not a chuck movement error exists is determined again (step 78-4). If the answer of the step 78-4 is NO, the program jumps to the step 74-12 as indicated by letter D; if otherwise, it jumps to the step 74-7. If the answer of the step 78-1 is YES, the chuck motor is driven forward to move the chuck forward (step 78-5), the chuck error detection is executed (step 78-6), and then whether or not a chuck error exists is determined again (step 78-7). If the answer of the step 78-7 is NO, the program jumps to the step 78-2; if otherwise, it jumps to the step 74-7.

Figure 79:
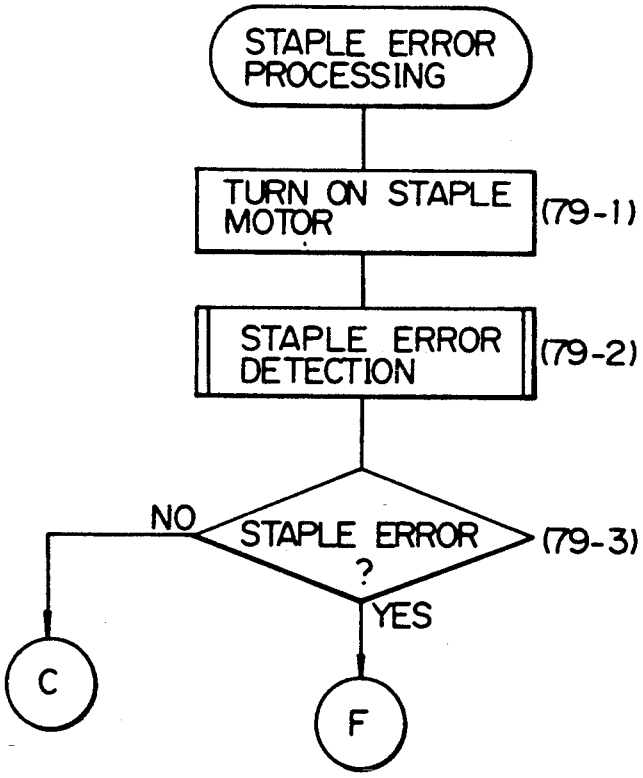
FIG. 79 is a flowchart showing staple error processing.

In the staple error processing shown in FIG. 79, i.e., step 79, the staple motor is turned on (step 79-1) and the staple error detection is executed (step 79-2). Then, whether or not a staple error exists is determined (step 79-3). If the answer of the step 79-3 is NO, the program jumps to the step 74-13 as indicated by letter E; if otherwise, it jumps to the step 74-7 as indicated by letter F.

In summary, the present invention achieves various unprecedented advantages, as enumerated below.

(1) Even when a stapling operation is interrupted halfway due to the short supply of paper sheets, paper sheets loaded on bins which follow a bin where the stapling operation is interrupted are positioned. Therefore, when copies are sorted after the supply of paper sheets, it is not necessary to position paper sheets loaded on a plurality of bins at a time. This reduces the load acting on a motor and allows paper stacks to be stapled after being surely positioned by a low-torque, inexpensive miniature motor. Especially, paper positioning and binding operations are surely effected in the previously stated dual sort and staple mode.

(2) Since a stapling operation is inhibited when each sorter means is loaded with paper sheets of different size, paper stacks which are not positioned are prevented from being stapled. This allows paper sheets of different sizes to be sorted and thereby implements the dual sort mode so as to enhance the manipulability in handling discharged paper sheets.

(3) Since paper stacks of small size distributed to the sorter means are not stapled, the same advantage as discussed above in item (2) is achievable.

(4) Stapling paper stacks which are not positioned is meaningless and, therefore, such paper stacks are not stapled or positioned. Again, this allows paper sheets of different sizes to be sorted and thereby implements the dual sort mode.

(5) Paper stacks of small size distributed to the sorter means are not positioned, while paper stacks of large size are positioned. Hence, the same advantage as discussed above in item (4) is achievable.

Various modifications will become possible for those skilled in the art after receiving the teachings of the present disclosure without departing from the scope thereof.

What is claimed is:

1. A paper handling apparatus comprising:

a plurality of bins for receiving paper sheets;

positioning means for positioning each sheet of paper distributed to said plurality of bins into a stack at a predetermined stacking position on a given bin;

stapling means for binding the paper sheets loaded on said plurality of bins to form a bound stack, the stapling means being movable between each of the plurality of bins and including stack positioning means for moving the stack between the predetermined position and a stapling position; and control means for causing said stack positioning means to act on the paper sheets even after said paper sheets have been bound by said stapling means so that the bound stack is returned to the predetermined position.

2. A paper handling apparatus as claimed in claim 1, wherein the control means causes the stack positioning means to move the bound stack to a position on a given bin at which the positioning means does not contact the bound stack until it reaches the bound stack which is located in a predetermined position.

3. A paper handling apparatus as claimed in claim 2, wherein the positioning means acts commonly on all of the plurality of bins, and even when the plurality of bins are loaded with the bound stacks, the sort control and the positioning by the positioning means are performed by using empty bins.

4. A paper handling apparatus comprising:

first sorter means and second sorter means for distributing paper sheets driven out of equipment body to a plurality of bins;

positioning means for positioning the paper sheets loaded on said plurality of bins;

stapling means for binding the paper sheets loaded on said plurality of bins;

size information sensing means for sensing size information associated with the paper sheets reached said first sorter means and said second sorter means;

size information signal detecting means for receiving from the equipment body a size information signal which is representative of a size of paper sheets driven out of said equipment body; and control means for inhibiting said stapling means from operating when the size information associated with the paper sheets provided by said first sorter means and said second sorter means are different from each other as determined on the basis of either one of said size information sensing means and said size information signal detecting means.

5. An apparatus as claimed in claim 4, wherein said control means inhibits said stapling means from acting on the paper sheets distributed to said second sorter means when said size information indicates that the paper sheets distributed to said second sorter means are smaller in size than the paper sheets distributed to said first sorter means during the course of distribution of the paper sheets to said second sorter means.

6. An apparatus as claimed in claim 4, wherein said control means inhibits said stapling means from acting on the paper sheets distributed to said first sorter means when said size information indicates that the paper sheets distributed to said first sorter means are smaller in size than the paper sheets distributed to said second sorter means during the course of distribution of said paper sheets to said first sorter means.

7. A paper handling apparatus comprising:

first sorter means and second sorter means for distributing paper sheets driven out of equipment body to a plurality of bins;

positioning means for positioning the paper sheets loaded on said plurality of bins;

stapling means for stapling the paper sheets loaded on said plurality of bins;

size information sensing means for sensing size information associated with the paper sheets reached said first sorter means and said second sorter means;

size information signal detecting means for receiving from the equipment body a size information signal representative of a size of paper sheets driven out of said equipment body; and control means for inhibiting said positioning means from operating when said size information associated with said first sorter means and said second sorter means are different from each other as determined on the basis of either one of said size information sensing means and said size information signal detecting means.

8. An apparatus as claimed in claim 7, wherein said control means inhibits said positioning means from acting on the paper sheets distributed to said second sorter means when said size information indicates that the paper sheets distributed to said second sorter means are smaller in size than the paper sheets distributed to said first sorter means during the course of distribution of said paper sheets to said second sorter means.

9. An apparatus as claimed in claim 7, wherein said control means inhibits said positioning means from acting on the paper sheets distributed to said first sorter means when said size information indicates that the paper sheets distributed to said first sorter means is smaller in size than the paper sheets distributed to said second sorter means during the course of distribution of said paper sheets to said first sorter means.

* * * * *